US011257473B2

(12) United States Patent
Yamazoe et al.

(10) Patent No.: US 11,257,473 B2
(45) Date of Patent: Feb. 22, 2022

(54) SOUNDPROOF STRUCTURE AND OPENING STRUCTURE

(71) Applicant: FUJIFILM Corporation, Tokyo (JP)

(72) Inventors: Shogo Yamazoe, Ashigara-kami-gun (JP); Shinya Hakuta, Ashigara-kami-gun (JP); Akihiko Ohtsu, Ashigara-kami-gun (JP)

(73) Assignee: FUJIFILM Corporation, Tokyo (JP)

( * ) Notice: Subject to any disclaimer, the term of this patent is extended or adjusted under 35 U.S.C. 154(b) by 481 days.

(21) Appl. No.: 16/283,042

(22) Filed: Feb. 22, 2019

(65) Prior Publication Data

US 2019/0228756 A1 Jul. 25, 2019

Related U.S. Application Data

(63) Continuation of application No. PCT/JP2017/029278, filed on Aug. 14, 2017.

(30) Foreign Application Priority Data

Aug. 23, 2016 (JP) ..... JP2016-163007
May 12, 2017 (JP) ..... JP2017-095509

(51) Int. Cl.
*G10K 11/162* (2006.01)
*G10K 11/16* (2006.01)

(52) U.S. Cl.
CPC ..... *G10K 11/162* (2013.01); *G10K 11/16* (2013.01)

(58) Field of Classification Search
CPC ..... G10K 11/162; G10K 11/16
(Continued)

(56) References Cited

U.S. PATENT DOCUMENTS 4,265,955 A 5/1981 Harp et al.
4,787,473 A 11/1988 Fuchs et al.
(Continued)

FOREIGN PATENT DOCUMENTS

EP 1657708 A1 5/2006
JP 55-308595 A 3/1980
(Continued)

OTHER PUBLICATIONS

Communication dated Sep. 10, 2019 from Japanese Patent Office in counterpart JP Application No. 2018-535613.
(Continued)

*Primary Examiner* — Forrest M Phillips
(74) *Attorney, Agent, or Firm* — Sughrue Mion, PLLC

(57) ABSTRACT

There are provided a soundproof structure and an opening structure capable of suppressing degradation of sound absorbing characteristics due to resonance vibration. A micro perforated plate having a plurality of through-holes passing therethrough in the thickness direction and a first frame body, which is disposed in contact with one surface of the micro perforated plate and has a plurality of hole portions, are provided. The opening diameter of the hole portion of the first frame body is larger than the opening diameter of the through-hole of the micro perforated plate. The opening ratio of the hole portion of the first frame body is larger than the opening ratio of the through-hole of the micro perforated plate. The resonance frequency of the micro perforated plate in contact with the first frame body is higher than the audible range.

15 Claims, 23 Drawing Sheets

(58) Field of Classification Search
USPC ..... 181/286
See application file for complete search history.

(56) References Cited

U.S. PATENT DOCUMENTS

| | | | | |
|---|---|---|---|---|
| 4,850,093 | A | 7/1989 | Parente | |
| 5,830,548 | A * | 11/1998 | Andersen | B32B 27/20 428/36.4 |
| 6,868,940 | B1 * | 3/2005 | Mekwinski | E01F 8/007 181/284 |
| 10,442,559 | B2 * | 10/2019 | Dong | E04C 2/365 |
| 2001/0050197 | A1 | 12/2001 | Wood | |
| 2004/0148891 | A1 * | 8/2004 | Porte | G10K 11/168 52/506.01 |
| 2004/0163888 | A1 | 8/2004 | Johnson | |
| 2005/0178489 | A1 | 8/2005 | Belleguic et al. | |
| 2009/0084627 | A1 * | 4/2009 | Tsugihashi | B60J 5/04 181/290 |
| 2009/0283356 | A1 | 11/2009 | Tsugihashi et al. | |
| 2015/0145274 | A1 | 5/2015 | Hirose et al. | |
| 2021/0049993 | A1 * | 2/2021 | Cazeaux | F02K 1/827 |

FOREIGN PATENT DOCUMENTS

| | | | |
|---|---|---|---|
| JP | 2006-518472 | A | 8/2006 |
| JP | 2007-011034 | A | 1/2007 |
| JP | 2007-058109 | A | 3/2007 |
| JP | 2008-046618 | A | 2/2008 |
| JP | 2015-104948 | A | 6/2015 |
| JP | 2005-338795 | A | 12/2015 |
| JP | 2016-095552 | A | 5/2016 |

OTHER PUBLICATIONS

International Search Report dated Oct. 10, 2017 from the International Searching Authority in counterpart International Application No. PCT/JP2017/029278.

International Preliminary Report on Patentability (IPRP): International Preliminary Report on Patentability dated Feb. 1, 2019 from the International Bureau in counterpart International Application No. PCT/JP2017/029278.

Written Opinion (WOp): Written Opinion dated Oct. 10, 2017 from the International Bureau in counterpart International Application No. PCT/2017/02978.

Communication dated Jul. 30, 2019 from the European Patent Office in application No. 17843442.9.

* cited by examiner

SOUNDPROOF STRUCTURE AND OPENING STRUCTURE

CROSS-REFERENCE TO RELATED APPLICATIONS

This application is a Continuation of PCT International Application No. PCT/JP2017/029278 filed on Aug. 14, 2017, which claims priority under 35 U.S.C. § 119(a) to Japanese Patent Application No. 2016-163007, filed on Aug. 23, 2016 and Japanese Patent Application No. 2017-095509, filed on May 12, 2017. Each of the above applications is hereby expressly incorporated by reference, in its entirety, into the present application.

BACKGROUND OF THE INVENTION

1. Field of the Invention

The present invention relates to a soundproof structure and an opening structure.

2. Description of the Related Art

As disclosed in JP2005-338795A, a soundproof structure using the Helmholtz resonance has a configuration in which a shielding plate is disposed on the rear surface of a plate-shaped member having a number of through-holes formed therein so that the acoustically closed space is provided. Such a Helmholtz structure has been widely used in various fields since a high sound absorption effect can be obtained at a desired frequency by changing the diameter or the length of the through-hole, the volume of the closed space, and the like.

As a new soundproof member replacing the conventional sound absorbing material such as urethane, a soundproof structure (hereinafter, also referred to as a micro perforated plate) in which a plurality of through-holes having a diameter of 1 mm or less are provided has been drawing attention (refer to JP2007-058109A). A micro perforated plate (MPP) is preferable from the viewpoint of obtaining the broadband sound absorbing characteristics. In addition, from the viewpoint of obtaining the broadband sound absorbing characteristics, the smaller the hole diameter, the better.

SUMMARY OF THE INVENTION

However, in the case of forming a hole of 1 mm or less in the micro perforated plate, it is necessary to use a thin plate or film due to processing problems. According to the studies of the present inventors, in a case where the micro perforated plate is a thin plate or film, resonance vibration with respect to low-frequency sound waves is likely to occur. For this reason, it has been found that there is a problem that the absorbance is decreased in the frequency band around the resonance vibration frequency.

Here, JP2007-058109A discloses that the strength is increased by adopting a configuration in which a reinforcement member having a plurality of opening portions provided in a micro perforated plate is attached. However, there is no mention of the problem that the absorbance is decreased in the frequency band around the resonance vibration frequency due to the resonance vibration.

It is an object of the present invention to provide a soundproof structure and an opening structure capable of suppressing a decrease in absorbance due to resonance vibration by solving the problems the above-described conventional technique.

In order to achieve the aforementioned object, the present inventors have made intensive studies and as a result, have found that the above-described problems can be solved in such a manner that a micro perforated plate having a plurality of through-holes passing therethrough in the thickness direction and a first frame body, which is disposed in contact with one surface of the micro perforated plate and has a plurality of hole portions, are provided and that the opening diameter of the hole portion of the first frame body is larger than the opening diameter of the through-hole of the micro perforated plate, the opening ratio of the hole portion of the first frame body is larger than the opening ratio of the through-hole of the micro perforated plate, and the resonance frequency of the micro perforated plate in contact with the first frame body is higher than the audible range, thereby completing the present invention.

That is, it has been found that the aforementioned object can be achieved by the following configurations.

[1] A soundproof structure comprising: a micro perforated plate having a plurality of through-holes passing therethrough in a thickness direction; and a first frame body that is disposed in contact with one surface of the micro perforated plate and has a plurality of hole portions, where an opening diameter of the hole portion of the first frame body is larger than an opening diameter of the through-hole of the micro perforated plate, an opening ratio of the hole portion of the first frame body is larger than an opening ratio of the through-hole of the micro perforated plate, and a resonance vibration frequency of the micro perforated plate in contact with the first frame body is higher than an audible range.

[2] The soundproof structure described in [1], where the opening diameter of the hole portion of the first frame body is 22 mm or less.

[3] The soundproof structure described in [1] or [2], where an average opening diameter of the through-holes of the micro perforated plate is 0.1 μm or more and 250 μm or less.

[4] The soundproof structure described in any one of [1] to [3], where an average opening diameter of the through-holes is 0.1 μm or more and less than 100 μm, and assuming that the average opening diameter of the through-holes is phi (μm) and a thickness of the micro perforated plate is t (μm), an average opening ratio rho of the through-holes is in a range having $rho_center=(2+0.25\times t)\times phi-1.6$ as its center, $rho_center-(0.052\times(phi/30)^{-2})$ as its lower limit, and $rho_center+(0.795\times(phi/30)^{-2})$ as its upper limit, which is a range larger than 0 and smaller than 1.

[5] The soundproof structure described in any one of [1] to [4] further comprising two first frame bodies that are disposed in contact with both surfaces of the micro perforated plate.

[6] The soundproof structure described in any one of [1] to [5], where the first frame body is bonded and fixed to the micro perforated plate.

[7] The soundproof structure described in any one of [1] to [6], where the micro perforated plate is formed of metal or synthetic resin.

[8] The soundproof structure described in any one of [1] to [7], where the micro perforated plate is formed of aluminum or an aluminum alloy.

[9] The soundproof structure described in any one of [1] to [8], where the first frame body has a honeycomb structure.

[10] The soundproof structure described in any one of [1] to [9], where the first frame body is formed of metal.

[11] The soundproof structure described in any one of [1] to [9], where the first frame body is formed of synthetic resin.

[12] The soundproof structure described in any one of [1] to [9], where the first frame body is formed of paper.

[13] The soundproof structure described in any one of [1] to [10], where the first frame body is formed of any one of aluminum, iron, an aluminum alloy, or an iron alloy.

[14] The soundproof structure described in any one of [1] to [13] further comprising a rear plate that is disposed on a surface of the first frame body opposite to a surface on which the micro perforated plate is disposed.

[15] The soundproof structure described in any one of [1] to [13] further comprising a rear plate that is disposed so as to be spaced apart from a laminate of the micro perforated plate and the first frame body.

[16] The soundproof structure described in any one of [1] to [15] further comprising: a second frame body having one or more opening portions; and a soundproof cell which covers the one or more opening portions of the second frame body and in which a laminate of the micro perforated plate and the first frame body is disposed.

[17] An opening structure comprising: the soundproof structure described in [16]; and an opening member having an opening, where the soundproof structure is disposed in the opening of the opening member such that a perpendicular direction of a film surface of the micro perforated plate crosses a direction perpendicular to an opening cross section of the opening member, and a region serving as a ventilation port through which gas passes is provided in the opening member.

According to the present invention, it is possible to provide a soundproof structure and an opening structure capable of suppressing a decrease in absorbance due to resonance vibration.

DESCRIPTION OF THE PREFERRED EMBODIMENTS

Hereinafter, the present invention will be described in detail.

The description of constituent elements described below may be made based on representative embodiments of the present invention, but the present invention is not limited to such embodiments.

The numerical range expressed by using "~" in this specification means a range including numerical values described before and after "~" as a lower limit and an upper limit.

Soundproof Structure

A soundproof structure according to an embodiment of the present invention is a soundproof structure which comprises a micro perforated plate having a plurality of through-holes passing therethrough in the thickness direction and a first frame body, which is disposed in contact with one surface of the micro perforated plate and has a plurality of hole portions, and in which the opening diameter of the hole portion of the first frame body is larger than the opening diameter of the through-hole of the micro perforated plate, the opening ratio of the hole portion of the first frame body is larger than the opening ratio of the through-hole of the micro perforated plate, and the resonance frequency of the micro perforated plate in contact with the first frame body is higher than the audible range.

The soundproof structure according to the embodiment of the present invention is used in a copying machine, a blower, air conditioning equipment, a ventilator, a pump, a generator, a duct, industrial equipment including various kinds of manufacturing equipment capable of emitting sound such as a coating machine, a rotary machine, and a conveyor machine, transportation equipment such as an automobile, a train, and aircraft, general household equipment such as a refrigerator, a washing machine, a dryer, a television, a copying machine, a microwave oven, a game machine, an air conditioner, a fan, a personal computer (PC), a vacuum cleaner, an air purifier, and a ventilator, and the like, and is appropriately disposed at a position through which sound generated from a noise source passes in various apparatuses.

The configuration of the soundproof structure according to the embodiment of the present invention will be described with reference to FIGS. 1 to 4.

Figure 1:
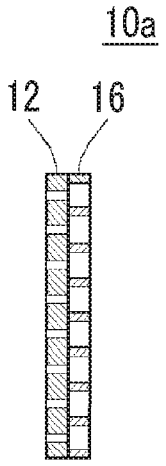
FIG. 1 is a cross-sectional view schematically showing an example of a soundproof structure of the present invention.
Figure 2:
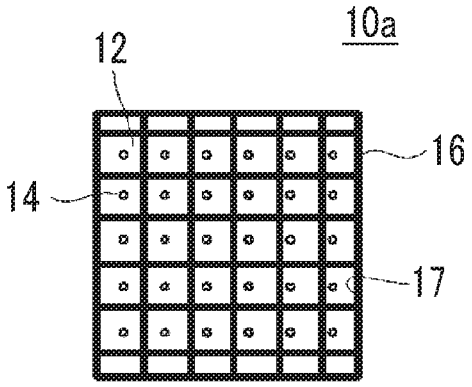
FIG. 2 is a front view schematically showing the soundproof structure shown in FIG. 1.

FIG. 1 is a schematic cross-sectional view showing an example of a preferred embodiment of the soundproof structure according to the embodiment of the present invention, and FIG. 2 is a schematic front view of the soundproof structure.

A soundproof structure 10*a* shown in FIGS. 1 and 2 has a plate-shaped micro perforated plate 12, which has a plurality of through-holes 14 passing therethrough in the thickness direction, and a first frame body 16, which has a plurality of hole portions 17 and is disposed in contact with one surface of the micro perforated plate 12.

Figure 3:
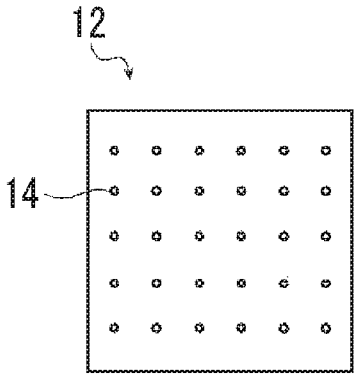
FIG. 3 is a front view schematically showing a micro perforated plate.
Figure 4:
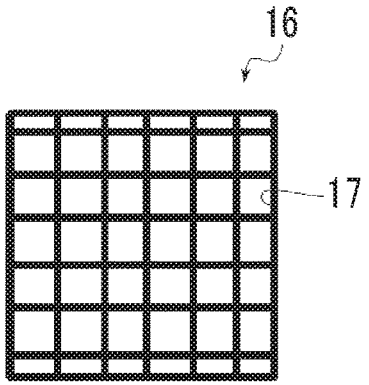
FIG. 4 is a front view schematically showing a first frame body.

FIG. 3 shows a schematic front view of an example of the micro perforated plate 12, and FIG. 4 shows a schematic front view of an example of the first frame body 16.

As shown in FIGS. 2 to 4, the opening diameter of the hole portion 17 of the first frame body 16 is larger than the opening diameter of the through-hole 14 of the micro perforated plate 12, and the opening ratio of the hole portion of the first frame body 16 is larger than the opening ratio of the through-hole 14 of the micro perforated plate 12.

Here, in the present invention, the soundproof structure 10*a* has a configuration in which the resonance frequency of the micro perforated plate in contact with the first frame body is higher than the audible range.

As described above, as a soundproof structure capable of obtaining the broadband sound absorbing characteristics, a micro perforated plate having a plurality of through-holes each having a diameter of 1 mm or less has been drawing attention. From the viewpoint of obtaining the broadband sound absorbing characteristics, in the micro perforated plate, the smaller the hole diameter provided in the micro perforated plate, the better. In the case of forming a hole of 1 mm or less in the micro perforated plate, it is necessary to use a thin plate or film due to processing problems.

However, according to the studies of the present inventors, in a case where the micro perforated plate is a thin plate or film, the micro perforated plate is likely to cause resonance vibration with respect to sound waves. For this reason, it has been found that there is a problem that the sound absorbing characteristics are degraded in the frequency band around the resonance vibration frequency.

In contrast, in the soundproof structure according to the embodiment of the present invention, by arranging the first frame body 16 having a plurality of hole portions 17 with large opening diameters in contact with the micro perforated plate 12, the stiffness of the micro perforated plate 12 is increased by the first frame body 16. In this case, by setting the opening diameter of the hole portion 17 of the first frame body 16 to an opening diameter such that the resonance vibration frequency of the micro perforated plate 12 is higher than the audible range, the resonance vibration frequency of the micro perforated plate 12 is made higher than the audible range. As a result, it is possible to suppress a decrease in absorbance due to resonance vibration in the audible range.

This point will be described with reference to FIGS. 5 and 6.

Figure 5:
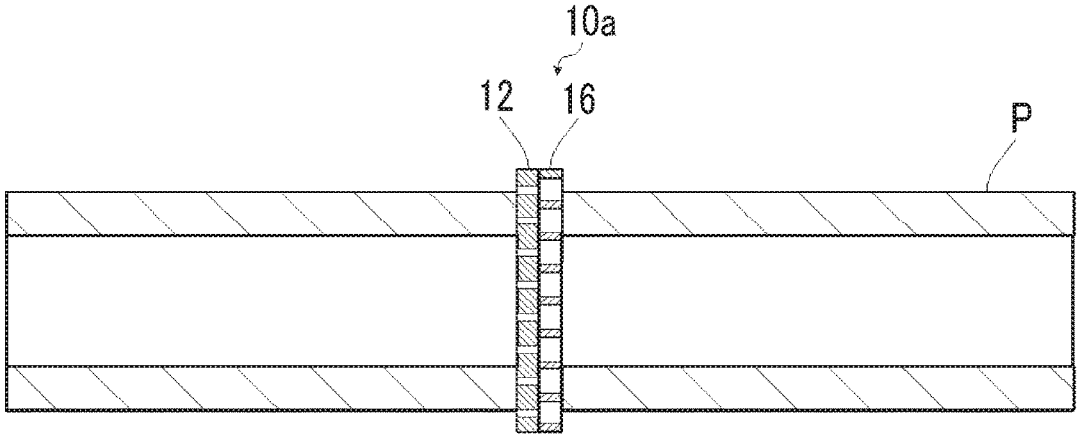
FIG. 5 is a schematic cross-sectional view illustrating a method of measuring the absorbance.
Figure 6:
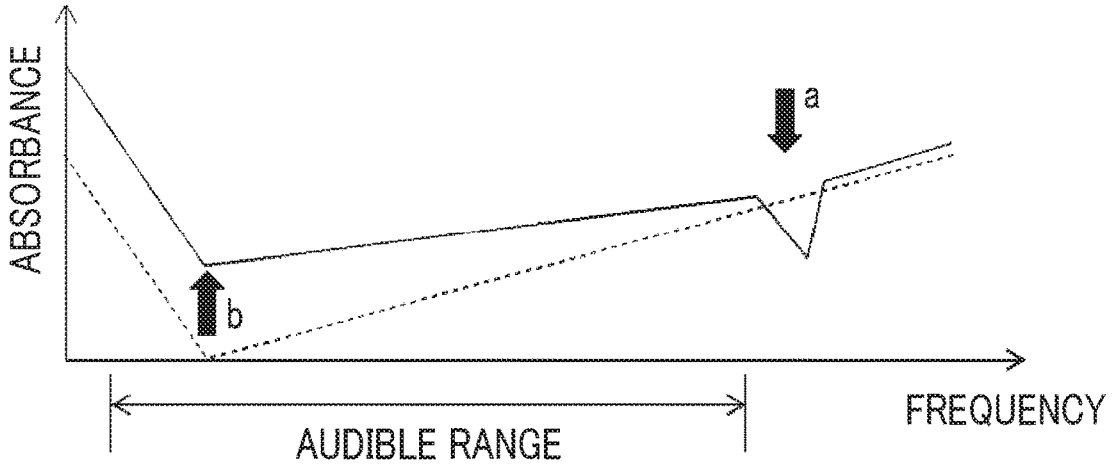
FIG. 6 is a graph conceptually showing the relationship between the absorbance and the frequency in order to describe the effect of the soundproof structure of the present invention.

FIG. 5 is a schematic cross-sectional view illustrating a method of measuring the absorbance of the soundproof structure, and FIG. 6 is a graph conceptually showing the relationship between the absorbance and the frequency.

As shown in FIG. 5, the absorbance of the soundproof structure can be calculated by arranging the soundproof structure in an acoustic tube P, measuring sounds at a plurality of positions in the acoustic tube P using a plurality of microphones (not shown), and using a transfer function method.

Specifically, in this application, the method for measuring the acoustic characteristics of the soundproof structure is based on "ASTM E2611-09: Standard Test Method for Measurement of Normal Incidence Sound Transmission of Acoustical Materials Based on the Transfer Matrix Method". This measurement method is, for example, the same measurement principle as a 4-microphone measurement method using WinZac provided by Nitto Bosei Aktien Engineering Co., Ltd. It is possible to measure the sound transmission loss in a wide spectral band using this method. In particular, by measuring the transmittance and the reflectivity at the same time and calculating 1−(transmittance+reflectivity) as the absorbance, the absorbance of the sample can also be accurately measured.

In the following description, the vertical acoustic transmittance, the reflectivity, and the absorbance are collectively referred to as acoustic characteristics.

FIG. 6 is a graph conceptually showing the relationship between the absorbance and the frequency in the case of measuring the absorbance as described above.

In FIG. 6, the absorbance in the case of a single micro perforated plate is indicated by a broken line, and the absorbance in the case of a soundproof structure having a micro perforated plate and a first frame body is indicated by a solid line.

As shown in FIG. 6, in the case of a single micro perforated plate, the resonance vibration frequency is in the audible range, and the absorbance is decreased at a specific frequency of the audible range. On the other hand, in the case of a soundproof structure having a micro perforated plate and a first frame body, since the stiffness of the micro perforated plate is increased and the resonance vibration frequency is a frequency higher than the audible range, a band in which the absorbance is decreased (indicated by an arrow a in the diagram) is generated in the vicinity of the resonance vibration frequency, but it is possible to suppress a decrease in absorbance in the audible range as indicated by an arrow b in the diagram.

As described above, according to the soundproof structure according to the embodiment of the present invention, it is possible to suppress a decrease in absorbance due to resonance vibration.

According to the studies of the present inventors, since the micro perforated plate and the through-hole are present in the configuration of the present invention, it is thought that the sound passes through one of the two kinds. The path passing through the micro perforated plate is a path in which solid vibration once converted into film vibration of the micro perforated plate is re-radiated as sound waves, and the path passing through the through-hole is a path in which the solid vibration passes directly through the through-hole as a gas propagating sound. In addition, the path passing through the through-hole is thought to be dominant as an absorption mechanism at that time. However, it is thought that the sound in a frequency band near the resonance vibration frequency (first natural vibration frequency) of the micro perforated plate mainly passes through the path in which the solid vibration is re-radiated by the film vibration of the micro perforated plate.

Here, the mechanism of sound absorption in the path passing through the through-hole is estimated to be a change of sound energy to heat energy due to friction between the inner wall surface of the through-hole and the air in a case where the sound passes through the micro through-hole. In a case where the sound passes through the through-hole portion, the sound is concentrated from a wide area on the entire micro perforated plate to a narrow area of the through-hole to pass through the through-hole portion. The local speed extremely increases as the sound collects in the through-hole. Since friction correlates with speed, the friction in the micro through-holes increases to be converted into heat.

In a case where the average opening diameter of the through-holes is small, the ratio of the edge length of the through-hole to the opening area is large. Therefore, it is thought that the friction generated at the edge portion or the inner wall surface of the through-hole can be increased. By increasing the friction in a case where the sound passes through the through-hole, the sound energy can be converted into heat energy. As a result, the sound can be more efficiently absorbed.

In addition, since sound is absorbed by friction in a case where the sound passes through the through-hole, it is possible to absorb the sound regardless of the frequency band of the sound. Therefore, it is possible to absorb the sound in a broad band.

As described above, in the present invention, the apparent stiffness of the micro perforated plate is increased by arranging the first frame body in contact with the micro perforated plate, so that the resonance vibration frequency is made higher than the audible range. Accordingly, since the sound in the audible range mainly passes through the path passing through the through-hole rather than the path in which the solid vibration is re-radiated by the film vibration of the micro perforated plate, the sound in the audible range is absorbed by friction at the time of passing through the through-hole.

The first natural vibration frequency of the micro perforated plate 12 disposed in contact with the first frame body 16 is a frequency of the natural vibration mode at which the sound wave most vibrates the film due to the resonance phenomenon. The sound wave is largely transmitted at the frequency. In the present invention, the first natural vibration frequency is determined by a structure configured to include the first frame body 16 and the micro perforated plate 12 or a structure further having a second frame body 18. Therefore, it has been found by the present inventors that approximately the same value is obtained regardless of the presence or absence of the through-hole 14 perforated in the micro perforated plate 12.

At frequencies near the first natural vibration frequency, since the film vibration increases, the sound absorption effect due to friction with micro through-holes is reduced. Therefore, in the soundproof structure according to the embodiment of the present invention, the absorbance is minimized at the first natural vibration frequency±100 Hz.

In the present invention, the audible range is 100 Hz to 20000 Hz. Therefore, in the soundproof structure according to the embodiment of the present invention, the resonance vibration frequency of the micro perforated plate is higher than 20000 Hz.

The micro perforated plate has micro through-holes. Accordingly, even in a case where a liquid such as water adheres to the micro perforated plate, water does not block the through-hole avoiding the through-hole due to the surface tension, so that the sound absorbing performance is hardly lowered.

In addition, since the micro perforated plate is a thin plate-shaped (film-shaped) member, the micro perforated plate can be bent according to the arrangement location.

In the example shown in FIG. 1, the first frame body 16 is disposed in contact with one surface of the micro perforated plate 12. However, the present invention is not limited thereto, and the first frame body 16 may be disposed in contact with both surfaces of the micro perforated plate 12 as in a soundproof structure 10*b* shown in FIG. 7.

By arranging the first frame body 16 on each of both the surfaces of the micro perforated plate 12, the stiffness of the micro perforated plate can be further increased, and the resonance vibration frequency can be made higher. Therefore, the resonance vibration frequency of the micro perforated plate 12 can be easily made higher than the audible range.

The two first frame bodies 16 disposed on both the surfaces of the micro perforated plate 12 may have the same configuration, or may have different configurations. For example, the opening diameters, opening ratios, materials, and the like of the hole portions in the two first frame bodies 16 may be the same or different.

Although the micro perforated plate 12 and the first frame body 16 may be disposed in contact with each other, it is preferable that the micro perforated plate 12 and the first frame body 16 are bonded and fixed.

By bonding and fixing the micro perforated plate 12 and the first frame body 16, the stiffness of the micro perforated plate can be further increased, and the resonance vibration frequency can be made higher. Therefore, the resonance vibration frequency of the micro perforated plate 12 can be easily made higher than the audible range.

The adhesive to be used in the case of bonding and fixing the micro perforated plate 12 and the first frame body 16 may be selected according to the material of the micro perforated plate 12 and the material of the first frame body 16 and the like. Examples of the adhesive include epoxy based adhesives (Araldite (registered trademark) (manufactured by Nichiban Co., Ltd.) and the like), cyanoacrylate based adhesives (Aron Alpha (registered trademark) (manufactured by Toagosei Co., Ltd.) and the like), and acrylic based adhesives.

The soundproof structure according to the embodiment of the present invention may have a configuration in which a second frame body having one or more opening portions is further provided and a laminate of the micro perforated plate and the first frame body is disposed so as to cover the opening portion of the second frame body.

Figure 8:
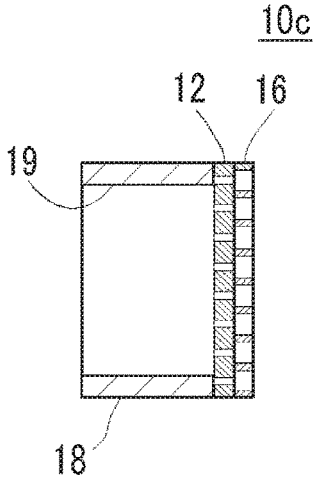
FIG. 8 is a cross-sectional view schematically showing another example of the soundproof structure of the present invention.

FIG. 8 shows a schematic cross-sectional view of another example of the soundproof structure according to the embodiment of the present invention.

A soundproof structure 10*c* shown in FIG. 8 has a micro perforated plate 12, a first frame body 16, and a second frame body 18.

In the soundproof structure shown in FIG. 8, the second frame body 18 has one opening portion 19 passing therethrough, and the laminate of the micro perforated plate 12 and the first frame body 16 is disposed so as to cover one of the opening surfaces having the opening portion 19.

As shown in FIG. 8, the opening diameter of the opening portion 19 of the second frame body 18 is larger than the opening diameter of the hole portion 17 of the first frame body 16, and the opening ratio of the opening portion 19 of the second frame body 18 is larger than the opening ratio of the hole portion 17 of the first frame body 16.

In this manner, by adopting the configuration in which the second frame body 18 is further included, the stiffness of the micro perforated plate 12 can be further increased, and the resonance vibration frequency can be made higher. Therefore, the resonance vibration frequency of the micro perforated plate 12 can be easily made higher than the audible range.

In the example shown in FIG. 8, the second frame body 18 is disposed in contact with the micro perforated plate 12 side of the laminate. However, the second frame body 18 may be disposed in contact with the first frame body 16 side of the laminate.

The method of fixing the second frame body 18 and the laminate (laminate of the micro perforated plate 12 and the first frame body 16) is not particularly limited. Any method may be used as long as the second frame body 18 and the laminate can be fixed. For example, a method using an adhesive, a method using a physical fixture, and the like can be mentioned.

In the method using an adhesive, an adhesive is applied onto the surface of the second frame body 18 surrounding the opening and the laminate is placed thereon, so that the laminate is fixed to the second frame body 18 with the adhesive. Examples of the adhesive include epoxy based adhesives (Araldite (registered trademark) (manufactured by Nichiban Co., Ltd.) and the like), cyanoacrylate based adhesives (Aron Alpha (registered trademark) (manufactured by Toagosei Co., Ltd.) and the like), and acrylic based adhesives.

As a method using a physical fixture, a method can be mentioned in which the laminate disposed so as to cover the opening of the second frame body 18 is interposed between the second frame body 18 and a fixing member, such as a rod, and the fixing member is fixed to the second frame body 18 by using a fixture, such as a screw.

In the example shown in FIG. 8, the second frame body 18 is configured to have one opening portion 19. However, the present invention is not limited thereto, and the second frame body 18 may have two or more opening portions 19.

In the following description, a configuration in which a laminate (laminate of the micro perforated plate 12 and the first frame body 16) is disposed in the opening portion 19 of the second frame body 18 having one opening portion 19 is also referred to as a "one soundproof cell". The soundproof structure according to the embodiment of the present invention may be configured to have a plurality of such soundproof cells. In the case of a soundproof structure having a plurality of soundproof cells, the second frame bodies 18 of the plurality of soundproof cells are integrally formed. The micro perforated plate 12 and the first frame body 16 of each of the plurality of soundproof cells may be integrally formed.

In the example shown in FIG. 8, the one second frame body 18 is provided. However, the present invention is not limited thereto, and the second frame body 18 may be disposed on each of both surfaces of the laminate of the micro perforated plate 12 and the first frame body 16.

Figure 9:
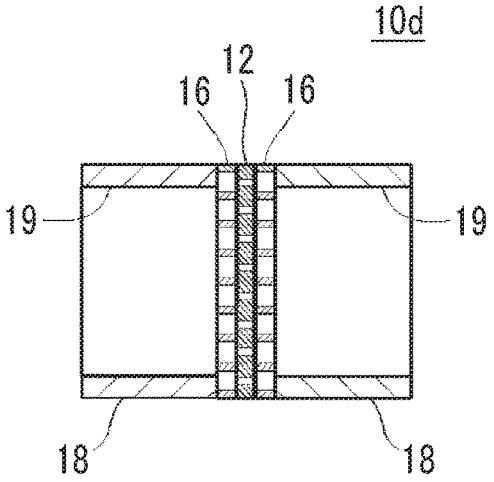
FIG. 9 is a cross-sectional view schematically showing another example of the soundproof structure of the present invention.

FIG. 9 shows a schematic cross-sectional view of another example of the soundproof structure according to the embodiment of the present invention.

A soundproof structure 10*d* shown in FIG. 9 has a micro perforated plate 12, two first frame bodies 16 disposed on both surfaces of the micro perforated plate 12, and two second frame bodies 18 disposed in the two first frame bodies 16. That is, the soundproof structure 10*d* shown in FIG. 9 has a configuration in which the micro perforated plate 12 is interposed between the two first frame bodies 16 and a laminate, in which the micro perforated plate 12 is interposed between the first frame bodies 16, is interposed between the two second frame bodies 18.

In this manner, by interposing the laminate of the micro perforated plate 12 and the first frame body 16 between the two second frame bodies 18, the stiffness of the micro perforated plate 12 can be further increased, and the resonance vibration frequency can be made higher. Therefore, the resonance vibration frequency of the micro perforated plate 12 can be easily made higher than the audible range.

In the example shown in FIG. 9, the laminate in which the micro perforated plate 12 is interposed between the two first frame bodies 16 is interposed between the two second frame bodies 18. However, the present invention is not limited thereto, and a laminate in which the first frame body 16 is disposed on one surface of the micro perforated plate 12 may be interposed between the two second frame bodies 18.

In FIG. 8, the first frame body 16 and the second frame body 18 are separate members. However, the first frame body 16 and the second frame body 18 may be integrated. Alternatively, the micro perforated plate 12, the first frame body 16, and the second frame body 18 may be integrated.

A member in which the first frame body 16 and the second frame body 18 are integrated can be manufactured using a 3D printer, for example. A member in which the micro perforated plate 12, the first frame body 16, and the second frame body 18 are integrated can be manufactured by integrally molding a plate-shaped member forming the micro perforated plate 12 and the first frame body 16 and the second frame body 18 using a 3D printer and then forming the micro through-hole 14 in the plate-shaped member with a laser.

Figure 10:
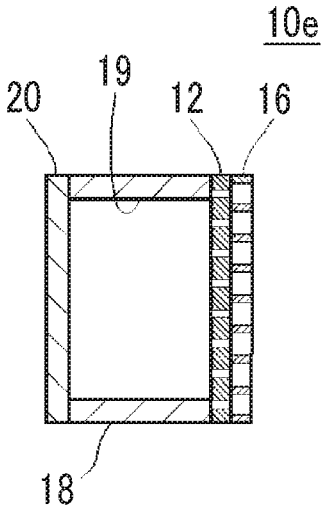
FIG. 10 is a cross-sectional view schematically showing another example of the soundproof structure of the present invention.

In the example shown in FIG. 8, the opening surface of the second frame body 18 on a side opposite to the surface on which the laminate is disposed is open. However, the present invention is not limited thereto, and a rear plate 20 that covers the opening portion 19 may be disposed on the opening surface of the second frame body on a side opposite to the surface on which the laminate is disposed, as shown in FIG. 10. In the present invention, gas (air) is present in a region between the laminate and the rear plate 20. That is, the laminate, the second frame body 18, and the rear plate 20 form an approximately closed space.

Figure 46:
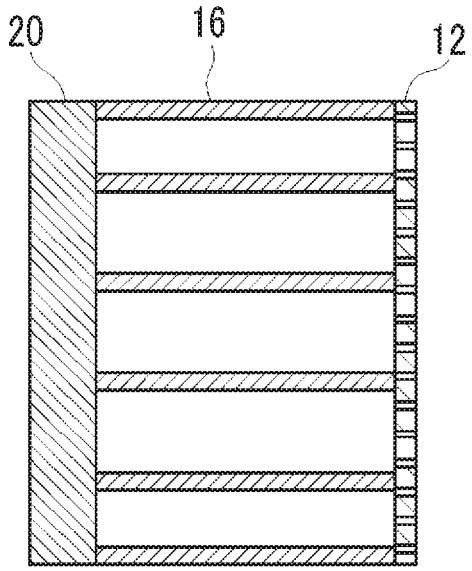
FIG. 46 is a cross-sectional view schematically showing another example of the soundproof structure of the present invention.

Alternatively, as shown in FIG. 46, a configuration may be adopted in which the second frame body is not provided, the micro perforated plate 12, the first frame body 16, and the rear plate 20 are provided, and the rear plate 20 is disposed on the surface of the first frame body 16 on a side opposite to the surface on which the micro perforated plate 12 is disposed. Even in such a configuration, gas (air) is present in a region between the micro perforated plate 12 and the rear plate 20, and the micro perforated plate 12, the first frame body 16, and the rear plate 20 form an approximately closed space. In the case of such a configuration, it is preferable that the thickness of the first frame body 16 is 5 mm or more. In addition, it is preferable that the opening diameter of the hole portion 17 of the first frame body 16 is 1 mm or more.

It is preferable that the thickness of the rear plate 20 is 0.1 mm to 10 mm.

As the material of the rear plate 20, various metals, such as aluminum and iron, and various resin materials, such as polyethylene terephthalate (PET), can be used.

The rear plate 20 may be constituent components of various apparatuses in which the soundproof structure is provided, a wall, or the like. That is, for example, in a case where the soundproof structure configured to include the micro perforated plate and the first frame body is installed on the wall, the surface of the first frame body on a side opposite to the surface on which the micro perforated plate is disposed may be disposed in contact with the wall, so that the wall is used as the rear plate 20.

Opening Structure

An opening structure according to the embodiment of the present invention is an opening structure which has the above-described soundproof structure and an opening member having an opening and in which the soundproof structure is disposed in the opening of the opening member such that the perpendicular direction of the film surface of the micro perforated plate crosses a direction perpendicular to the opening cross section of the opening member and a region serving as a ventilation port through which gas passes is provided in the opening member.

Figure 11:
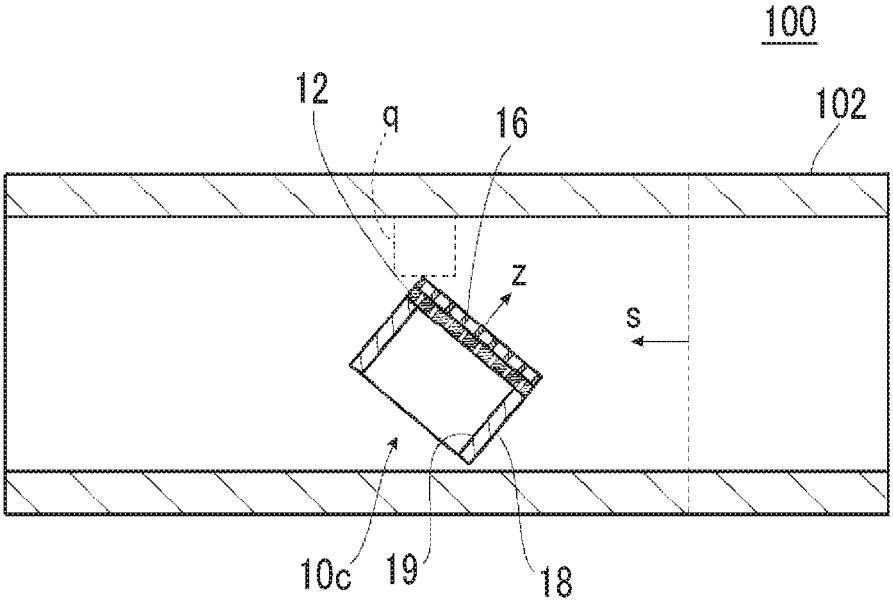
FIG. 11 is a cross-sectional view schematically showing an example of an opening structure of the present invention.

FIG. 11 is a cross-sectional view schematically showing an example of the opening structure according to the embodiment of the present invention.

An opening structure 100 shown in FIG. 11 has the soundproof structure 10*c* and an opening member 102, and the soundproof structure 10*c* is disposed in the opening of the opening member 102.

As shown in FIG. 11, in the opening structure 100, the soundproof structure 10*c* is disposed such that a perpendicular direction z of the film surface of the micro perforated plate 12 crosses a direction s perpendicular to the opening cross section of the opening member 102. Between the opening of the opening structure 100 and the soundproof structure 10*c* disposed in the opening, a region q serving as a ventilation port through which gas can pass is provided.

The soundproof structure 10*c* shown in FIG. 11 is a soundproof structure having the same configuration as the soundproof structure 10*c* shown in FIG. 8. The soundproof structure used in the opening structure according to the embodiment of the present invention may be any soundproof structure having the micro perforated plate 12, the first frame body 16, and the second frame body 18.

In a case where the opening member 102 is a tubular member having a length, such as a duct, and the soundproof structure 10*c* is disposed in the opening member 102, since the sound travels through the opening of the opening member 102 in the direction s approximately perpendicular to the opening cross section, the direction s approximately perpendicular to the opening cross section is the direction of the sound source. Therefore, by making the perpendicular direction z of the film surface of the micro perforated plate 12 inclined with respect to the direction s perpendicular to the opening cross section of the opening member 102, the perpendicular direction z of the film surface is inclined with respect to the direction of the sound source as a soundproofing target. That is, the opening structure according to the embodiment of the present invention absorbs sounds that hit the film surface obliquely or in parallel thereto without hitting the film surface in a direction perpendicular to the film surface.

In the example shown in FIG. 11, the soundproof structure 10*c* is disposed such that the perpendicular direction of the film surface of the micro perforated plate 12 is about 45° with respect to the direction s perpendicular to the opening cross section of the opening member 102. However, the present invention is not limited thereto, and the soundproof structure 10*c* may be disposed such that the perpendicular direction z of the film surface of the micro perforated plate 12 crosses the direction s perpendicular to the opening cross section of the opening member 102.

From the viewpoints of sound absorbing performance and air permeability, that is, viewpoints of increasing the size of a ventilation hole, reducing the amount of wind hitting the film surface in the case of a noise structure accompanied by wind, such as a fan, and the like, the angle of the perpendicular direction z of the film surface of the micro perforated plate 12 of the soundproof structure 10*c* with respect to the direction s perpendicular to the opening cross section of the opening member 102 is preferably 20° or more, more preferably 45° or more, and even more preferably 80° or more. The upper limit of the above angle is 90°.

In the illustrated example, the soundproof structure 10*c* is disposed in the opening of the opening member 102. However, the present invention is not limited thereto, and the soundproof structure 10*c* may be disposed at a position protruding from the end surface of the opening member 102. Specifically, it is preferable that the soundproof structure 10*c* is disposed within the opening end correction distance from the opening end of the opening member 102. In a case where the opening member 102 is used, the antinode of the standing wave of the sound field is located outside the opening 22*a* of the opening member 102 by the distance of opening end correction. Therefore, the soundproofing performance can be obtained even outside the opening member 102. In the case of the cylindrical opening member 102, the opening end correction distance is approximately 0.61×tube radius.

Here, assuming that only the micro perforated plate without the second frame body is horizontally disposed in the opening member in a direction perpendicular to the opening cross section of the opening member, the sound pressure and the local speed on both surfaces of the film are completely the same. In this case, since the same pressure is applied from both the surfaces, the force by which the sound travels toward the opposite surface through the micro hole (that is, the force in a direction having an element of the perpendicular component of the film) does not work. Therefore, it can be inferred that absorption does not occur in this case.

In contrast, in the opening structure according to the embodiment of the present invention, since the second frame body is present, the sound traveling toward the soundproof structure wraps around by the second frame body. In this case, in a case where the distances from both the surfaces of the micro perforated plate to the frame end are different, distances through which sound wrapping around from both surfaces of the frame passes are different. Therefore, it is thought that there is an effect of creating the perpendicular direction component of the micro perforated plate by giving a phase difference to the sound fields on both the surfaces of the micro perforated plate and changing the local traveling direction of the sound by the effect of diffraction. That is, by providing the second frame body, it is possible to change the phases on both the surfaces of the micro perforated plate, make the sound pressure and the local speed different, and make the air pass through the micro through-hole. Therefore, sound energy can be converted into heat energy by friction between the inner wall surface of the through-hole and the air, and the sound can be absorbed.

Here, in the opening structure 100 shown in FIG. 11, the soundproof structure 10*c* having one soundproof cell is disposed in the opening member 102. However, the present invention is not limited thereto, and a soundproof structure having two or more soundproof cells may be disposed in the opening member 102. Alternatively, two or more soundproof structures may be disposed in the opening member 102.

In the present invention, it is preferable that the opening member has an opening formed in the region of the object that blocks the passage of gas, and it is preferable that the opening member is provided in a wall separating two spaces from each other.

Here, the object that has a region where an opening is formed and that blocks the passage of gas refers to a member, a wall, and the like separating two spaces from each other. The member refers to a member, such as a tubular body and a tubular member. The wall refers to, for example, a fixed wall forming a building structure such as a house, a building, and a factory, a fixed wall such as a fixed partition disposed in a room of a building to partition the inside of the room, or a movable wall such as a movable partition disposed in a room of a building to partition the inside of the room.

In the present invention, the opening member is a member having an opening portion for the purpose of ventilation, heat dissipation, and movement of substances, such as a window frame, a door, an entrance, a ventilation opening, a duct portion, and a louver portion. That is, the opening member may be a tubular body, such as a duct, a hose, a pipe, and a conduit, or a tubular member, or may be a ventilation opening portion to which a louver, a gully, or the like can be attached and a wall itself having an opening for attaching a window or the like, or may be a portion configured to include a partition upper portion and a ceiling and/or a wall, or may be a window member, such as a window frame attached to a wall. That is, it is preferable that a portion surrounded by the closed curve is the opening portion and the soundproof structure according to the embodiment of the present invention is disposed therein.

In the present invention, the cross-sectional shape of the opening is not limited as long as the soundproof structure can be disposed in the opening of the opening member. For example, the cross-sectional shape of the opening may be a circle, a quadrangle such as a square, a rectangle, a diamond, and a parallelogram, a triangle such as an equilateral triangle, an isosceles triangle, and a right triangle, a polygon including a regular polygon such as a regular pentagon and a regular hexagon, an ellipse, and the like, or may be an irregular shape.

The material of the opening member according to the embodiment of the present invention is not particularly limited, and examples thereof include a metal material, a resin material, a reinforced plastic material, a carbon fiber, and a wall material. Examples of the metal material include metal materials, such as aluminum, titanium, magnesium, tungsten, iron, steel, chromium, chromium molybdenum, nichrome molybdenum, and alloys thereof. Examples of the resin material include resin materials, such as acrylic resin, methyl polymethacrylate, polycarbonate, polyamideide, polyarylate, polyether imide, polyacetal, polyether ether ketone, polyphenylene sulfide, polysulfone, polyethylene terephthalate, polybutylene terephthalate, polyimide, and triacetyl cellulose. Examples of the reinforced plastic material include carbon fiber reinforced plastics (CFRP) and glass fiber reinforced plastics (GFRP). Examples of the wall material include wall materials, such as concrete, mortar, and wood similar to the wall material of the building structure.

Hereinafter, constituent elements of the soundproof structure according to the embodiment of the present invention will be described.

The micro perforated plate 12 has a plurality of through-holes 14, and absorbs or reflects the energy of sound waves to insulate sound by making the sound pass through the through-hole 14 and causing film vibration corresponding to the sound wave from the outside.

Here, as described above, in the present invention, since the micro perforated plate 12 is disposed in contact with the first frame body 16, the micro perforated plate 12 is fixed so as to be restrained by the first frame body 16, and the resonance vibration frequency is higher than the audible range.

The micro perforated plate 12 has a plurality of through-holes 14 passing therethrough in the thickness direction. It is preferable that a plurality of through-holes 14 formed in the micro perforated plate 12 have an average opening diameter of 0.1 μm or more and 250 μm or less.

As described above, the micro perforated plate 12 and the first frame body 16 may be in contact with each other, and may not be fixed. However, it is preferable that the micro perforated plate 12 and the first frame body 16 are fixed with an adhesive.

According to the studies of the present inventors, it has been found that there is an optimum ratio in the average opening ratio of through-holes and in particular, in a case where the average opening diameter is as relatively large as about 50 μm or more, the absorbance increases as the average opening ratio decreases. In a case where the average opening ratio is large, sound passes through a number of through-holes. In contrast, in a case where the average opening ratio is small, the number of through-holes is reduced. Accordingly, the amount of sound passing through one through-hole is increased. For this reason, it is thought that the local speed of air in a case where the sound passes through the through-hole is further increased so that the friction generated at the edge portion or the inner wall surface of the through-hole can be made larger.

Here, from the viewpoints of sound absorbing performance and the like, the average opening diameter of the through-hole is preferably 100 μm or less, more preferably 80 μm or less, even more preferably 70 μm or less, and particularly preferably 50 μm or less.

In addition, the lower limit of the average opening diameter is preferably 0.5 μm or more, more preferably 1 μm or more, and even more preferably 2 μm or more. In a case where the average opening diameter is too small, since the viscous resistance in a case where the sound passes through the through-hole is too high, the sound does not pass through the through-hole sufficiently. Therefore, even in a case where the opening ratio is increased, a sufficient sound absorption effect cannot be obtained.

The average opening ratio of the through-holes may be appropriately set according to the average opening diameter or the like. However, from the viewpoints of sound absorbing performance, air permeability, and the like, the average opening ratio of the through-hole is preferably 2% or more, more preferably 3% or more, and even more preferably 5% or more. In a case where air permeability and heat exhaust performance are more important, 10% or more is preferable.

Here, the micro perforated plate 12 preferably has a configuration in which the average opening diameter of a plurality of through-holes 14 is 0.1 μm or more and less than 100 μm and assuming that the average opening diameter is phi (μm) and the thickness of the micro perforated plate 12 is t (μm), an average opening ratio rho of the through-hole 14 is in a range larger than 0 and smaller than 1, that is, a range having $rho_center=(2+0.25\times t)\times phi^{-1.6}$ as its center, $rho_center-(0.052\times(phi/30)^{-2})$ as its lower limit, and $rho_center+(0.795\times phi/30)^{-2})$ as its upper limit.

Since the average opening diameter of the through-holes is 0.1 μm or more and less than 100 μm and the average opening ratio rho of the through-hole 14 is in a range larger than 0 and smaller than 1, that is, a range having $rho_center=(2+0.25\times t)\times phi^{-1.6}$ as its center, $rho_center-(0.052\times(phi/30)^{-2})$ as its lower limit, and $rho_center+(0.795\times(phi/30)^{-2})$ as its upper limit assuming that the average opening diameter of a plurality of through-holes 14 is phi (μm) and the thickness of the micro perforated plate 12 is t (μm), a higher sound absorption effect can be obtained.

The average opening ratio rho is preferably in the range of $rho_center-0.050\times(phi/30)^{-2}$ or more and $rho_center+0.505\times(phi/30)^{-2}$ or less, more preferably in the range of $rho_center-0.048\times(phi/30)^{-2}$ or more and $rho_center+0.345\times(phi/30)^{-2}$ or less, even more preferably in the range of $rho_center-0.085\times(phi/20)^{-2}$ or more and $rho_center+0.35\times(phi/20)^{-2}$ or less, particularly preferably in the range of $rho_center-0.24\times(phi/10)^{-2}$ or more and $rho_center+0.57\times(phi/10)^{-2}$ or less, and most preferably in the range of $rho_center-0.185\times(phi/10)^{-2}$ or more and $rho_center+0.34\times(phi/10)^{-2}$ or less. This point will be described in detail in a simulation to be described later.

For the average opening diameter of through-holes, the surface of the micro perforated plate is imaged at a magnification of 200 times from one surface of the micro perforated plate using a high-resolution scanning electron microscope (SEM, manufactured by Hitachi High-Technologies Corporation: FE-SEMS-4100), 20 through-holes whose surroundings are annularly connected are extracted in the obtained SEM photograph, the opening diameters of the through-holes are read, and the average value of the opening diameters is calculated as the average opening diameter. In a case where there are less than 20 through-holes in one SEM photograph, SEM photographs are taken at different positions in the surrounding area and counted until the total number reaches 20.

The opening diameter was evaluated using a diameter (circle equivalent diameter) in a case where the area of the through-hole portion was measured and replaced with a circle having the same area. That is, since the shape of the opening portion of the through-hole is not limited to the approximately circular shape, the diameter of a circle having the same area was evaluated in a case where the shape of the opening portion is a non-circular shape. Therefore, for example, even in the case of through-holes having such a shape that two or more through-holes are integrated, these are regarded as one through-hole, and the circle equivalent diameter of the through-hole is taken as the opening diameter.

For these tasks, for example, all circle equivalent diameters, opening ratios, and the like can be calculated by Analyze Particles using "Image J" (https://imagej.nih.gov/ij/).

In addition, for the average opening ratio, Using the high resolution scanning electron microscope (SEM), the surface of the micro perforated plate is imaged from directly thereabove at a magnification of 200 times, a through-hole portion and a non-through-hole portion are observed by performing binarization with image analysis software or the like for the field of view (five places) of 30 mm×30 mm of the obtained SEM photograph, a ratio (opening area/geometrical area) is calculated from the sum of the opening areas of the through-holes and the area of the field of view (geometric area), and an average value in each field of view (five places) is calculated as the average opening ratio.

Here, in the soundproof structure according to the embodiment of the present invention, the plurality of through-holes may be regularly arranged, or may be randomly arranged. From the viewpoints of productivity of micro through-holes, robustness of sound absorbing characteristics, suppression of sound diffraction, and the like, it is preferable that the through-holes are randomly arranged. Regarding sound diffraction, in a case where the through-holes are periodically arranged, a diffraction phenomenon of sound occurs according to the period of the through-hole. Accordingly, there is a concern that the sound is bent by diffraction and the traveling direction of noise is divided into a plurality of directions. Random is an arrangement state in which there is no periodicity like a complete arrangement, and the absorption effect by each through-hole appears but the diffraction phenomenon due to the minimum distance between through-holes does not occur.

In the embodiment of the present invention, there are samples manufactured by etching treatment in continuous treatment in a roll form. However, for mass production, it is easier to form a random pattern at once using surface treatment or the like rather than a process for manufacturing a periodic arrangement. Accordingly, from the viewpoint of productivity, it is preferable that the through-holes are randomly arranged.

In the present invention, the fact that the through-holes are randomly arranged is defined as follows.

In the case of the completely periodic structure, strong diffracted light appears. Even in a case where only a small part of the periodic structure is different in position, diffracted light appears due to the remaining structure. Since the diffracted light is a wave formed by superimposing scattered light beams from the basic cell of the periodic structure, interference due to the remaining structure causes the diffracted light even in a case where only a small part is disturbed. This is a mechanism of the diffracted light.

Therefore, as the number of basic cells disturbed from the periodic structure increases, the amount of scattered light that causes interference for making the intensity of diffracted light strong is reduced. As a result, the intensity of diffracted light is reduced.

Accordingly, "random" in the present invention indicates that at least 10% of all the through-holes deviate from the periodic structure. From the above discussion, in order to suppress the diffracted light, the more basic cells deviating from the periodic structure, the more desirable. For this reason, a structure in which 50% of all the through-holes is deviated is preferable, a structure in which 80% of all the through-holes is deviated is more preferable, and a structure in which 90% of all the through-holes is deviated is even more preferable.

As a verification of the deviation, it is possible to take an image in which five or more through-holes are present and analyze the image. As the number of through-holes included becomes higher, it is possible to perform the more accurate analysis. Any image can be used as long as the image is an image that can be recognized by an optical microscope and a SEM and an image in which the positions of a plurality of through-holes can be recognized.

In a captured image, focusing on one through-hole, a distance between the one through-hole and a through-hole therearound is measured. It is assumed that the shortest distance is a1 and the second, third and fourth shortest distances are a2, a3, and a4. In a case where two or more distances of a1 to a4 are the same (for example, the matching distance is assumed to be b1), the through-hole can be determined as a hole having a periodic structure with respect to the distance b1. On the other hand, in a case where neither distances of a1 to a4 are the same, the through-hole can be determined as a through-hole deviating from the periodic structure. This work is performed for all the through-holes on the image to perform determination.

Here, the above "the same" is assumed to be the same up to the deviation of $\Phi$ assuming that the hole diameter of the through-hole of interest is $\Phi$. That is, it is assumed that a2 and a1 are the same in the case of the relationship of $a2-\Phi<a1<a2+\Phi$. It is thought that this is because scattered light from each through-hole is considered for diffracted light and scattering occurs in the range of the hole diameter $\Phi$.

Then, for example, the number of "through-holes having a periodic structure with respect to the distance of b1" is counted, and the ratio of the number of the through-holes having a periodic structure with respect to the distance of b1 to the number of all the through-holes on the image is calculated. Assuming that the ratio is c1, the ratio c1 is the ratio of through-holes having a periodic structure, 1−c1 is the ratio of through-holes deviated from the periodic structure, 1−c1 is a numerical value that determines the above-described "random". In a case where there are a plurality of distances, for example, "through-holes having a periodic structure with respect to the distance of b1" and "through-holes having a periodic structure with respect to the distance of b2", counting is separately performed for b1 and b2. Assuming that the ratio of the periodic structure with respect to the distance of b1 is c1 and the ratio of the periodic structure with respect to the distance of b2 is c2, the structure in a case where both (1−c1) and (1−c2) are 10% or more is "random".

On the other hand, in a case where either (1−c1) or (1−c2) is less than 10%, the structure has a periodic structure and is not "random". In this manner, for all of the ratios c1, c2, . . . , in a case where the condition of "random" is satisfied, the structure is defined as "random".

A plurality of through-holes may be through-holes having one kind of opening diameter, or may be through-holes having two or more kinds of opening diameters. From the viewpoints of productivity, durability, and the like, it is preferable to form through-holes having two or more kinds of opening diameters.

As for the productivity, as in the above random arrangement, from the viewpoint of performing etching treatment in a large quantity, the productivity is improved by allowing variations in the opening diameter. In addition, from the viewpoint of durability, the size of dirt or dust differs depending on the environment. Accordingly, assuming that through-holes having one kind of opening diameter are provided, all the through-holes are influenced in a case where the size of the main dust almost matches the size of the through-hole. By providing through-holes having a plurality of kinds of opening diameters, a device that can be applied in various environments is obtained.

By using the manufacturing method disclosed in WO2016/060037A, it is possible to form a through-hole having a maximum diameter at the inside, in which the hole diameter increases inside the through-hole. Due to this shape, dust (dirt, toner, nonwoven fabric, foamed material, or the like) of about the size of the through-hole is less likely to clog the inside. Therefore, the durability of the film having through-holes is improved.

Dust larger than the diameter of the outermost surface of the through-hole does not intrude into the through-hole, while dust smaller than the diameter can pass through the through-hole as it is since the internal diameter is increased.

Considering a shape in which the inside is narrowed as the opposite shape, compared with a situation in which dust passing through the outermost surface of the through-hole is caught in an inner portion with a small diameter and the dust is left as it is, it can be seen that the shape having a maximum diameter at the inside functions advantageously in suppressing the clogging of dust.

In addition, in a shape in which one surface of the film has a maximum diameter and the inner diameter decreases approximately monotonically, such as a so-called tapered shape, in a case where dust satisfying the relationship of "maximum diameter>dust size>diameter of the other surface" enters from the side having the maximum diameter, a possibility that the internal shape functions as a slope and becomes clogged in the middle is further increased.

In addition, from the viewpoint of further increasing the friction in a case where the sound passes through the through-hole, it is preferable that the inner wall surface of the through-hole is roughened. Specifically, the surface roughness Ra of the inner wall surface of the through-hole is preferably 0.1 μm or more, more preferably 0.1 μm to 10.0 μm, and even more preferably 0.15 μm to 1.0 μm.

Here, the surface roughness Ra can be measured by measuring the inside of the through-hole with an atomic force microscope (AFM). As the AFM, for example, SPA 300/SPI 3800N manufactured by Hitachi High-Tech Sciences Co., Ltd. can be used. The cantilever can be measured in a dynamic force mode (DFM) (tapping mode) using the OMCL-AC200TS. Since the surface roughness of the inner wall surface of the through-hole is about several microns, it is preferable to use the AFM from the viewpoint of having a measurement range and accuracy of several microns.

In addition, it is possible to calculate the average particle diameter of protruding portions by regarding each one of the protruding portions of the unevenness in the through-hole as a particle from the SEM image in the through-hole.

Specifically, an SEM image captured at 2000 times is captured into Image J and binarized into black and white so that the protruding portion is white, and the area of each protruding portion is calculated by Analyze Particles. A circle equivalent diameter assuming a circle having the same area as the area of each protruding portion was calculated for each protruding portion, and the average value was calculated as the average particle diameter. The imaging range of the SEM image is about 100 μm×100 μm.

The average particle diameter of the protruding portion is preferably 0.1 μm or more and 10.0 μm or less, and more preferably 0.2 μm or more and 5.0 μm or less.

Here, from the viewpoint of the visibility of the through-hole, the average opening diameter of the plurality of through-holes formed in the micro perforated plate is preferably 50 μm or less, and more preferably 20 μm or less.

In a case where the micro perforated plate having micro through-holes, which is used in the soundproof structure according to the embodiment of the present invention, is disposed on the wall surface or a visible place, a situation in which the through-holes themselves are visible is not preferable in terms of design. Since a person is concerned that there are holes as an appearance, it is desirable that through-holes are difficult to see. It becomes a problem in a case where through-holes are visible at various places such as a soundproof wall inside the room, an articulating wall, a soundproof panel, an articulating panel, and an exterior part of a machine.

First, the visibility of one through-hole will be examined.

Hereinafter, a case where the resolution of human eyes is visual acuity 1 will be discussed.

Figure 47:
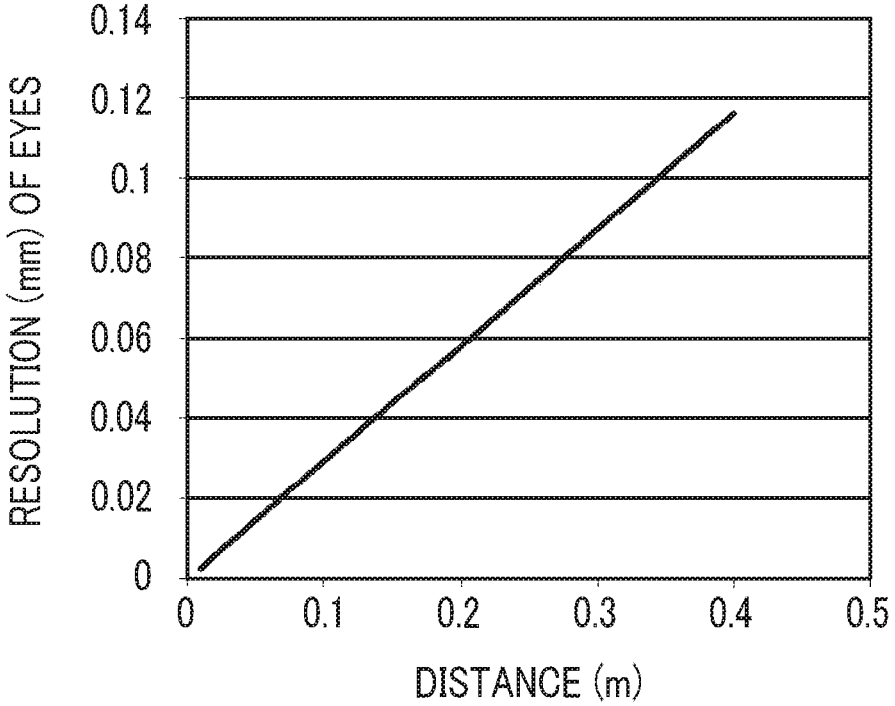
FIG. 47 is a graph showing the relationship between the distance and the resolution of the eyes.

The definition of visual acuity 1 is to see the one minute angle decomposed. This indicates that 87 μm can be decomposed at a distance of 30 cm. The relationship between the distance and the resolution in the case of visual acuity 1 is shown in FIG. 47.

Whether or not the through-hole is visible is strongly relevant to the visual acuity. Whether a blank space between two points and/or two line segments can be seen depends on the resolution, as the visual acuity test is performed by recognizing the gap portion of the Landolt's ring. That is, in the case of a through-hole having an opening diameter less than the resolution of the eye, the distance between the edges of the through-hole cannot be decomposed by the eyes. For this reason, it is difficult to see the through-hole having an opening diameter less than the resolution of the eye. On the other hand, it is possible to recognize the shape of a through-hole having an opening diameter equal to or greater than the resolution of the eye.

In the case of visual acuity 1, a through-hole of 100 μm can be decomposed from a distance of 35 cm. However, a through-hole of 50 μm and a through-hole of 20 μm cannot be decomposed at a distance longer than 18 cm and 7 cm, respectively. Therefore, in a case where a person is concerned since a through-hole of 100 μm can be recognized, a through-hole of 20 μm can be used since the through-hole of 20 μm cannot be recognized unless the distance is not an extremely short distance of ⅕. Therefore, the smaller the opening diameter, the more advantageous for hiding the through-hole. In the case of using the soundproof structure in a wall or in a car, the distance from the observer is generally several tens of centimeters. In this case, an opening diameter of about 100 μm is the boundary therebetween.

Next, light scattering caused by through-holes will be discussed. Since the wavelength of visible light is about 400 nm to 800 nm (0.4 μm to 0.8 μm), the opening diameter of several tens of micrometers discussed in the present invention is sufficiently larger than the optical wavelength. In this case, the cross-sectional area of scattering in visible light (amount indicating how strongly an object is scattered, the unit is an area) almost matches the geometrical cross-sectional area, that is, the cross-sectional area of the through-hole in this case. That is, it can be seen that the magnitude at which visible light is scattered is proportional to the square of the radius (half of the circle equivalent diameter) of the through-hole. Therefore, as the size of the through-hole increases, the scattering intensity of the light increases with the square of the radius of the through-hole. Since the visibility of a single through-hole is proportional to the amount of scattering of light, visibility in a case where each one of through-holes is large even in a case where the average opening ratio is the same.

Finally, a difference between a random arrangement having no periodicity for the arrangement of through-holes and a periodic arrangement will be discussed. In the periodic arrangement, a light diffraction phenomenon occurs according to the period. In this case, in a case where transmitted white light, reflected white light, broad spectrum light, and the like hits, the color appears variously (for example, light diffracts and the color appear to be misaligned like a rainbow or the color is strongly reflected at a specific angle). Accordingly, the pattern is noticeable.

On the other hand, in the case of a random arrangement, the above-described diffraction phenomena do not occur. In addition, it has been confirmed that, even in the case of a reflective arrangement, there is a metal gloss similar to that of ordinary aluminum foil and no diffraction reflection occurs.

The thickness of the micro perforated plate 12 may be appropriately set in order to obtain the natural vibration mode of the structure configured to include the first frame body 16 and the micro perforated plate 12 to a desired frequency. As the thickness increases, the friction energy received in a case where the sound passes through the through-hole increases. Therefore, it can be thought that the sound absorbing performance is further improved. In addition, in a case where the micro perforated plate 12 is extremely thin, it is difficult to handle the micro perforated plate 12 and the micro perforated plate 12 is easy to break. For this reason, it is preferable to have a thickness enough to maintain the micro perforated plate 12. On the other hand, from the viewpoints of miniaturization, air permeability, and light transmittance, it is preferable that the thickness is small. In a case where etching or the like is used for the method of forming the through-hole, a longer manufacturing time is required as the thickness becomes larger. Therefore, from the viewpoint of productivity, it is preferable that the thickness is small.

From the viewpoints of sound absorbing performance, miniaturization, air permeability, light transmittance, and the like, the thickness of the micro perforated plate 12 is preferably 5 μm to 500 μm, more preferably 10 μm to 300 μm, and particularly preferably 20 μm to 100 μm.

The material of the micro perforated plate 12 may also be appropriately set in order to obtain a desired frequency as the natural vibration mode of the soundproof structure. For example, as materials of the micro perforated plate 12, materials or structures that can form a thin structure, such as resin materials that can be made into a film shape, metal materials that can be made into a foil shape, materials that become fibrous films, nonwoven fabrics, films containing nano-sized fibers, thinly processed porous materials, carbon materials processed into a thin film structure, and rubber materials, can be mentioned. Specifically, as the metal materials, various metals, such as aluminum, titanium, nickel, permalloy, 42 alloy, kovar, nichrome, copper, beryllium, phosphor bronze, brass, nickel silver, tin, zinc, iron, tantalum, niobium, molybdenum, zirconium, gold, silver, platinum, palladium, steel, tungsten, lead, and iridium, and alloys of these metals can be mentioned. As the resin materials, resin material such as polyethylene terephthalate (PET), triacetyl cellulose (TAC), polyvinyl chloride, polyethylene, polyvinyl chloride, polymethylbenzene, cycloolefin polymer (COP), polycarbonate, Zeonor, polyethylene naphthalate (PEN), polypropylene, and polyimide can be used. Examples of the material that becomes a fibrous film include paper and cellulose. Examples of the thinly processed porous material include thinly processed urethane and synthrate. In addition, glass materials, such as thin film glass, and fiber reinforced plastic materials, such as carbon fiber reinforced plastics (CFRP) and glass fiber reinforced plastics (GFRP), can also be used. Examples of the rubber material include silicone rubber and natural rubber.

In the case of using a fibrous material as the material of the micro perforated plate 12, fibrous materials may be overlapped (nonwoven fabric), or fibrous materials may be woven (net, woven fabric). It is preferable that the average opening diameter of openings formed between fibers in a plan view is 0.1 μm or more and 250 μm or less, and it is preferable that the average opening diameter is in the range of 0.1 μm or more and 100 μm or less and the average opening ratio rho is in the above-described range (a range having $rho_center=(2+0.25\times t)\times phi^{-1.6}$ as its center, $rho_center-(0.052\times(phi/30)^{-2})$ as its lower limit, and $rho_center+(0.795\times(phi/30)^{-2})$ as its upper limit).

In addition, the micro perforated plate 12 may have a structure in which films formed of these materials are laminated.

In the soundproof structure according to the embodiment of the present invention, since film vibration occurs at the first natural vibration frequency, it is preferable that the plate-shaped member is hard to break against vibration. On the other hand, it is preferable to use a material having a high Young's modulus, which has a large spring constant and does not make the displacement of the vibration too large, in order to make use of sound absorption by the friction in the micro through-hole. From these viewpoints, it is preferable to use a metal material. Among these, aluminum or an aluminum alloy, which is lightweight and is easy to form micro through-holes by etching or the like, is preferably used from the viewpoints of availability, cost, and the like.

In the case of using a metal material, metal plating may be performed on the surface from the viewpoint of suppression of rust and the like.

In addition, by performing the metal plating on at least the inner surface of the through-hole, the average opening diameter of the through-holes may be adjusted to a smaller range.

By using a material that is conductive and is not charged, such as a metal material, as the material of the micro perforated plate, fine dirt, dust, and the like are not attracted to the film by static electricity. Therefore, it is possible to suppress the sound absorbing performance from lowering due to clogging of the through-hole of the micro perforated plate with dirt, dust, and the like.

In addition, heat resistance can be improved by using a metal material as the material of the micro perforated plate. In addition, ozone resistance can be improved.

In a case where a metal material is used as the micro perforated plate, it is possible to shield electric waves.

The metal material has a high reflectivity with respect to radiant heat due to far infrared rays. Accordingly, in a case where the metal material is used as a material of the micro perforated plate, the metal material also functions as a heat insulating material for preventing heat transfer due to radiant heat. In this case, a plurality of through-holes are formed in the micro perforated plate, but the micro perforated plate functions as a reflecting film since the opening diameter of the through-hole is small.

It is known that a structure in which a plurality of micro through-holes are opened in a metal functions as a high pass filter of a frequency. For example, a window with a metal mesh in a microwave oven has a property of transmitting visible high-frequency light while shielding microwaves used for the microwave oven. In this case, assuming that the hole diameter of the through-hole is Φ and the wavelength of the electromagnetic wave is λ, the window functions as a filter that does not transmit a long wavelength component satisfying the relationship of Φ<λ and transmits a short wavelength component satisfying the relationship of Φ>λ.

Here, the response to radiant heat is considered. Radiant heat is a heat transfer mechanism in which far infrared rays are radiated from an object according to the object temperature and transmitted to other objects. From the Wien's radiation law, it is known that radiant heat in an environment of about room temperature is distributed around λ=10 μm and up to 3 times the wavelength (up to 30 μm) on the longer wavelength side contributes effectively to transferring heat by radiation. Considering the relationship between the hole diameter Φ of the high pass filter and the wavelength λ, the component of λ>20 μm is strongly shielded in the case of Φ=20 μm, while the relationship of Φ>λ is satisfied and radiant heat propagates through the through-hole in the case of Φ=50 μm. That is, since the hole diameter Φ is several tens of micrometers, the propagation performance of radiant heat greatly changes depending on the difference in hole diameter Φ, and it can be seen that the smaller the hole diameter Φ, that is, the smaller the average opening diameter, the more it functions as a radiant heat cut filter. Therefore, from the viewpoint of a heat insulating material for preventing heat transfer due to radiant heat, the average opening diameter of the through-holes formed in the micro perforated plate is preferably 20 μm or less.

On the other hand, in a case where transparency is required for the entire soundproof structure, a resin material or a glass material that can be made transparent can be used as a material of the micro perforated plate. For example, a PET film has a relatively high Young's modulus among resin materials, is easy to obtain, and has high transparency. Therefore, the PET film can be used as a soundproof structure suitable for forming through-holes.

It is possible to improve the durability of the micro perforated plate by appropriately performing surface treatment (plating treatment, oxide coating treatment, surface coating (fluorine, ceramic), and the like) according to the material of the micro perforated plate. For example, in a case where aluminum is used as the material of the micro perforated plate, it is possible to form an oxide coating film on the surface by performing alumite treatment (anodic oxidation treatment) or boehmite treatment. By forming an oxide coating film on the surface, it is possible to improve corrosion resistance, abrasion resistance, scratch resistance, and the like. In addition, by adjusting the treatment time to adjust the thickness of the oxide coating film, it is possible to adjust the color by optical interference.

Coloring, decoration, designing, and the like can be applied to the micro perforated plate. As a method of applying these, an appropriate method may be selected according to the material of the micro perforated plate and the state of the surface treatment. For example, printing using an ink jet method or the like can be used. In addition, in a case where aluminum is used as the material of the micro perforated plate, highly durable coloring can be performed by performing color alumite treatment. The color alumite treatment is a treatment in which alumite treatment is performed on the surface and then a dye is penetrated onto the surface and then the surface is sealed. In this manner, it is possible to obtain a plate-shaped member with high designability such as the presence or absence of metal gloss and color. In addition, by forming alumite treatment after forming through-holes, an anodic oxide coating film is formed only on the aluminum portion. Therefore, decorations can be made without the dye covering the through-holes and reducing the sound absorbing characteristics.

In combination with the alumite treatment, various coloring and design can be applied.

Aluminum Base Material

The aluminum base material used as the micro perforated plate is not particularly limited. For example, known aluminum base materials, such as Alloy Nos. 1085, 1N30, and 3003 described in JIS standard H4000, can be used. The aluminum base material is an alloy plate containing aluminum as a main component and containing a small amount of different element.

The thickness of the aluminum base material is not particularly limited, and is preferably 5 μm to 1000 μm, more preferably 5 μm to 200 μm, and particularly preferably 10 μm to 100 μm.

Method of Manufacturing a Micro Perforated Plate Having a Plurality of Through-Hole Next, a method of manufacturing a micro perforated plate having a plurality of through-holes will be described with a case using an aluminum base material as an example.

The method of manufacturing a micro perforated plate having a plurality of through-holes using an aluminum base material has a coating film forming step for forming a coating film containing aluminum hydroxide as a main component on the surface of the aluminum base material, a through-hole forming step for forming a through-hole by performing through-hole forming treatment after the coating film forming step, and a coating film removing step for removing the aluminum hydroxide coating film after the through-hole forming step.

By having the coating film forming step, the through-hole forming step, and the coating film removing step, it is possible to appropriately form through-holes having an average opening diameter of 0.1 μm or more and 250 μm or less.

Next, each step of the method of manufacturing a micro perforated plate having a plurality of through-holes will be described with reference to FIGS. 12A to 12E, and then each step will be described in detail.

FIGS. 12A to 12E are schematic cross-sectional views illustrating an example of a preferred embodiment of the method of manufacturing a micro perforated plate having a plurality of through-holes using an aluminum base material.

Figure 12A:
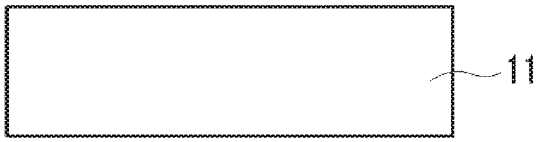
FIG. 12A is a schematic cross-sectional view illustrating an example of a preferable method of manufacturing a micro perforated plate having a plurality of through-holes.
Figure 12B:
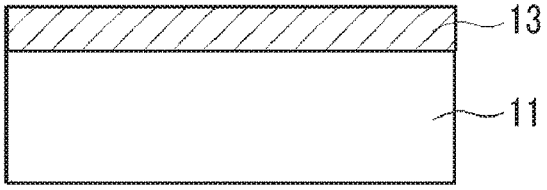
FIG. 12B is a schematic cross-sectional view illustrating an example of a preferable method of manufacturing a micro perforated plate having a plurality of through-holes.
Figure 12C:
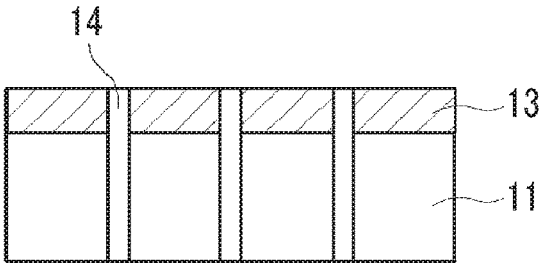
FIG. 12C is a schematic cross-sectional view illustrating an example of a preferable method of manufacturing a micro perforated plate having a plurality of through-holes.
Figure 12D:
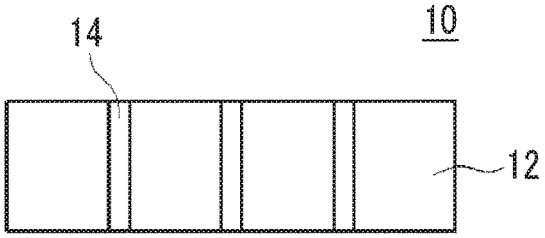
FIG. 12D is a schematic cross-sectional view illustrating an example of a preferable method of manufacturing a micro perforated plate having a plurality of through-holes.

As shown in FIGS. 12A to 12E, the method of manufacturing a micro perforated plate having a plurality of through-holes is a manufacturing method having a coating film forming step in which coating film forming treatment is performed on one main surface of an aluminum base material 11 to form an aluminum hydroxide coating film 13 (FIGS. 12A and 12B), a through-hole forming step in which the through-holes 14 are formed by performing electrolytic dissolution treatment after the coating film forming step so that through-holes are formed in the aluminum base material 11 and the aluminum hydroxide coating film 13 (FIGS. 12B and 12C), and a coating film removing step in which the aluminum hydroxide coating film 13 is removed after the through-hole forming step to manufacture the micro perforated plate 12 having the through-holes 14 (FIGS. 12C and 12D).

Figure 12E:
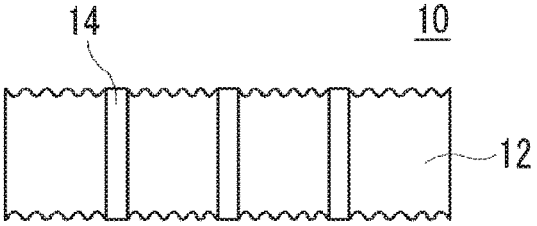
FIG. 12E is a schematic cross-sectional view illustrating an example of a preferable method of manufacturing a micro perforated plate having a plurality of through-holes.

In the method of manufacturing a micro perforated plate having a plurality of through-holes, it is preferable to perform electrochemical surface roughening treatment on the micro perforated plate 12 having the through-holes 14 after the coating film removing step and to have a surface roughening treatment step for roughening the surface of the micro perforated plate 12 (FIGS. 12D and 12E).

Small holes are easily formed in the aluminum hydroxide coating film. Therefore, by forming through-holes by performing electrolytic dissolution treatment in the through-hole forming step after the coating film forming step for forming the aluminum hydroxide coating film, it is possible to form through-holes having an average opening diameter of 0.1 μm or more and 250 μm or less.

Coating Film Forming Step

In the present invention, the coating film forming step included in the method of manufacturing a micro perforated plate having a plurality of through-holes is a step of performing coating film forming treatment on the surface of the aluminum base material to form an aluminum hydroxide coating film.

Coating Film Forming Treatment

The above-described coating film forming treatment is not particularly limited. For example, the same treatment as the conventionally known aluminum hydroxide coating film forming treatment can be performed.

As the coating film forming treatment, for example, conditions or apparatuses described in the paragraphs of [0013] to [0026] of JP2011-201123A can be appropriately adopted.

In the present invention, the conditions of the coating film forming treatment change according to the electrolyte to be used and accordingly cannot be unconditionally determined. In general, however, it is appropriate that the electrolyte concentration is 1 to 80% by mass, the liquid temperature is 5 to 70° C., the current density is 0.5 to 60 A/dm$^2$, the voltage is 1 to 100 V, and the electrolysis time is 1 second to 20 minutes, and these are adjusted so as to obtain a desired amount of coating film.

In the present invention, it is preferable to perform electrochemical treatment using nitric acid, hydrochloric acid, sulfuric acid, phosphoric acid, oxalic acid, or mixed acids of two or more of these acids as an electrolyte.

In the case of performing electrochemical treatment in the electrolyte containing nitric acid and hydrochloric acid, a direct current may be applied between the aluminum base material and the counter electrode, or an alternating current may be applied. In the case of applying a direct current to the aluminum base material, the current density is preferably 1 to 60 A/dm$^2$, and more preferably 5 to 50 A/dm$^2$. In the case of continuously performing the electrochemical treatment, it is preferable to perform the electrochemical treatment using a liquid power supply method for supplying electric power to the aluminum base material through the electrolyte.

In the present invention, the amount of the aluminum hydroxide coating film formed by the coating film forming treatment is preferably 0.05 to 50 g/m$^2$, and more preferably 0.1 to 10 g/m$^2$.

Through-Hole Forming Step

The through-hole forming step is a step of forming through-holes by performing electrolytic dissolution treatment after the coating film forming step.

Electrolytic Dissolution Treatment

The electrolytic dissolution treatment is not particularly limited, and a direct current or an alternating current may be used, and an acidic solution may be used as the electrolyte. Among these, it is preferable to perform electrochemical treatment using at least one acid of nitric acid or hydrochloric acid, and it is more preferable to perform electrochemical treatment using mixed acids of at least one or more of sulfuric acid, phosphoric acid, or oxalic acid in addition to these acids.

In the present invention, as an acidic solution that is an electrolyte, in addition to the above-mentioned acids, electrolytes described in U.S. Pat. Nos. 4,671,859B, 4,661,219B, 4,618,405B, 4,600,482B, 4,566,960B, 4,566,958B, 4,566,959B, 4,416,972B, 4,374,710B, 4,336,113B, 4,184,932B, and the like can also be used.

The concentration of the acidic solution is preferably 0.1 to 2.5% by mass, and particularly preferably 0.2 to 2.0% by mass. The solution temperature of the acidic solution is preferably 20 to 80° C., more preferably 20 to 50° C., and even more preferably 20 to 35° C.

As the above-described acid based aqueous solution, it is possible to use an aqueous solution of acid having a concentration of 1 to 100 g/L in which at least one of a nitric acid compound having nitrate ions, such as aluminum nitrate, sodium nitrate, and ammonium nitrate, a hydrochloric acid compound having hydrochloric acid ions, such as sodium chloride, and ammonium chloride, or a sulfuric acid compound having sulfate ions, such as aluminum sulfate, sodium sulfate, and ammonium sulfate, is added in a range of 1 g/L to saturation.

In addition, metals contained in aluminum alloys, such as iron, copper, manganese, nickel, titanium, magnesium, and silica, may be dissolved in the above-described acid based aqueous solution. A solution obtained by adding aluminum chloride, aluminum nitrate, aluminum sulfate, or the like to an aqueous solution having an acid concentration of 0.1 to 2% by mass so that the concentration of aluminum ions is 1 to 100 g/L is preferably used.

In the electrochemical dissolution treatment, a direct current is mainly used. However, in the case of using an alternating current, the AC power supply wave is not particularly limited, and a sine wave, a rectangular wave, a trapezoidal wave, a triangular wave, and the like are used. Among these, a rectangular wave or a trapezoidal wave is preferable, and a trapezoidal wave is particularly preferable.

Nitric Acid Electrolysis

In the present invention, it is possible to easily form through-holes having an average opening diameter of 0.1 μm or more and 250 μm or less by electrochemical dissolution treatment using a nitric acid based electrolyte (hereinafter, also abbreviated as "nitric acid dissolution treatment").

Here, for the reason that it is easy to control the melting point of the through-hole formation, the nitric acid dissolution treatment is preferably an electrolytic treatment performed under the conditions that a direct current is used and the average current density is 5 A/dm$^2$ or more and the electric quantity is 50 C/dm$^2$ or more. The average current density is preferably 100 A/dm$^2$ or less, and the electric quantity is preferably 10000 C/dm$^2$ or less.

The concentration or temperature of the electrolyte in the nitric acid electrolysis is not particularly limited, and electrolysis can be performed at 20 to 60° C. using a nitric acid electrolyte having a high concentration, for example, a nitric acid concentration of 15 to 35% by mass, or electrolysis can be performed at a high temperature, for example, 80° C. or more, using a nitric acid electrolyte having a nitric acid concentration of 0.7 to 2% by mass.

In addition, electrolysis can be performed by using an electrolyte in which at least one of sulfuric acid, oxalic acid, or phosphoric acid having a concentration of 0.1 to 50% by mass is mixed in the nitric acid electrolyte.

Hydrochloric Acid Electrolysis

In the present invention, it is also possible to easily form through-holes having an average opening diameter of 1 μm or more and 250 μm or less by electrochemical dissolution treatment using a hydrochloric acid based electrolyte (hereinafter, also abbreviated as "hydrochloric acid dissolution treatment").

Here, for the reason that it is easy to control the melting point of the through-hole formation, the hydrochloric acid dissolution treatment is preferably an electrolytic treatment performed under the conditions that a direct current is used and the average current density is 5 $A/dm^2$ or more and the electric quantity is 50 $C/dm^2$ or more. The average current density is preferably 100 $A/dm^2$ or less, and the electric quantity is preferably 10000 $C/dm^2$ or less.

The concentration or temperature of the electrolyte in the hydrochloric acid electrolysis is not particularly limited, and electrolysis can be performed at 20 to 60° C. using a hydrochloric acid electrolyte having a high concentration, for example, a hydrochloric acid concentration of 10 to 35% by mass, or electrolysis can be performed at a high temperature, for example, 80° C. or more, using a hydrochloric acid electrolyte having a hydrochloric acid concentration of 0.7 to 2% by mass.

In addition, electrolysis can be performed by using an electrolyte in which at least one of sulfuric acid, oxalic acid, or phosphoric acid having a concentration of 0.1 to 50% by mass is mixed in the hydrochloric acid electrolyte.

Coating Film Removing Step

The coating film removing step is a step of performing chemical dissolution treatment to remove the aluminum hydroxide coating film. In the coating film removing step, for example, the aluminum hydroxide coating film can be removed by performing an acid etching treatment or an alkali etching treatment to be described later.

Acid Etching Treatment

The above-described dissolution treatment is a treatment of dissolving the aluminum hydroxide coating film using a solution that preferentially dissolves aluminum hydroxide rather than aluminum (hereinafter, referred to as "aluminum hydroxide solution").

Here, as the aluminum hydroxide solution, for example, an aqueous solution containing at least one selected from nitric acid, hydrochloric acid, sulfuric acid, phosphoric acid, oxalic acid, a chromium compound, a zirconium compound, a titanium compound, a lithium salt, a cerium salt, a magnesium salt, sodium silicofluoride, zinc fluoride, a manganese compound, a molybdenum compound, a magnesium compound, a barium compound, or a halogen simple substance is preferable.

Specifically, examples of the chromium compound include chromium oxide (III) and chromium anhydride (VI) acid Examples of the zirconium based compound include zirconium fluoride, zirconium fluoride, and zirconium chloride.

Examples of the titanium compound include titanium oxide and titanium sulfide.

Examples of the lithium salt include lithium fluoride and lithium chloride.

Examples of the cerium salt include cerium fluoride and cerium chloride.

Examples of the magnesium salt include magnesium sulfide.

Examples of the manganese compound include sodium permanganate and calcium permanganate.

Examples of the molybdenum compound include sodium molybdate.

Examples of the magnesium compound include magnesium fluoride and pentahydrate.

Examples of the barium compound include barium oxide, barium acetate, barium carbonate, barium chlorate, barium chloride, barium fluoride, barium iodide, barium lactate, barium oxalate, barium perchlorate, barium selenate, selenite Barium, barium stearate, barium sulfate, barium titanate, barium hydroxide, barium nitrate, and hydrates thereof.

Among the barium compounds, barium oxide, barium acetate, and barium carbonate are preferable, and barium oxide is particularly preferable.

Examples of halogen simple substance include chlorine, fluorine, and bromine.

Among these, it is preferable that the aluminum hydroxide solution is an aqueous solution containing an acid, and examples of the acid include nitric acid, hydrochloric acid, sulfuric acid, phosphoric acid, and oxalic acid and a mixture of two or more acids may be used.

The acid concentration is preferably 0.01 mol/L or more, more preferably 0.05 mol/L or more, and even more preferably 0.1 mol/L or more. There is no particular upper limit, but in general it is preferably 10 mol/L or less, and more preferably 5 mol/L or less.

The dissolution treatment is performed by bringing the aluminum base material on which the aluminum hydroxide coating film is formed into contact with the solution described above. The method of contacting is not particularly limited, and examples thereof include an immersion method and a spray method. Among these, the immersion method is preferable.

The immersion treatment is a treatment of immersing an aluminum base material on which an aluminum hydroxide coating film is formed into the solution described above. Stirring during immersion treatment is preferably performed since uniform treatment is performed.

The immersion treatment time is preferably 10 minutes or more, more preferably 1 hour or more, and even more preferably 3 hours or more or 5 hours or more.

Alkali Etching Treatment

The alkali etching treatment is a treatment for dissolving the surface layer by bringing the aluminum hydroxide coating film into contact with an alkali solution.

Examples of the alkali used in the alkali solution include caustic alkali and alkali metal salts. Specifically, examples of the caustic alkali include sodium hydroxide (caustic soda) and caustic potash. Examples of the alkali metal salt include: alkali metal silicates such as sodium metasilicate, sodium silicate, potassium metasilicate, and potassium silicate; alkali metal carbonates such as sodium carbonate and potassium carbonate; alkali metal aluminates such as sodium aluminate and potassium aluminate; alkali metal aldonic acid salts such as sodium gluconate and potassium gluconate; and alkali metal hydrogenphosphate such as secondary sodium phosphate, secondary potassium phosphate, tertiary sodium phosphate, and tertiary potassium phosphate. Among these, a solution containing caustic alkali and a solution containing both caustic alkali and alkali metal aluminate are preferable from the viewpoint of high etching speed and low cost. In particular, an aqueous solution of sodium hydroxide is preferred.

The concentration of the alkali solution is preferably 0.1 to 50% by mass, and more preferably 0.2 to 10% by mass. In a case where aluminum ions are dissolved in the alkali solution, the concentration of aluminum ions is preferably 0.01 to 10% by mass, and more preferably 0.1 to 3% by mass. The temperature of the alkali solution is preferably 10 to 90° C. The treatment time is preferably 1 to 120 seconds.

Examples of the method of bringing the aluminum hydroxide coating film into contact with the alkali solution include a method in which an aluminum base material having an aluminum hydroxide coating film formed thereon is made to pass through a tank containing an alkali solution, a method in which an aluminum base material having an aluminum hydroxide coating film formed thereon is immersed in a tank containing an alkali solution, and a method in which an alkali solution is sprayed onto the surface (aluminum hydroxide coating film) of an aluminum base material on which an aluminum hydroxide coating film is formed.

Surface Roughening Treatment Step

In the present invention, any surface roughening treatment step which may be included in the method of manufacturing a micro perforated plate having a plurality of through-holes is a step of roughening the front surface or the back surface of the aluminum base material by performing electrochemical roughening treatment (hereinafter, also abbreviated as "electrolytic surface roughening treatment") on the aluminum base material from which the aluminum hydroxide coating film has been removed.

In the embodiment described above, the surface roughening treatment is performed after forming through-holes. However, the present invention is not limited thereto, and through-holes may be formed after the surface roughening treatment.

In the present invention, the surface can be easily roughened by electrochemical surface roughening treatment (hereinafter, also abbreviated as "nitric acid electrolysis") using a nitric acid based electrolyte.

Alternatively, the surface can also be roughened by electrochemical surface roughening treatment (hereinafter, also abbreviated as "hydrochloric acid electrolysis") using a hydrochloric acid based electrolyte.

Metal Coating Step

In the present invention, for the reason that the average opening diameter of the through-hole formed by the above-described electrolytic dissolution treatment can be adjusted to a small range of about 0.1 μm to 20 μm, it is preferable that the method of manufacturing a plate-shaped member having a plurality of through-holes has a metal coating step for coating a part or entirety of the surface of the aluminum base material including at least the inner wall of the through-hole with a metal other than aluminum after the coating film removing step described above.

Here, "coating a part or entirety of the surface of the aluminum base material including at least the inner wall of the through-hole with a metal other than aluminum" means that at least the inner wall of the through-hole in the entire surface of the aluminum base material including the inner wall of the through-hole is coated. A surface other than the inner wall may not be coated, or a part or entirety of the surface other than the inner wall may be coated.

In the metal coating step, for example, substitution treatment and plating treatment to be described later are performed on the aluminum base material having through-holes.

Substitution Treatment

The above-described substitution treatment is a treatment for performing substitution plating of zinc or zinc alloy on a part or entirety of the surface of the aluminum base material including at least the inner wall of the through-hole.

Examples of the substitution plating solution include a mixed solution of sodium hydroxide of 120 g/L, zinc oxide of 20 g/L, crystalline ferric chloride of 2 g/L, Rossel salt of 50 g/L, and sodium nitrate of 1 g/L.

Commercially available Zn or Zn alloy plating solution may be used. For example, substars Zn-1, Zn-2, Zn-3, Zn-8, Zn-10, Zn-111, Zn-222, and Zn-291 manufactured by Okuno Pharmaceutical Industries can be used.

The time of immersion of the aluminum base material in such a substitution plating solution is preferably 15 seconds to 40 seconds, and the immersion temperature is preferably 20 to 50° C.

Plating Treatment

In a case where zinc or zinc alloy is substituted for plating on the surface of the aluminum base material by the substitution treatment described above to form a zinc coating film, for example, it is preferable to perform plating treatment in which the zinc coating film is substituted to nickel by electrolytic plating to be described later and then various metals are precipitated by electrolytic plating to be described later.

Electroless Plating Treatment

As a nickel plating solution used for the electroless plating treatment, commercially available products can be widely used. For example, an aqueous solution containing nickel sulfate of 30 g/L, sodium hypophosphite of 20 g/L, and ammonium citrate of 50 g/L can be mentioned.

In addition, examples of the nickel alloy plating solution include an Ni—P alloy plating solution in which a phosphorus compound is used as a reducing agent or an Ni—B plating solution in which a boron compound is used as a reducing agent.

The immersion time in such a nickel plating solution or nickel alloy plating solution is preferably 15 seconds to 10 minutes, and the immersion temperature is preferably 30° C. to 90° C.

Electrolytic Plating Treatment

As a plating solution in the case of electroplating Cu as an example of electrolytic plating treatment, for example, a plating solution obtained by adding sulfuric acid Cu of 60 to 110 g/L, sulfuric acid of 160 to 200 g/L, and hydrochloric acid of 0.1 to 0.15 mL/L to pure water and adding Toprutina SF base WR of 1.5 to 5.0 mL/L, Toprutina SF-B of 0.5 to 2.0 mL/L, and Toprutina SF leveler of 3.0 to 10 mL/L, which are manufactured by Okuno Pharmaceutical Co., Ltd., as additives can be mentioned.

The immersion time in such a copper plating solution depends on the thickness of the Cu film and accordingly is not particularly limited. For example, in a case where a Cu film having a thickness of 2 μm is applied, immersion for about 5 minutes at a current density of 2 A/dm$^2$ is preferable, and the immersion temperature is preferably 20° C. to 30° C.

Washing Treatment

In the present invention, it is preferable to perform washing after the end of each treatment step described above. Pure water, well water, tap water, and the like can be used for washing. A nipping apparatus may be used to prevent the inflow of treatment solution to the next step.

Such a micro perforated plate having through-holes may be manufactured by using a cut sheet-shaped aluminum base material, or may be manufactured by roll-to-roll (hereinafter, also referred to as RtoR).

As is well known, RtoR is a manufacturing method in which a raw material is pulled out from a roll on which a long raw material is wound, various treatments such as surface treatment are performed while transporting the raw material in the longitudinal direction, and the treated raw material is wound onto the roll again.

In the manufacturing method of forming through-holes in the aluminum base material as described above, it is possible to easily and efficiently form a through-hole of about 20 μm by RtoR.

The method of forming through-holes is not limited to the method described above, and the through-holes may be formed by using a known method depending on a material for forming the micro perforated plate or the like.

For example, in a case where a resin film such as a PET film is used as a micro perforated plate, it is possible to form through-holes by using a processing method for absorbing energy, such as laser processing, or a mechanical processing method based on physical contact, such as punching and needle processing.

The first frame body 16 is a member that has a plurality of hole portions 17 and is disposed in contact with one surface of the micro perforated plate 12 to increase the apparent stiffness of the micro perforated plate 12.

The opening diameter of the hole portion 17 of the first frame body 16 is larger than the opening diameter of the through-hole 14 of the micro perforated plate 12. In addition, the opening ratio of the hole portion 17 of the first frame body 16 is larger than the opening ratio of the through-hole 14 of the micro perforated plate 12.

The shape of the opening cross section of the hole portion 17 of the first frame body 16 is not particularly limited. For example, the shape of the opening cross section of the hole portion 17 of the first frame body 16 may be a quadrangle such as a rectangle, a diamond, and a parallelogram, a triangle such as an equilateral triangle, an isosceles triangle, and a right triangle, a polygon including a regular polygon such as a regular pentagon and a regular hexagon, a circle, an ellipse, and the like, or may be an irregular shape. Among these, the shape of the opening cross section of the hole portion 17 is preferably a regular hexagon, and the first frame body 16 has a so-called honeycomb structure in which a plurality of hole portions 17 each having a regular hexagonal cross section are arranged closest to one another (refer to FIG. 48). By configuring the first frame body 16 to have a honeycomb structure, the apparent stiffness of the micro perforated plate 12 can be further increased, and the resonance vibration frequency can easily be made higher than the audible range.

In addition, the opening diameter of the hole portion 17 was set to a diameter (circle equivalent diameter) in a case where the area of the hole portion 17 was measured and replaced with a circle having the same area.

Specifically, from the viewpoint of appropriately increasing the stiffness of the micro perforated plate 12, viewpoint that the opening diameter is larger than the through-hole 14 of the micro perforated plate 12, viewpoint of reducing the influence on the path passing through the through-hole 14, viewpoint of preventing fingers or the like from directly touching the micro perforated plate 12 in terms of handling, and the like, the opening diameter of the hole portion 17 of the first frame body 16 is preferably 22 mm or less, more preferably larger than 0.1 mm and 15 mm or less, and particularly preferably 1 mm or more and 10 mm or less.

A typical micro perforated plate called a micro perforated plate (MPP) has through-holes of 100 μm to 1 mm in diameter. In order to form such a micro perforated plate has a micro through-hole, it is necessary to use a thin plate having an aspect ratio (a ratio of the opening diameter to the length of the through-hole) of about 1 due to processing problems. Therefore, it is preferable to use a substrate having a thickness of 1 mm or less as a micro perforated plate. In a case where the thickness is 1 mm or less, for example, even in the case of using aluminum that is a material having a relatively high stiffness, in order to make the resonance vibration frequency higher than the audible range, the opening diameter of the hole portion of the first frame body needs to be 22 mm or less (refer to Equation (1) to be described later).

In addition, from the viewpoint of appropriately increasing the stiffness of the micro perforated plate 12, viewpoint that the opening ratio is larger than the through-hole 14 of the micro perforated plate 12, viewpoint of reducing the influence on the path passing through the through-hole 14, viewpoint of preventing fingers or the like from directly touching the micro perforated plate 12 in terms of handling, and the like, the opening ratio of the hole portion 17 of the first frame body 16 is preferably larger than 1% and 98% or less, more preferably 5% or more and 75% or less, and particularly preferably 10% or more and 50% or less.

The thickness of the first frame body 16 is not particularly limited as long as the stiffness of the micro perforated plate 12 can be appropriately increased. For example, the thickness of the first frame body 16 can be set according to the specification of the micro perforated plate 12, the material of the first frame body 16, the opening diameter of the hole portion 17, and the like.

Examples of the material for forming the first frame body 16 include metal materials such as aluminum, titanium, magnesium, tungsten, iron, steel, chromium, chromium molybdenum, nichrome molybdenum, and alloys thereof, resin materials such as acrylic resins, polymethyl methacrylate, polycarbonate, polyamideide, polyarylate, polyether imide, polyacetal, polyether ether ketone, polyphenylene sulfide, polysulfone, polyethylene terephthalate, polybutylene terephthalate, polyimide, and triacetyl cellulose; carbon fiber reinforced plastics (CFRP), carbon fiber, glass fiber reinforced plastics (GFRP), and paper.

The metal material is preferable in terms of high durability, nonflammability, and the like. The resin material is preferable in terms of easy forming, transparency, and the like. Paper is preferable in terms of light weight, inexpensiveness, and the like.

In particular, it is preferable to use any one of aluminum, aluminum alloy, iron, or iron alloy.

The second frame body 18 has one or more opening portions 19, and fixes and supports the laminate of the micro perforated plate 12 and the first frame body 16 so as to cover the opening portion 19.

It is preferable that the second frame body 18 has a closed continuous shape so as to be able to fix and suppress the entire circumference of the laminate of the micro perforated plate 12 and the first frame body 16. However, the present invention is not limited thereto, and the second frame body 18 may be partially cut to have a discontinuous shape.

The shape of the opening cross section of the opening portion 19 of the second frame body 18 is not particularly limited. For example, the shape of the opening cross section of the opening portion 19 of the second frame body 18 may be a quadrangle such as a square, a rectangle, a diamond, and a parallelogram, a triangle such as an equilateral triangle, an isosceles triangle, and a right triangle, a polygon including a regular polygon such as a regular pentagon and a regular hexagon, a circle, an ellipse, and the like, or may be an irregular shape. End portions on both sides of the opening portion 19 of the second frame body 18 are not blocked and are open to the outside as they are.

The size of the second frame body 18 is a size in a plan view, and can be defined as the size of the opening portion. Accordingly, in the following description, the size of the second frame body 18 is the size of the opening portion. However, in the case of a regular polygon such as a circle or a square, the size of the second frame body 18 can be defined as a distance between opposite sides passing through the center or as a circle equivalent diameter. In the case of a polygon, an ellipse, or an irregular shape, the size of the second frame body 18 can be defined as a circle equivalent diameter. In the present invention, the circle equivalent diameter and the radius are a diameter and a radius at the time of conversion into circles having the same area.

The size of the opening portion of the second frame body 18 is not particularly limited, and may be set according to a soundproofing target to which the soundproof structure according to the embodiment of the present invention is applied, for example, a copying machine, a blower, air conditioning equipment, a ventilator, a pump, a generator, a duct, industrial equipment including various kinds of manufacturing equipment capable of emitting sound such as a coating machine, a rotary machine, and a conveyor machine, transportation equipment such as an automobile, a train, and aircraft, and general household equipment such as a refrigerator, a washing machine, a dryer, a television, a copying machine, a microwave oven, a game machine, an air conditioner, a fan, a PC, a vacuum cleaner, and an air purifier.

As described above, in a case where a soundproof cell is formed by fixing the laminate of the micro perforated plate 12 and the first frame body 16 to the second frame body 18, the soundproof cell can be a unit soundproof cell, and a soundproof structure can be made to have a plurality of unit soundproof cells. Therefore, it is not necessary to match the size of the opening portion with the size of a duct or the like, and a plurality of unit soundproof cells can be combined and arranged at the duct end for soundproofing.

In addition, it is possible to respond to a large area by providing a plurality of unit soundproof cells.

In addition, in each unit soundproof cell, it is easy to combine unit soundproof cells with different soundproofing characteristics by changing the shape, material, and the like of the micro perforated plate 12, the first frame body 16, and the second frame body 18.

The soundproof structure itself having the second frame body can also be used like a partition in order to shield sound from a plurality of noise sources.

In the soundproof structure having a plurality of unit soundproof cells, the number of unit soundproof cells is not limited. For example, in the case of in-device noise shielding (reflection and/or absorption), the number of unit soundproof cells is preferably 1 to 10000, more preferably 2 to 5000, and most preferably 4 to 1000.

The size of the second frame body 18 may be appropriately set. For example, the size of the second frame body 18 (opening portion) is preferably 0.5 mm to 200 mm, more preferably 1 mm to 100 mm, and most preferably 2 mm to 30 mm.

The wall thickness of the frame of the second frame body 18 and the thickness of the opening portion 19 in the penetration direction (hereinafter, also referred to as the thickness of the second frame body 18) are not particularly limited as long as the laminate can be reliably fixed and supported. For example, the wall thickness of the frame of the second frame body 18 and the thickness of the opening portion 19 in the penetration direction can be set according to the size of the second frame body 18.

Figure 49:
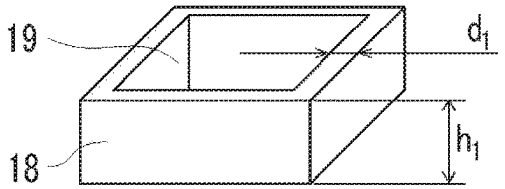
FIG. 49 is a schematic perspective view illustrating the shape of a second frame body.

Here, as shown in FIG. 49, the frame wall thickness of the second frame body 18 is the thickness $d_1$ of a thinnest portion on the opening surface of the second frame body 18. The thickness of the second frame body 18 is the height $h_1$ of the opening portion in the penetration direction.

For example, in a case where the size of the second frame body 18 is 0.5 mm to 50 mm, the wall thickness of the frame of the second frame body 18 is preferably 0.5 mm to 20 mm, more preferably 0.7 mm to 10 mm, and most preferably 1 mm to 5 mm.

In a case where the ratio of the wall thickness of the second frame body 18 to the size of the second frame body 18 is too large, the area ratio of the portion of the second frame body 18 with respect to the entire structure increases. Accordingly, there is a concern that the device will become heavy. On the other hand, in a case where the ratio is too small, it is difficult to strongly fix a laminate with an adhesive or the like in the second frame body 18 portion.

In a case where the size of the second frame body 18 exceeds 50 mm and is equal to or less than 200 mm, the frame wall thickness of the second frame body 18 is preferably 1 mm to 100 mm, more preferably 3 mm to 50 mm, and most preferably 5 mm to 20 mm.

In addition, the thickness of the second frame body 18, that is, the thickness of the opening portion in the penetration direction is preferably 0.5 mm to 200 mm, more preferably 0.7 mm to 100 mm, and most preferably 1 mm to 50 mm.

The material for forming the second frame body 18 is not particularly limited as long as it is possible to support the laminate of the micro perforated plate 12 and the first frame body 16 and the material for forming the second frame body 18 has a suitable strength in the case of being applied to the above soundproofing target and is resistant to the soundproof environment of the soundproofing target, and can be selected according to the soundproofing target and the soundproof environment. Examples of the material of the second frame body 18 include metal materials such as aluminum, titanium, magnesium, tungsten, iron, steel, chromium, chromium molybdenum, nichrome molybdenum, and alloys thereof, resin materials such as acrylic resins, polymethyl methacrylate, polycarbonate, polyamideimide, polyarylate, polyether imide, polyacetal, polyether ether ketone, polyphenylene sulfide, polysulfone, polyethylene terephthalate, polybutylene terephthalate, polyimide, and triacetyl cellulose, carbon fiber reinforced plastics (CFRP), carbon fiber, and glass fiber reinforced plastics (GFRP).

A plurality of kinds of materials of the second frame body 18 may be used in combination.

A known sound absorbing material may be disposed in the opening portion of the second frame body 18.

By arranging the sound absorbing material, the sound insulation characteristics can be further improved by the sound absorption effect of the sound absorbing material.

The sound absorbing material is not particularly limited, and various known sound absorbing materials, such as foamed urethane and nonwoven fabric, can be used.

Hereinafter, the physical properties or characteristics of a structural member that can be combined with a soundproof member having the soundproof structure according to the embodiment of the present invention will be described.

Flame Retardancy

In the case of using a soundproof member having the soundproof structure according to the embodiment of the present invention as a soundproof material in a building or a device, flame retardancy is required.

Therefore, the micro perforated plate is preferably flame retardant. In a case where a resin is used as the micro perforated plate, for example, Lumirror (registered trademark) nonhalogen flame-retardant type ZV series (manufactured by Toray Industries, Inc.) that is a flame-retardant PET film, Teij in Tetoron (registered trademark) UF (manufactured by Teij in Ltd.), and/or Dialamy (registered trademark) (manufactured by Mitsubishi Plastics Co., Ltd.) that is a flame-retardant polyester film may be used.

In addition, flame retardancy can be also given by using metal materials, such as aluminum, nickel, tungsten, and copper.

The first frame body and the second frame body are also preferably flame-retardant materials. A metal such as aluminum, an inorganic material such as ceramic, a glass material, flame-retardant polycarbonate (for example, PCMUPY 610 (manufactured by Takiron Co., Ltd.)), and/or flame-retardant plastics such as flame-retardant acrylic (for example, Acrylite (registered trademark) FR1 (manufactured by Mitsubishi Rayon Co., Ltd.)) can be mentioned.

As a method of fixing the micro perforated plate to the first frame body and a method of fixing the laminate of the micro perforated plate and the first frame body to the second frame body, a bonding method using a flame-retardant adhesive (Three Bond 1537 series (manufactured by Three Bond Co. Ltd.)) or solder or a mechanical fixing method, such as interposing the micro perforated plate between two frame bodies so as to be fixed therebetween, is preferable.

Heat Resistance

There is a concern that the soundproofing characteristics may be changed due to the expansion and contraction of the structural member of the soundproof structure according to the embodiment of the present invention due to an environmental temperature change. Therefore, the material forming the structural member is preferably a heat resistant material, particularly a material having low heat shrinkage.

As the micro perforated plate, for example, Teijin Tetoron (registered trademark) film SLA (manufactured by Teijin DuPont Film), PEN film Teonex (registered trademark) (manufactured by Teijin DuPont Film), and/or Lumirror (registered trademark) off-anneal low shrinkage type (manufactured by Toray Industries, Inc.) are preferably used. In general, it is preferable to use a metal film, such as aluminum having a smaller thermal expansion factor than a plastic material.

As the first frame body and the second frame body, it is preferable to use heat resistant plastics, such as polyimide resin (TECASINT 4111 (manufactured by Enzinger Japan Co., Ltd.)) and/or glass fiber reinforced resin (TECAP-EEKGF 30 (manufactured by Enzinger Japan Co., Ltd.)) and/or to use a metal such as aluminum, an inorganic material such as ceramic, or a glass material.

As the adhesive, it is preferable to use a heat resistant adhesive (TB 3732 (Three Bond Co., Ltd.), super heat resistant one component shrinkable RTV silicone adhesive sealing material (manufactured by Momentive Performance Materials Japan Ltd.) and/or heat resistant inorganic adhesive Aron Ceramic (registered trademark) (manufactured by Toagosei Co., Ltd.)). In the case of applying these adhesives to the micro perforated plate, the first frame body, or the second frame body, it is preferable to set the thickness to 1 μm or less so that the amount of expansion and contraction can be reduced.

Weather Resistance and Light Resistance

In a case where the soundproof member having the soundproof structure according to the embodiment of the present invention is disposed outdoors or in a place where light is incident, the weather resistance of the structural member becomes a problem.

Therefore, as the micro perforated plate, it is preferable to use a weather-resistant film, such as a special polyolefin film (ARTPLY (registered trademark) (manufactured by Mitsubishi Plastics Inc.)), an acrylic resin film (ACRYPRENE (manufactured by Mitsubishi Rayon Co.)), and/or Scotch Calfilm (trademark) (manufactured by 3M Co.).

As the first frame body and the second frame body, it is preferable to use plastics having high weather resistance such as polyvinyl chloride, polymethyl methacryl (acryl), metal such as aluminum, inorganic materials such as ceramic, and/or glass materials.

As an adhesive, it is preferable to use epoxy resin based adhesives and/or highly weather-resistant adhesives such as Dry Flex (manufactured by Repair Care International).

Regarding moisture resistance as well, it is preferable to appropriately select the micro perforated plate, a first frame body, a second frame body, and an adhesive having high moisture resistance. Regarding water absorption and chemical resistance as well, it is preferable to appropriately select the micro perforated plate, a first frame body, a second frame body, and an adhesive.

Dust

During long-term use, dust may adhere to the micro perforated plate surface to affect the soundproofing characteristics of the soundproof structure according to the embodiment of the present invention. Therefore, it is preferable to prevent the adhesion of dust or to remove adhering dust.

As a method of preventing dust, it is preferable to use the micro perforated plate formed of a material to which dust is hard to adhere. For example, by using a conductive film (Flecria (registered trademark) (manufactured by TDK Corporation) and/or NCF (Nagaoka Sangyou Co., Ltd.)) so that the micro perforated plate is not charged, it is possible to prevent adhesion of dust due to charging. It is also possible to suppress the adhesion of dust by using a fluororesin film (Dynoch Film (trademark) (manufactured by 3M Co.)), and/or a hydrophilic film (Miraclain (manufactured by Lifegard Co.)), RIVEX (manufactured by Riken Technology Inc.) and/or SH2CLHF (manufactured by 3M Co.)). By using a photocatalytic film (Raceline (manufactured by Kimoto Corporation)), contamination of the micro perforated plate can also be prevented. A similar effect can also be obtained by applying a spray having the conductivity, hydrophilic property and/or photocatalytic property and/or a spray containing a fluorine compound to the micro perforated plate.

In addition to using the special micro perforated plates described above, it is also possible to prevent contamination by providing a cover on the micro perforated plate. As the cover, it is possible to use a thin film material (Saran Wrap (registered trademark) or the like), a mesh having a mesh size not allowing dust to pass therethrough, a nonwoven fabric, a urethane, an airgel, a porous film, and the like.

Figure 13:
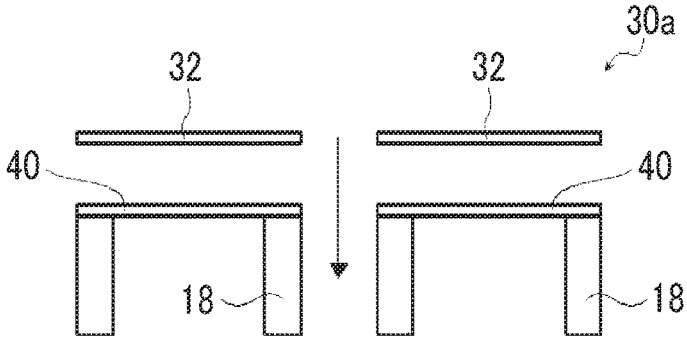
FIG. 13 is a schematic cross-sectional view of an example of a soundproof member having the soundproof structure of the present invention.
Figure 14:
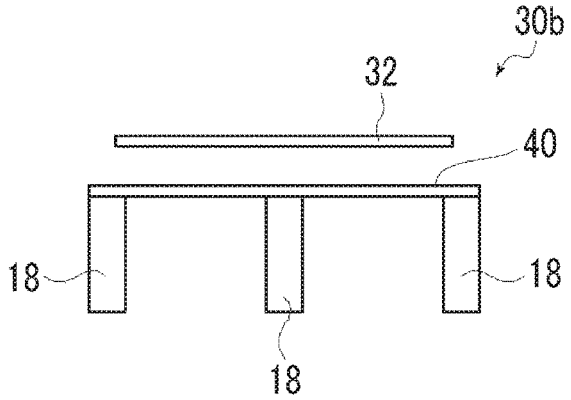
FIG. 14 is a schematic cross-sectional view of another example of the soundproof member having the soundproof structure of the present invention.

For example, as in soundproof members 30*a* and 30*b* shown in FIGS. 13 and 14, a cover 32 is disposed on a laminate 40 of the micro perforated plate 12 and the first frame body 16 so as to cover the laminate 40 with a predetermined distance therebetween, so that it is possible to prevent the wind or dust from directly hitting the laminate 40.

In a case where a particularly thin film material or the like is used as the cover, the effect of the through-hole is maintained by making the thin film material or the like away from the laminate 40 without attaching the thin film material or the like to the laminate 40, which is desirable. In addition, in a case where the thin film material is fixed with the thin film material stretched in order to make sound pass through the thin film material without strong film vibration, film vibration tends to occur. For this reason, it is desirable that the thin film material is loosely supported.

As a method of removing adhering dust, it is possible to remove dust by emitting sound having a resonance frequency of the micro perforated plate so that the micro perforated plate strongly vibrates. The same effect can be obtained even in a case where a blower or wiping is used.

Wind Pressure

In a case where a strong wind hits the micro perforated plate, the micro perforated plate may be pressed to change the resonance frequency. Therefore, by covering the micro perforated plate with a nonwoven fabric, urethane, and/or a film, the influence of wind can be suppressed. Similarly to the case of dust described above, as in the soundproof members 30*a* and 30*b* shown in FIGS. 13 and 14, it is preferable to provide the cover 32 on the laminate 40 so that wind does not directly hit the laminate 40 (micro perforated plate 12).

Figure 15:
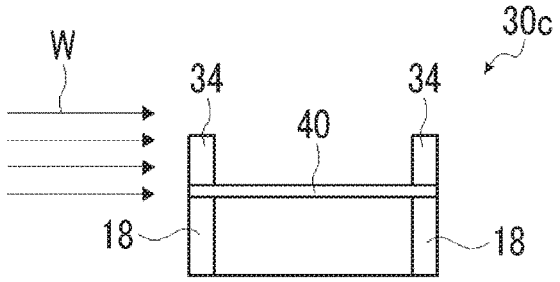
FIG. 15 is a schematic cross-sectional view of another example of the soundproof member having the soundproof structure of the present invention.

In addition, as in a soundproof member 30*c* shown in FIG. 15, in a structure in which the laminate 40 is inclined with respect to sound waves, it is preferable to provide a windshield frame 34 for preventing wind W from directly hitting the laminate 40 above the laminate 40.

Figure 16:
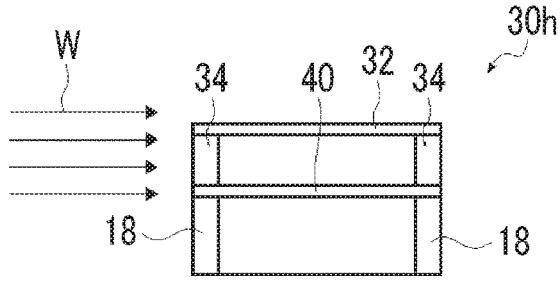
FIG. 16 is a schematic cross-sectional view of another example of the soundproof member having the soundproof structure of the present invention.

As the most preferable windshield form, as shown in FIG. 16, the cover 32 is provided on the laminate 40 and the space between the cover 32 and the laminate 40 is surrounded by the windshield frame 34 so as to close the space, so that it is possible to block the wind hitting the laminate 40 from the vertical direction with respect to the laminate 40 and the wind hitting the laminate 40 from the parallel direction with respect to the laminate 40.

Figure 17:
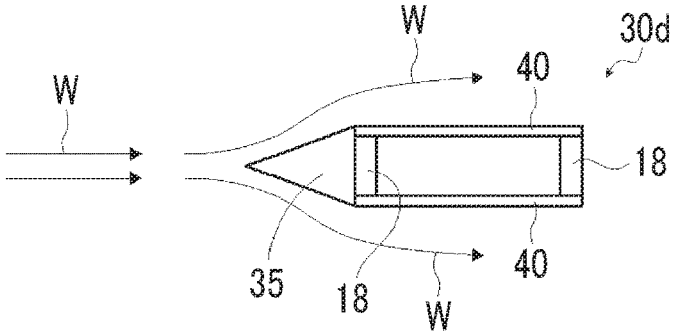
FIG. 17 is a schematic cross-sectional view of another example of the soundproof member having the soundproof structure of the present invention.

In addition, as in a soundproof member 30*d* shown in FIG. 17, in order to suppress the influence (wind pressure on the film, wind noise) due to turbulence caused by blocking the wind W on the side surface of the soundproof member, it is preferable to provide a flow control mechanism 35, such as a flow control plate for rectifying the wind W, on the side surface of the soundproof member.

Combination of Unit Cells

As described above, in the case of having a plurality of soundproof cells, the plurality of second frame bodies 18 may be formed by one continuous frame body, or a plurality of soundproof cells as unit cells may be provided. That is, the soundproof member having the soundproof structure according to the embodiment of the present invention does not necessarily need to be formed by one continuous frame body, and a soundproof cell having a structure, which has the second frame body 18 and the laminate 40 attached thereto, as a unit cell may be used. Such a unit cell can be used independently, or a plurality of unit cells can be connected and used.

As a method of connecting a plurality of unit cells, as will be described later, a Magic Tape (registered trademark), a magnet, a button, a suction cup, and/or an uneven portion may be attached to a frame body portion so as to be combined therewith, or a plurality of unit cells can be connected using a tape or the like.

Arrangement

Figure 18:
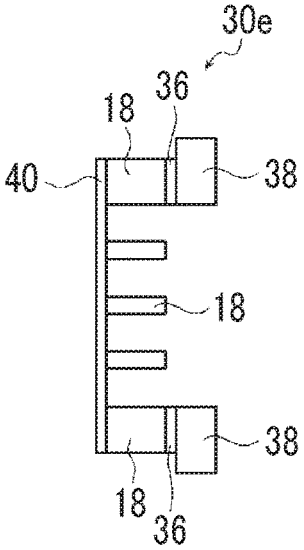
FIG. 18 is a schematic cross-sectional view showing an example of a state in which a soundproof member having the soundproof structure of the present invention is attached to the wall.
Figure 19:
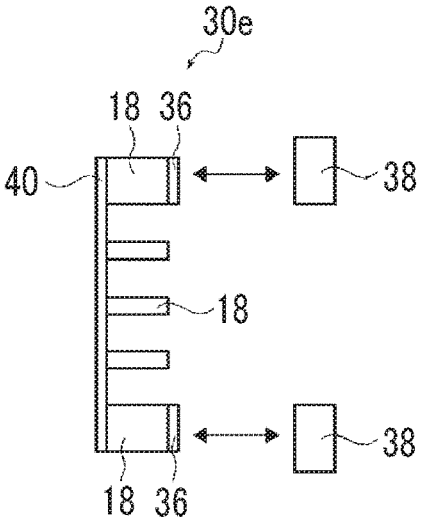
FIG. 19 is a schematic cross-sectional view of an example of a state in which the soundproof member shown in FIG. 18 is detached from the wall.

In order to allow the soundproof member having the soundproof structure according to the embodiment of the present invention to be easily attached to a wall or the like or to be removable therefrom, an attachment and detachment mechanism formed of a magnetic material, a Magic Tape (registered trademark), a button, a suction cup, or the like is preferably attached to the soundproof member. For example, as shown in FIG. 18, an attachment and detachment mechanism 36 may be attached to the bottom surface of a frame on the outer side of a second frame body 18 of a soundproof member (soundproof cell unit) 30*e*, and the attachment and detachment mechanism 36 attached to the soundproof member 30*e* may be attached to a wall 38 so that the soundproof member 30 is disposed on the wall 38. As shown in FIG. 19, the attachment and detachment mechanism 36 attached to the soundproof member 30*e* may be detached from the wall 38 so that the soundproof member 30*e* is detached from the wall 38.

Figure 20:
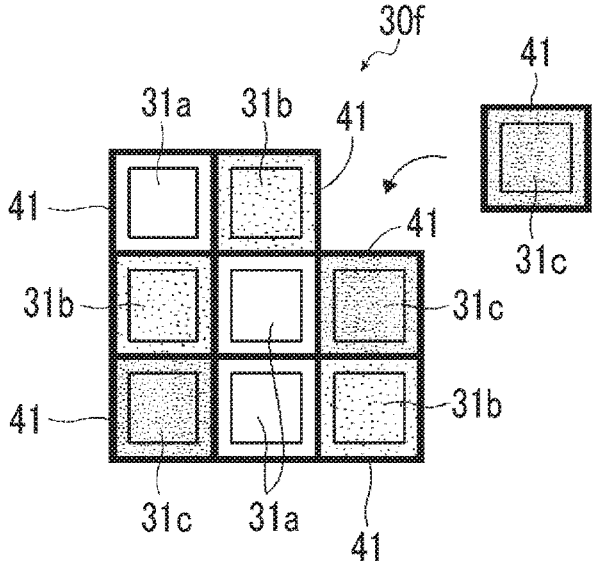
FIG. 20 is a plan view showing attachment and detachment of a unit cell in another example of the soundproof member having the soundproof structure of the present invention.

In the case of adjusting the soundproofing characteristics of a soundproof member 30*f* by combining respective soundproof cells having different resonance frequencies, for example, by combining soundproof cells 31*a*, 31*b*, and 31*c* as shown in FIG. 20, it is preferable that the attachment and detachment mechanism 41, such as a magnetic material, a Magic Tape (registered trademark), a button, and a suction cup, is attached to each of the soundproof cells 31*a*, 31*b*, and 31*c* so that the soundproof cells 31*a*, 31*b*, and 31*c* are easily combined. In addition, an uneven portion may be provided in a soundproof cell.

Figure 21:
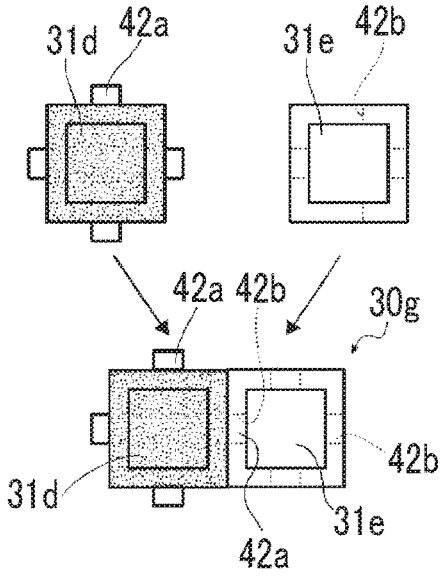
FIG. 21 is a plan view showing attachment and detachment of a unit cell in another example of the soundproof member having the soundproof structure of the present invention.

For example, as shown in FIG. 21, a protruding portion 42*a* may be provided in a soundproof cell 31*d* and a recessed portion 42*b* may be provided in a soundproof cell 31*e*, and the protruding portion 42*a* and the recessed portion 42*b* may be engaged so that the soundproof cell 31*d* and the soundproof cell 31*e* are detached from each other. As long as it is possible to combine a plurality of soundproof cells, both a protruding portion and a recessed portion may be provided in one soundproof cell.

Furthermore, the soundproof cells may be detached from each other by combining the above-described attachment and detachment mechanism 41 shown in FIG. 20 and the uneven portion, the protruding portion 42*a*, and the recessed portion 42*b* shown in FIG. 21.

Mechanical Strength of Frame

As the size of the soundproof member having the soundproof structure according to the embodiment of the present invention increases, the second frame body easily vibrates, and a function as a fixed end is degraded. Therefore, it is preferable to increase the frame stiffness by increasing the thickness of the second frame body. However, increasing the thickness of the frame causes an increase in the mass of the soundproof member. This declines the advantage of the present soundproof member that is lightweight.

Figure 22:
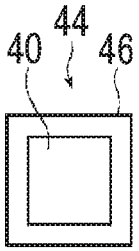
FIG. 22 is a plan view of an example of a soundproof cell of the soundproof structure of the present invention.
Figure 23:
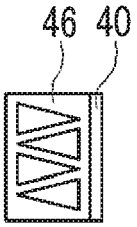
FIG. 23 is a side view of the soundproof cell shown in FIG. 22.
Figure 24:
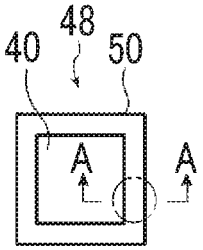
FIG. 24 is a plan view of an example of a soundproof cell of the soundproof structure of the present invention.
Figure 25:
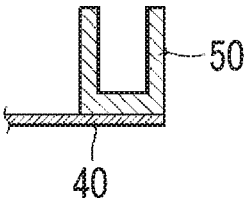
FIG. 25 is a schematic cross-sectional view of the soundproof cell shown in FIG. 24 taken along the line A-A.

Therefore, in order to reduce the increase in mass while maintaining high stiffness, it is preferable to form a hole or a groove in the second frame body. For example, by using a truss structure as shown in a side view of FIG. 23 for a second frame body 46 of a soundproof cell 44 shown in FIG. 22 or by using a Rahmem structure as shown in the diagram taken along the line A-A of FIG. 25 for a second frame body 50 of a soundproof cell 48 shown in FIG. 24, it is possible to achieve both high stiffness and light weight.

Figure 26:
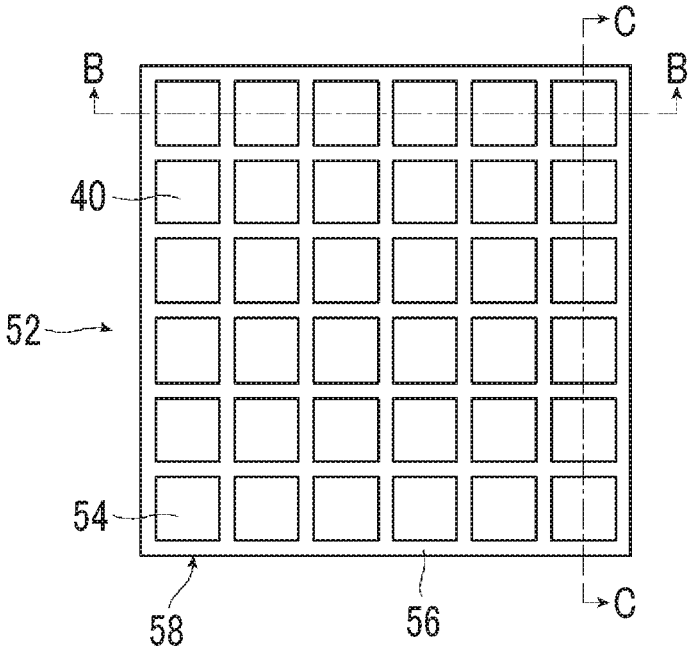
FIG. 26 is a plan view of another example of the soundproof member having the soundproof structure of the present invention.
Figure 27:
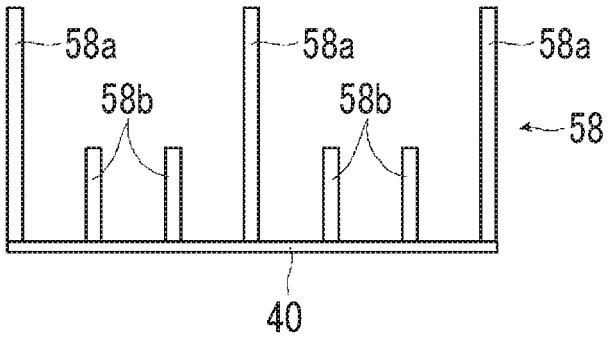
FIG. 27 is a schematic cross-sectional view of the soundproof member shown in FIG. 26 taken along the line B-B.
Figure 28:
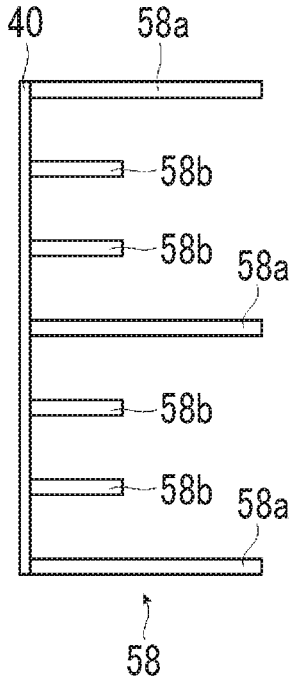
FIG. 28 is a schematic cross-sectional view of the soundproof member shown in FIG. 26 taken along the line C-C.

For example, as shown in FIGS. 26 to 28, by changing or combining the frame thickness in the plane, it is possible to secure high stiffness and to reduce the weight. As in a soundproof member 52 having the soundproof structure according to the embodiment of the present invention shown in FIG. 26, as shown in FIG. 27 that is a schematic cross-sectional view of the soundproof member 52 shown in FIG. 26 taken along the line B-B, frame members 58*a* on both outer sides and a central frame member 58*a* of a second frame body 58 configured to include a plurality of frames 56 of 36 soundproof cells 54 are made thicker than frame members 58*b* of the other portions. In the illustrated example, the frame members 58*a* on both outer sides and the central frame member 58*a* are made two times or more thicker than the frame members 58*b* of the other portions. As shown in FIG. 28 that is a schematic cross-sectional view taken along the line C-C perpendicular to the line B-B, similarly in the direction perpendicular to the line B-B, the frame members 58*a* on both outer sides and the central frame member 58*a* of the second frame body 58 are made thicker than the frame members 58*b* of the other portions. In the illustrated example, the frame members 58*a* on both outer sides and the central frame member 58*a* are made two times or more thicker than the frame members 58*b* of the other portions.

In this manner, it is possible to achieve both high stiffness and light weight.

Also in the above-described FIGS. 13 to 28, the micro perforated plate 12 and the first frame body 16 are not shown and are collectively shown as the laminate 40.

The soundproof structure according to the embodiment of the present invention is not limited to being used in various apparatuses, such as industrial equipment, transportation equipment, and general household equipment described above, and can also be used in a fixed wall, such as a fixed partition structure (partition) that is disposed in a room of a building to partition the inside of the room, and a movable wall, such as a movable partition structure (partition) that is disposed in a room of a building to partition the inside of the room.

Thus, by using the soundproof structure according to the embodiment of the present invention as a partition, it is possible to appropriately shield sound between the partitioned spaces. In particular, in the case of a movable partition, the thin and light structure according to the embodiment of the present invention is advantageous in that the structure is easy to carry.

Since the soundproof structure according to the embodiment of the present invention has light transmittance and air permeability, the soundproof structure according to the embodiment of the present invention can be suitably used as a window member.

Alternatively, the soundproof structure according to the embodiment of the present invention can also be used as a cage that surrounds an apparatus that becomes a noise source, for example, an air conditioner outdoor unit or a water heater, for noise prevention. By surrounding the noise source with this member, it is possible to absorb sound while ensuring heat dissipation and air permeability and accordingly to prevent noise.

In addition, the soundproof structure according to the embodiment of the present invention may be used for a pet breeding cage. By applying the member according to the embodiment of the present invention to the entire pet breeding cage or a part of the pet breeding cage, for example, by replacing one surface of the pet cage with this member, it is possible to obtain the pet cage that is lightweight and has a sound absorption effect. By using this cage, it is possible to protect the pet in the cage from outside noise, and it is possible to suppress the crying sound of the pet in the cage from leaking to the outside.

In addition to those described above, the soundproof structure according to the embodiment of the present invention can be used as the following soundproof members.

For example, as soundproof members having the soundproof structure according to the embodiment of the present invention, it is possible to mention: a soundproof member for building materials (soundproof member used as building materials); a soundproof member for air conditioning equipment (soundproof member installed in ventilation openings, air conditioning ducts, and the like to prevent external noise); a soundproof member for external opening portion (soundproof member installed in the window of a room to prevent noise from indoor or outdoor); a soundproof member for ceiling (soundproof member installed on the ceiling of a room to control the sound in the room); a soundproof member for floor (soundproof member installed on the floor to control the sound in the room); a soundproof member for internal opening portion (soundproof member installed in a portion of the inside door or sliding door to prevent noise from each room); a soundproof member for toilet (soundproof member installed in a toilet or a door (indoor and outdoor) portion to prevent noise from the toilet); a soundproof member for balcony (soundproof member installed on the balcony to prevent noise from the balcony or the adjacent balcony); an indoor sound adjusting member (soundproof member for controlling the sound of the room); a simple soundproof chamber member (soundproof member that can be easily assembled and can be easily moved); a soundproof chamber member for pet (soundproof member that surrounds a pet's room to prevent noise); amusement facilities (soundproof member installed in a game centers, a sports center, a concert hall, and a movie theater); a soundproof member for temporary enclosure for construction site (soundproof member for covering the construction site to prevent leakage of a lot of noise around the construction site); and a soundproof member for tunnel (soundproof member installed in a tunnel to prevent noise leaking to the inside and outside the tunnel).

EXAMPLES

Hereinafter, the present invention will be described in more detail by way of examples. Materials, the amount of use, ratios, treatment content, treatment procedures, and the like shown in the following examples can be appropriately changed without departing from the gist of the present invention. Therefore, the range of the present invention should not be interpreted restrictively by the following examples.

Example 1

Manufacturing of a Micro Perforated Plate Having a Plurality of Through-Holes Treatment shown below was performed on the surface of an aluminum base material (JIS H-4160, Alloy No. 1N30-H, aluminum purity: 99.30%) having an average thickness of 20 μm and a size of 210 mm×297 mm (A4 size), and a micro perforated plate having a plurality of through-holes was manufactured.

(a1) Aluminum Hydroxide Coating Film Forming Treatment (Coating Film Forming Step)

An aluminum hydroxide coating film was formed on an aluminum base material by performing electrolytic treatment for 20 seconds under the conditions that the total electric quantity was 1000 C/dm2 by using the aluminum base material as a cathode and using an electrolyte (nitric acid concentration of 10 g/L, sulfuric acid concentration of 6 g/L, aluminum concentration of 4.5 g/L, flow rate of 0.3 m/s) kept at 50° C. In addition, electrolytic treatment was performed with a DC power supply. The current density was set to 50 A/dm2.

After forming the aluminum hydroxide coating film, washing by spraying was performed.

(b1) Electrolytic Dissolution Treatment (Through-Hole Forming Step)

Then, through-holes were formed on the aluminum base material and the aluminum hydroxide coating film by performing electrolytic treatment for 24 seconds under the conditions that the total electric quantity was 600 C/dm2 by using the aluminum base material as an anode and using an electrolyte (nitric acid concentration of 10 g/L, sulfuric acid concentration of 6 g/L, aluminum concentration of 4.5 g/L, flow rate of 0.3 m/s) kept at 50° C. In addition, electrolytic treatment was performed with a DC power supply. The current density was set to 5 A/dm$^2$.

After forming the through-holes, washing by spraying was performed for drying.

(c1) Treatment for Removing an Aluminum Hydroxide Coating Film (Coating Film Removing Step Then, the aluminum hydroxide coating film was dissolved and removed by immersing the aluminum base material after the electrolytic dissolution treatment in an aqueous solution (liquid temperature 35° C.) having a sodium hydroxide concentration of 50 g/L and an aluminum ion concentration of 3 g/L for 32 seconds and then immersing the aluminum base material in an aqueous solution (liquid temperature 50° C.) having a nitric acid concentration of 10 g/L and an aluminum ion concentration of 4.5 g/L for 40 seconds.

Thereafter, by performing washing by spraying for drying, a micro perforated plate having through-holes was manufactured.

The average opening diameter and the average opening ratio of the through-holes of the manufactured micro perforated plate were measured. The average opening diameter was 25 μm and the average opening ratio was 6%.

Manufacturing of a Soundproof Structure

A commercially available mesh (PP-#50 manufactured by As One Corporation: material of polypropylene, wire diameter of 136 μm, mesh opening of 370 μm, and opening ratio of 53%) was used as a first frame body.

The soundproof structure 10*a* shown in FIG. 1 was manufactured by arranging the first frame body in contact with one surface of the manufactured micro perforated plate.

Comparative Example 1

A soundproof structure was manufactured in the same manner as in Example 1 except that there was no first frame body. That is, a soundproof structure of a single micro perforated plate was manufactured.

Evaluation

Acoustic Characteristics

Figure 29:
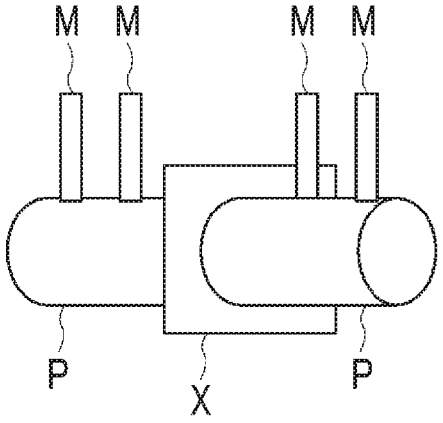
FIG. 29 is a perspective view schematically showing a measurement apparatus for measuring the acoustic characteristics.

The acoustic characteristics of the manufactured soundproof structure were measured by a transfer function method using four microphones M in the self-made acoustic tube P formed of acrylic as shown in FIG. 29. This method is based on "ASTM E2611-09: Standard Test Method for Measurement of Normal Incidence Sound Transmission of Acoustical Materials Based on the Transfer Matrix Method".

A soundproof structure X was interposed in the acoustic tube P, and the vertical acoustic transmittance, reflectivity, and absorbance of the soundproof structure were measured.

Figure 30:
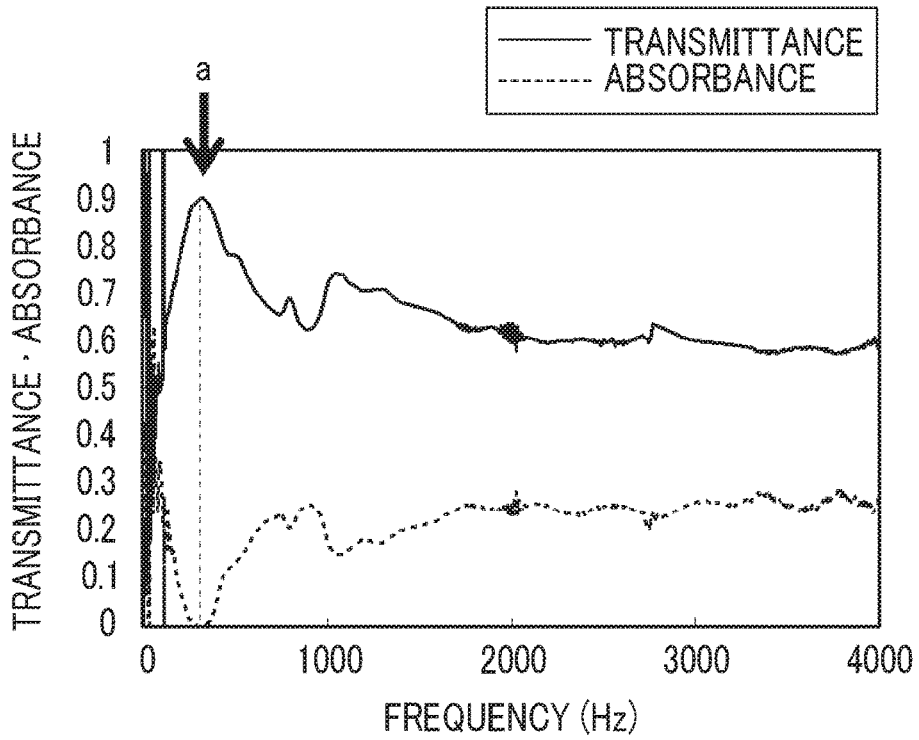
FIG. 30 is a graph showing the relationship between the frequency and the acoustic characteristics.
Figure 31:
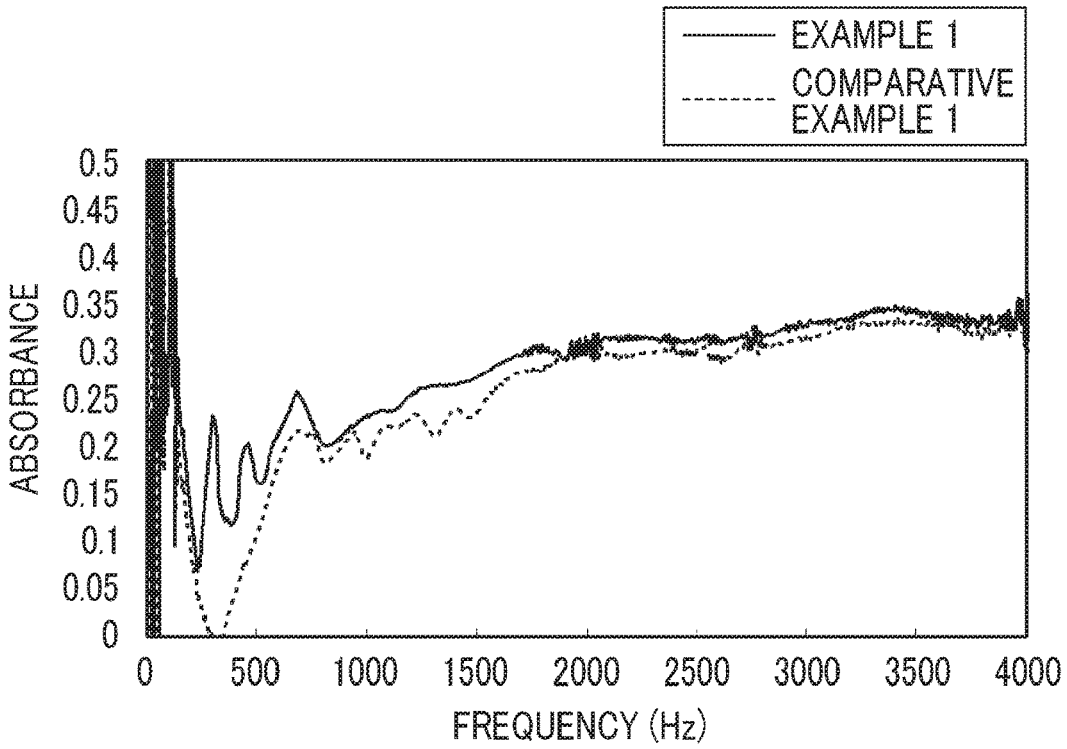
FIG. 31 is a graph showing the relationship between the frequency and the absorbance.

FIG. 30 shows the measurement results of the transmittance and the absorbance in Comparative example 1, and FIG. 31 shows the measurement results of the absorbance in Example 1 and Comparative Example 1.

As shown in FIG. 30, it can be seen that even a single micro perforated plate has broadband sound absorbing characteristics ranging from 1000 Hz to 4000 Hz. However, it can be seen that the absorbance is greatly decreased in the vicinity of 310 Hz. Since the transmittance increases at this frequency, it can be thought that the decrease in the absorbance at this frequency is due to the fact that the sound is transmitted by vibration due to the resonance of the micro perforated plate.

As shown in FIG. 31, it can be seen that the absorbance in the vicinity of 310 Hz in Example 1, which is the soundproof structure according to the embodiment of the present invention, is higher than that in Comparative example 1. This is believed to be because the soundproof structure of Example 1 has the first frame body and accordingly, the stiffness of the micro perforated plate increases and the resonance vibration frequency increases.

The opening diameter of the hole portion of the first frame body is 370 μm. The resonance vibration frequency of the micro perforated plate in a case where the opening diameter of the first frame body is 370 μm, which is calculated based on the following Equation (1) (reference document "Formulas for dynamics, acoustics and vibration" p. 261), is 161 kHz that is higher than the audible range (100 Hz to 20000 Hz). Therefore, it is possible to suppress a decrease in absorbance due to resonance of the micro perforated plate.

$$f_{i,j} = \frac{\lambda_{i,j}^2}{2\pi a^2}\left[\frac{Eh^2}{12\rho(1-\upsilon^2)}\right]^{1/2} \quad \text{[Equation 1]}$$

In the above Equation (1), f is a vibration frequency, λ is a vibration frequency parameter (35.99 square and mode 1), a is the length of one side, E is the modulus of elasticity, ρ is a density, and v is a Poisson's ratio.

Example 2

A soundproof structure was manufactured in the same manner as in Example 1 except that a commercially available mesh (PP-#10 manufactured by As One Corporation: material of polypropylene, wire diameter of 395 μm, mesh opening of 2.145 mm, and opening ratio of 71.3%) was used as a first frame body.

Example 3

Figure 7:
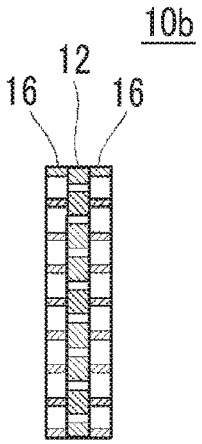
FIG. 7 is a cross-sectional view schematically showing another example of the soundproof structure of the present invention.

The soundproof structure 10*b* shown in FIG. 7 was manufactured in the same manner as in Example 2 except that a first frame body was disposed on both surfaces of the micro perforated plate. From the above Equation (1), the resonance vibration frequency was calculated as 126 kHz.

Evaluation

Absorbance

The absorbance of the manufactured soundproof structure was measured in the same manner as in Example 1. The measurement result is shown in FIG. 32.

Figure 32:
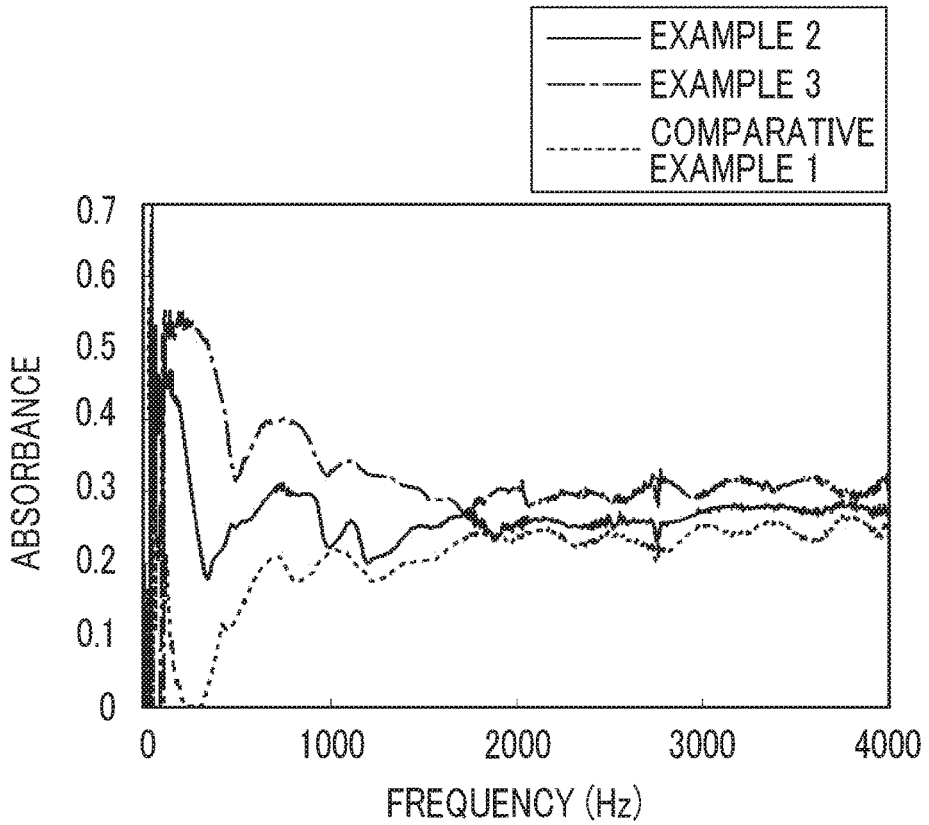
FIG. 32 is a graph showing the relationship between the frequency and the absorbance.

As shown in FIG. 32, it can be seen that the absorbance in the vicinity of 310 Hz of the soundproof structures of Examples 2 and 3 of the present invention is higher than that in Comparative example 1.

From the comparison between Examples 2 and 3, it can be seen that the stiffness can be further increased by arranging the first frame body on both the surfaces of the micro perforated plate and accordingly it is possible to suppress a decrease in absorbance.

Example 4

A soundproof structure was manufactured in the same manner as in Example 3 except that a micro perforated plate manufactured as follows was used.

From the above Equation (1), the resonance vibration frequency was calculated as 209 kHz.

A PET film having a thickness of 100 μm was used as a micro perforated plate, and through-holes each having an opening diameter of 60 μm were formed every 1 mm using a laser processing machine. The opening ratio was 0.2%.

Comparative Example 2

A soundproof structure was manufactured in the same manner as in Example 4 except that there was no first frame body. That is, a soundproof structure of a single micro perforated plate was manufactured.

Evaluation

Absorbance

The absorbance of the manufactured soundproof structure was measured in the same manner as in Example 1. The measurement result is shown in FIG. 33.

Figure 33:
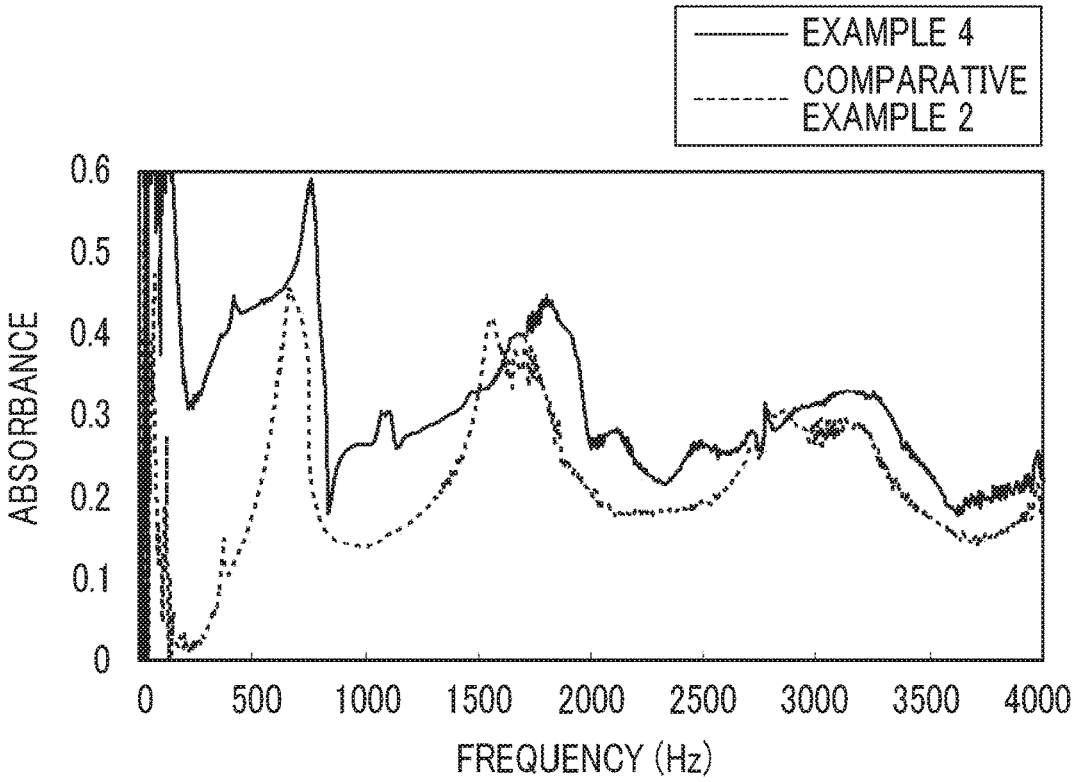
FIG. 33 is a graph showing the relationship between the frequency and the absorbance.

As shown in FIG. 33, in the soundproof structure of Comparative example 2, it can be seen that the absorbance is decreased in the vicinities of 230 Hz, 1,000 Hz, 2240 Hz, and 3500 Hz. In contrast, in the soundproof structure of Example 4, it can be seen that the absorbance in the vicinities of 230 Hz, 1,000 Hz, 2240 Hz, and 3500 Hz is higher than that in Comparative example 2.

Example 5

A soundproof structure was manufactured in the same manner as in Example 2 except that the micro perforated plate and the first frame body were bonded and fixed with an adhesive.

As the adhesive, spray glue 55 (manufactured by 3M Co.) was used.

Evaluation

Absorbance

The absorbance of the manufactured soundproof structure was measured in the same manner as in Example 1. The measurement result is shown in FIG. 34.

Figure 34:
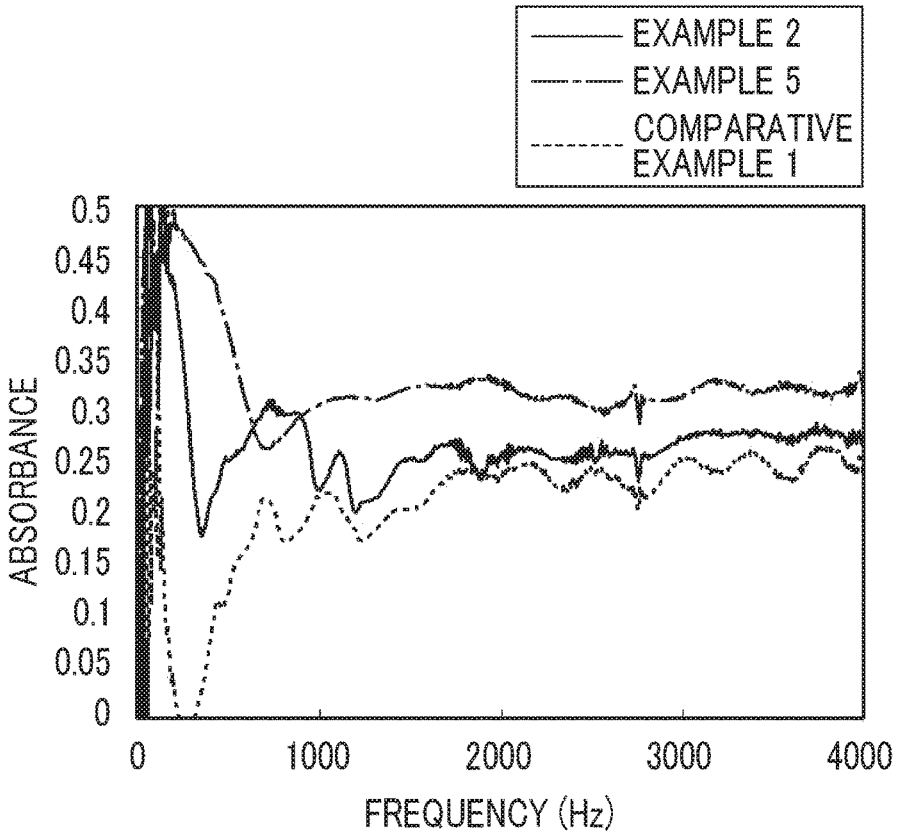
FIG. 34 is a graph showing the relationship between the frequency and the absorbance.

As shown in FIG. 34, it can be seen that the absorbance of the soundproof structure of Example 5 is higher than that of the soundproof structure of Example 2 in a wide frequency band.

Example 6

A soundproof structure was manufactured in the same manner as in Example 4 except that a commercially available mesh (stainless steel mesh #10 (plain weave) manufactured by AS ONE Corporation: material SUS 304, wire diameter of 500 μm, mesh opening of 2.5 mm, and opening ratio of 64.5%) was used as a first frame body.

Evaluation

Absorbance

The absorbance of the manufactured soundproof structure was measured in the same manner as in Example 1. The measurement result is shown in FIG. 35.

Figure 35:
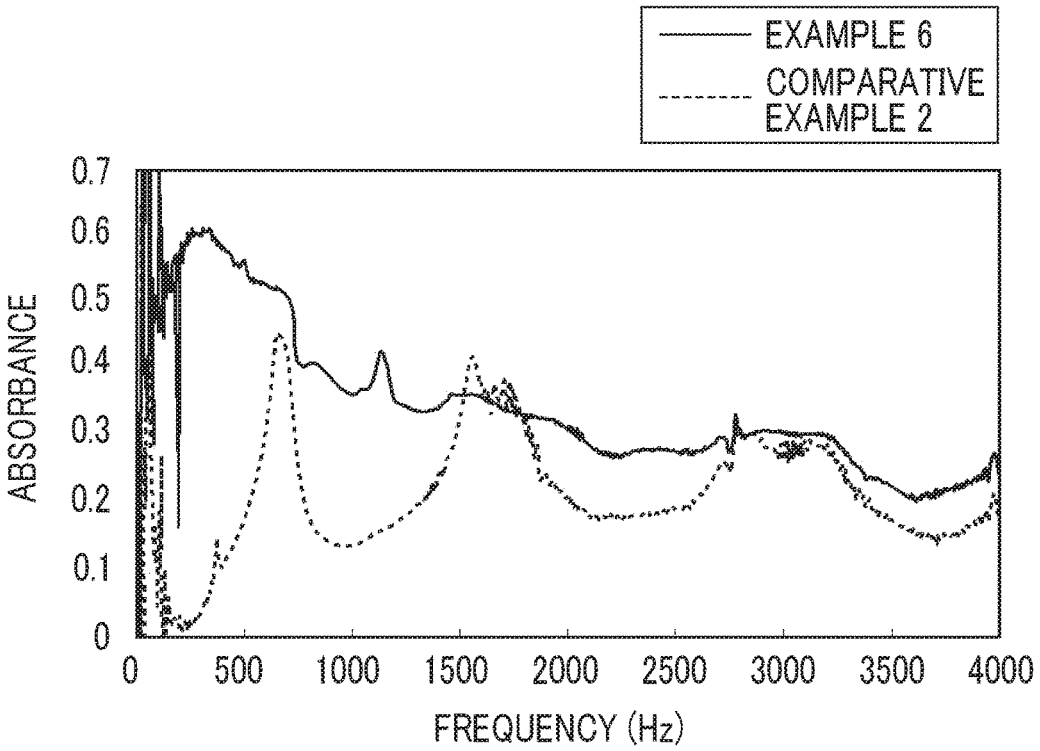
FIG. 35 is a graph showing the relationship between the frequency and the absorbance.

As shown in FIG. 35, it can be seen that the absorbance of the soundproof structure of Example 6 is higher than that of the soundproof structure of Comparative example 2 in a wide frequency band.

In addition, compared with Example 4 in which a polypropylene mesh is used, a local drop in absorbance is small. This is thought that the stiffness of the stainless steel mesh is higher than that of the polypropylene mesh and accordingly the resonance of the micro perforated plate can be further suppressed.

Example 7

The soundproof structure 10*d* shown in FIG. 9 was manufactured in which the same first frame body as in Example 1 was disposed on both surfaces of the same micro perforated plate as in Example 1 and was interposed between two second frame bodies.

As the second frame body, one formed of an aluminum material and having a thickness of 3 mm and an opening portion of 25 mm square was used.

Comparative Example 3

A soundproof structure was manufactured in the same manner as in Example 7 except that there was no first frame body.

Evaluation

Absorbance

The absorbance of the manufactured soundproof structure was measured in the same manner as in Example 1. The measurement result is shown in FIG. 36.

Figure 36:
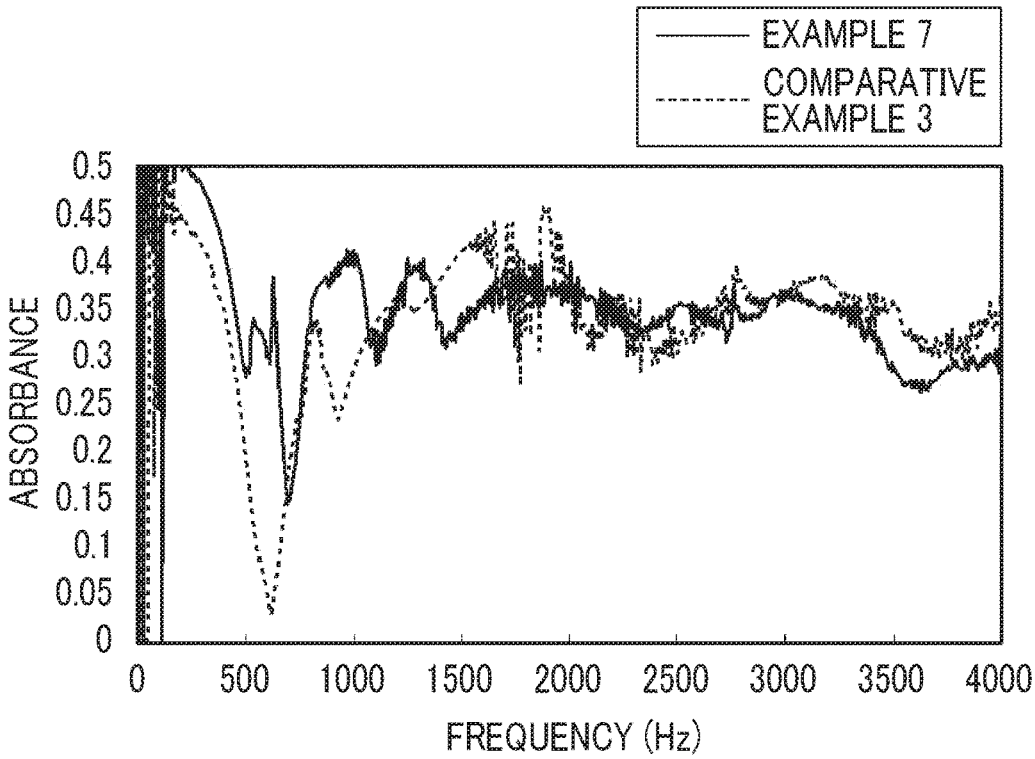
FIG. 36 is a graph showing the relationship between the frequency and the absorbance.

As shown in FIG. 36, it can be seen that the absorbance is decreased in the vicinity of 600 Hz in the soundproof structure of Comparative example 3, but the absorbance in the vicinity of 600 Hz in the soundproof structure of Example 7 is higher than that in Comparative example 3.

Example 8

The soundproof structure 10*c* shown in FIG. 8 was manufactured by bonding and fixing the same first frame body as in Example 1 to one surface of the same micro perforated plate as in Example 1 and bonding and fixing the following second frame body to the other surface of the micro perforated plate, and the soundproof structure 10*c* was disposed in an opening member having an opening to obtain the opening structure shown in FIG. 11.

As the second frame body, one formed of a vinyl chloride material and having a thickness of 20 mm and an opening portion of 16 mm square was used.

As the opening member, one having an opening of φ40 mm was used.

The soundproof structure was disposed in the opening so that the angle formed by the perpendicular direction z of the film surface of the micro perforated plate and the direction s perpendicular to the opening cross section of the opening member was 45°.

Comparative Example 4

A soundproof structure was manufactured in the same manner as in Example 8 except that there was no first frame body, and the soundproof structure was disposed in an opening member to obtain an opening structure.

Evaluation

Absorbance

The absorbance of the manufactured soundproof structure was measured. The measurement result is shown in FIG. 37.

Figure 37:
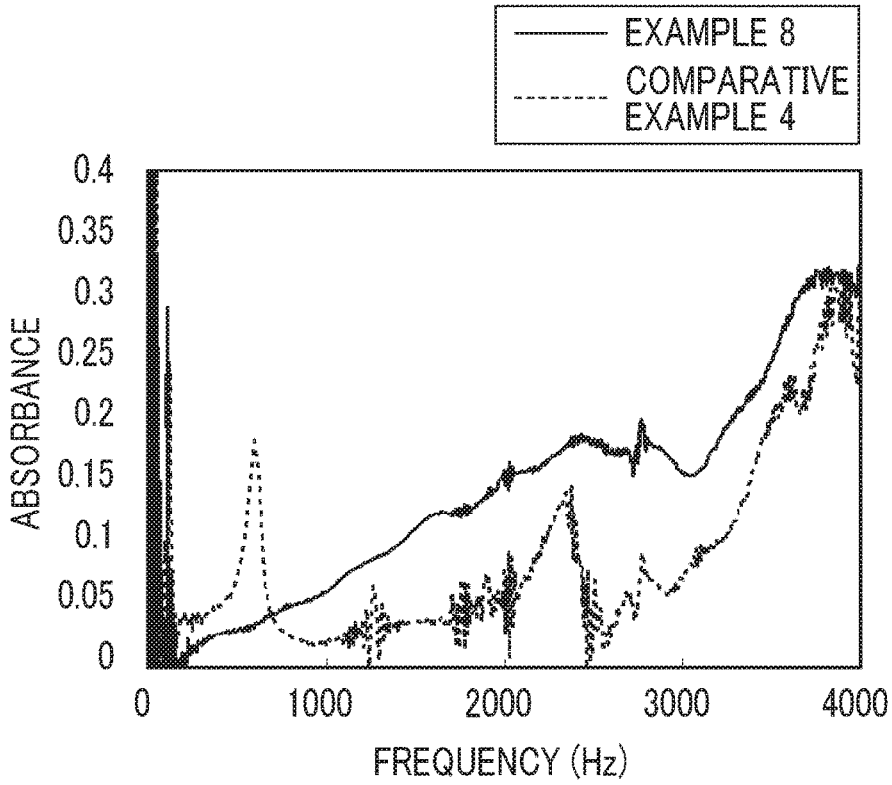
FIG. 37 is a graph showing the relationship between the frequency and the absorbance.

As shown in FIG. 37, it can be seen that the absorbance in Example 8 is higher than that in Comparative example 4 in a wide frequency band. In addition, since there is the region q serving as a ventilation port, it is possible to insulate the sound in a broad band with the wind passing through the region q.

Example 9

A soundproof structure was manufactured in the same manner as in Example 3 except that a rear plate is further provided.

Figure 38:
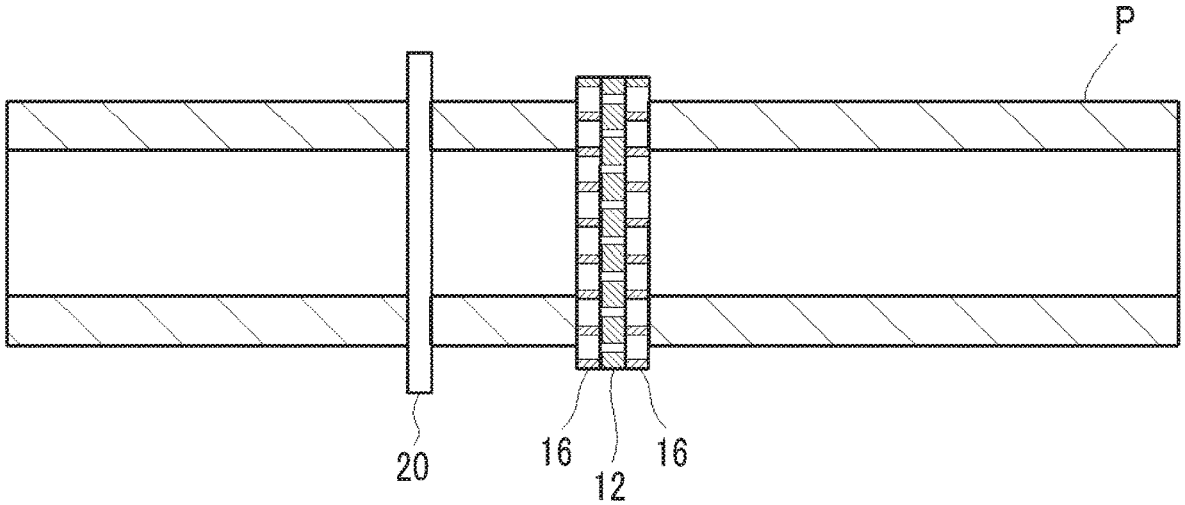
FIG. 38 is a perspective view schematically showing a measurement apparatus for measuring the acoustic characteristics.

As the rear plate, an acrylic plate having a thickness of 3 mm was used. Specifically, as shown in FIG. 38, the acoustic tube P was fixed at a position separated by 50 mm from the laminate of the micro perforated plate and the first frame body.

Comparative Example 5

A soundproof structure was manufactured in the same manner as in Example 9 except that there was no first frame body.

Evaluation

Absorbance

The absorbance of the manufactured soundproof structure was measured in the same manner as in Example 1. The measurement result is shown in FIG. 39.

Figure 39:
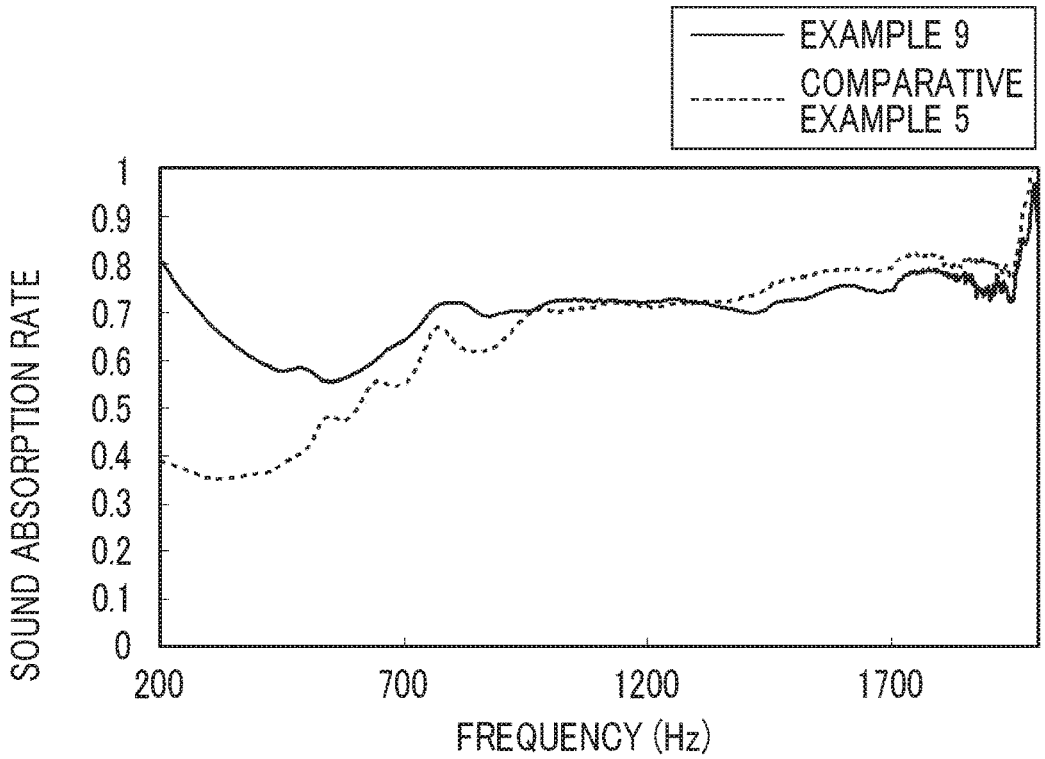
FIG. 39 is a graph showing the relationship between the frequency and the absorbance.

As shown in FIG. 39, it can be seen that the absorbance is decreased in a band of 950 Hz or less in the soundproof structure of Comparative example 5, but the absorbance in the band of 950 Hz or less in the soundproof structure of Example 9 is higher than that in Comparative example 5.

Example 10

Figure 48:
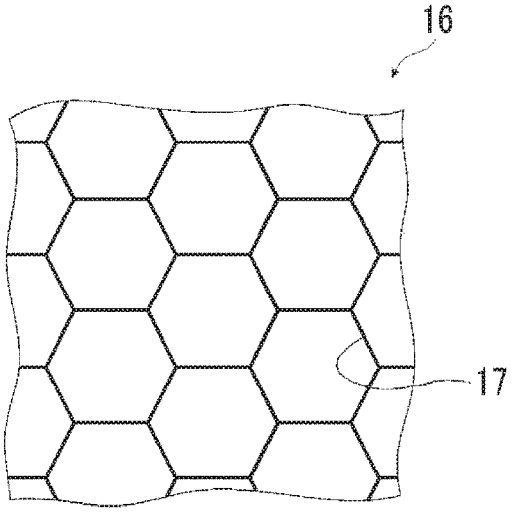
FIG. 48 is a front view schematically showing another example of the first frame body.

The first frame body 16 having a honeycomb structure as shown in FIG. 48 was disposed on one surface side of the micro perforated plate 12 thickness: 20 μm, average opening diameter: 25 μm, average opening ratio: 6.2%) manufactured in Example 1 and the rear plate 20 was disposed on a surface of the first frame body 16 opposite to a surface on which the micro perforated plate was disposed as shown in FIG. 46, thereby manufacturing a soundproof structure.

The material of the first frame body 16 was ABS, the thickness was 15 mm, the shape of the opening cross section of the hole portion 17 was a regular hexagon, the diameter of the circumscribed circle was 1 cm, and the opening ratio was about 95%.

The material of the rear plate 20 was aluminum, and the thickness was 5 cm.

Comparative Example 6

A soundproof structure was manufactured in the same manner as in Example 10 except that there was no first frame body. That is, the micro perforated plate and the rear plate were provided, and the micro perforated plate and the rear plate were disposed so as to be spaced apart by 15 mm from each other.

Evaluation

Absorbance

The absorbance of the manufactured soundproof structure was measured in the same manner as in Example 1. The measurement result is shown in FIG. 50.

Figure 50:
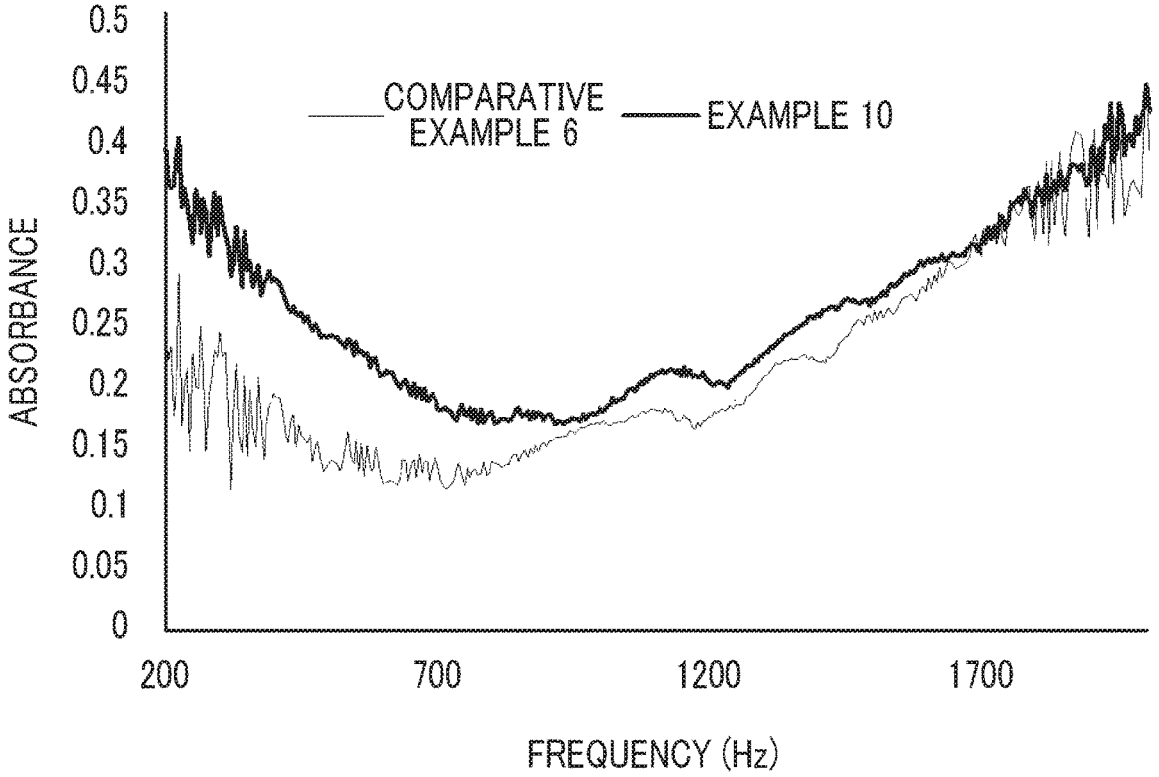
FIG. 50 is a graph showing the relationship between the frequency and the absorbance.

As shown in FIG. 50, it can be seen that the absorbance in Example 10 is higher than that in Comparative example 6 in a broad band. In particular, it can be seen that the absorbance in the band of 1200 Hz or less is high.

From the above results, the effect of the present invention is obvious.

Simulation

As described above, the present inventors presumed that the principle of sound absorption of the soundproof structure according to the embodiment of the present invention was friction in a case where the sound passed through a micro through-hole.

For this reason, optimally designing the average opening diameter and the average opening ratio of the through-holes of the micro perforated plate so as to increase friction is important in order to increase the absorbance. It can be thought that this is because, particularly in the high-frequency region, the film vibration is also small and accordingly the influence of being attached to the first frame body and the second frame body is not large, and the sound is absorbed by the sound absorbing characteristics of the through-hole+micro perforated plate itself.

For that purpose, simulation regarding frictional heat due to through-holes was performed.

Specifically, designing was performed using an acoustic module of COMSOL ver 5.1 (COMSOL Inc) that is analysis software of the finite element method. By using a thermoacoustic model in the acoustic module, it is possible to calculate sound absorption due to friction between the wall and sound waves passing through a fluid (including air).

First, as a comparison with the experiment, the single micro perforated plate having through-holes used in Example 1 was loosely fixed to the acoustic tube used in Example 1 to measure the absorbance of the micro perforated plate. That is, the micro perforated plate itself was evaluated by reducing the influence of the fixed end according to a reduction in the number of components attached to the first frame body. The measurement result of the absorbance is shown in FIG. 40 as a reference example.

In the simulation, using the value of the library of COMSOL as a physical property value of aluminum, the inside of the through-hole was calculated by the thermoacoustic module, and sound absorption due to film vibration and friction inside the through-hole was calculated. In the simulation, the end portion of the micro perforated plate was fixed to the roller so that the micro perforated plate freely moved in a direction perpendicular to the plane of the micro perforated plate, thereby reproducing the system of the single micro perforated plate. The simulation result is shown in FIG. 40.

Figure 40:
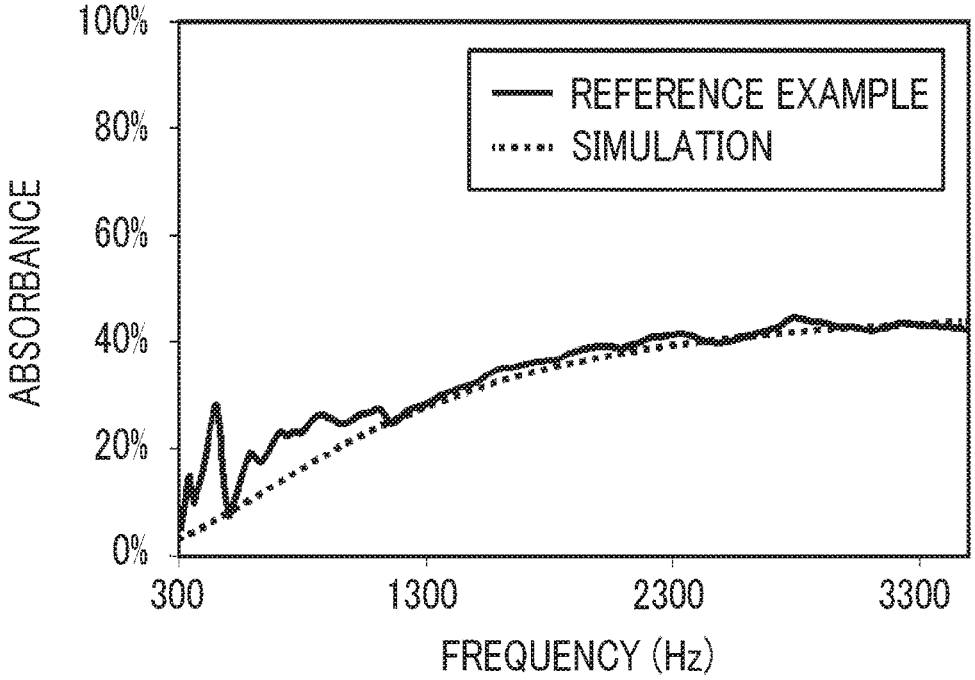
FIG. 40 is a graph showing the relationship between the frequency and the absorbance.

As shown in FIG. 40, in a case where the absorbances of the experiment and the simulation are compared, it can be seen that the simulation reproduces the experiment well. The spike-like change on the low-frequency side in the experiment indicates that the effect of film vibration due to the fixed end slightly occurs even in a case where the end portion of the micro perforated plate is loosely fixed. Since the influence of the film vibration became smaller as the frequency became higher, there was good matching with the result of the simulation in which the performance of the single micro perforated plate was evaluated.

From this result, it was possible to guarantee that the simulation reproduced the experiment result.

Next, in order to optimize the friction characteristics of the through-hole, the micro perforated plate portion was fixedly constrained and a simulation was performed in which the sound passed only through the through-hole, and the thickness of the micro perforated plate and the average opening diameter and the average opening ratio of the through-hole were changed to examine the behavior of absorption. In addition, the following calculation was performed with the frequency of 3000 Hz.

Figure 41:
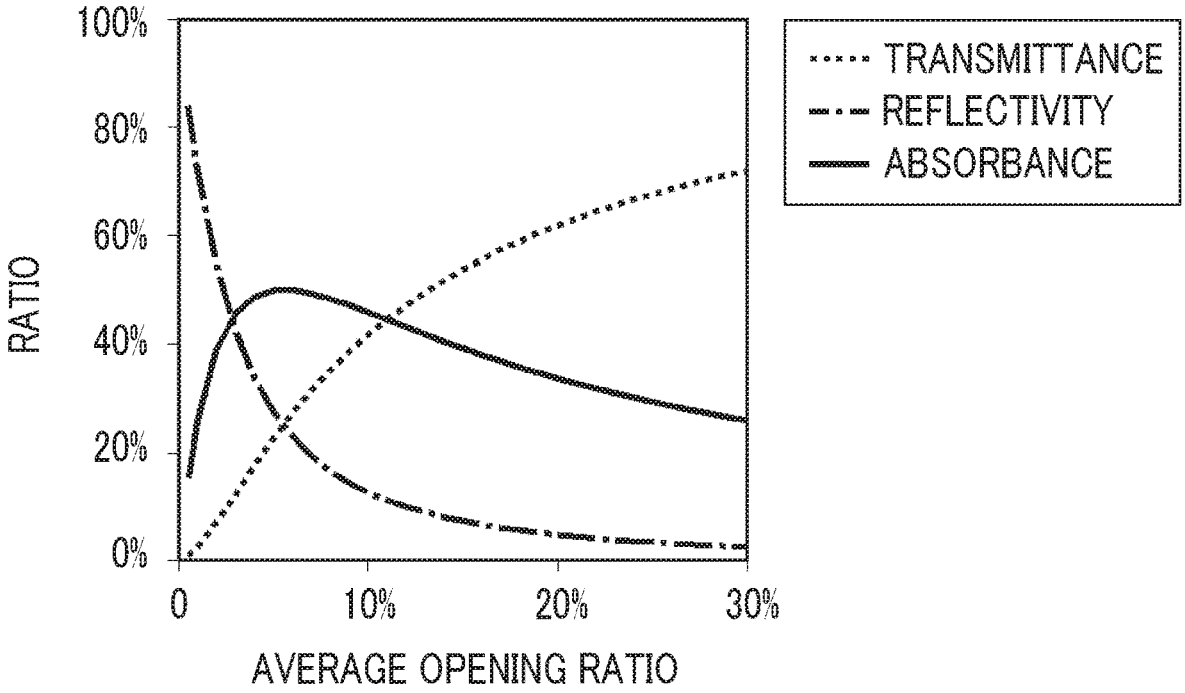
FIG. 41 is a graph showing the relationship between the average opening ratio and the acoustic characteristics.

For example, FIG. 41 shows the calculation results of changes in the transmittance T, the reflectivity R, and the absorbance A in the case of changing the average opening ratio with the thickness of the micro perforated plate being 20 μm and the average opening diameter of the through-hole being 20 μm. Focusing on the absorbance, it can be seen that the absorbance changes by changing the average opening ratio. Therefore, it can be seen that there is an optimum value for maximizing the absorbance. In this case, it can be seen that absorption is maximized at an opening ratio of 6%. In this case, the transmittance and the reflectivity are almost equal. Thus, particularly in a case where the average opening diameter is small, a smaller average opening ratio is not preferable, and the average opening ratio needs to be adjusted to the optimum value.

In addition, it can be seen that the range of the average opening ratio at which the absorbance increases smoothly spreads with the optimum average opening ratio as the center.

Figure 42:
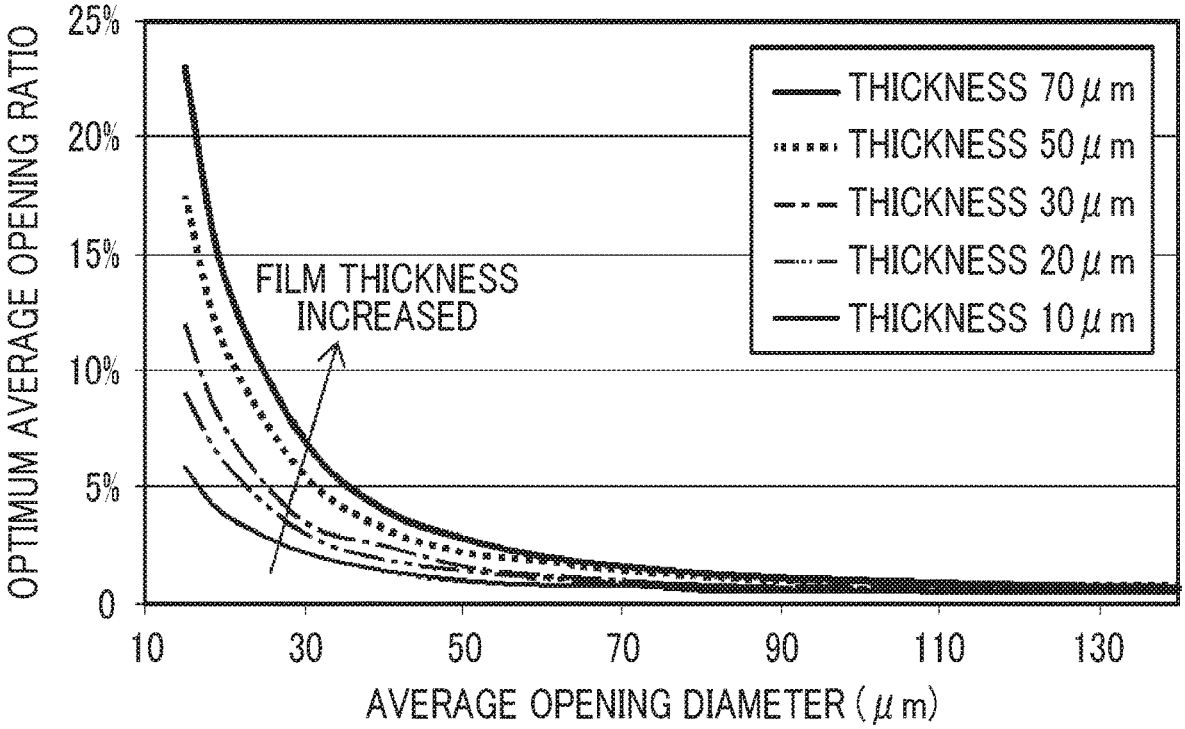
FIG. 42 is a graph showing the relationship between the average opening diameter and the optimum average opening ratio.

The average opening diameter of the through-holes was changed in the range of 20 μm to 140 μm for each of the thicknesses 10 μm, 20 μm, 30 μm, 50 μm, and 70 μm of the micro perforated plate, and the average opening ratio at which the absorbance was maximized under each condition and the absorbance at that time were calculated and summarized. The result is shown in FIG. 42.

In a case where the average opening diameter of the through-holes is small, the optimum average opening ratio changes depending on the thickness of the micro perforated plate. However, in a case where the average opening diameter of the through-holes is about 100 μm or more, a very small average opening ratio of 0.5% to 1.0% is the optimum value.

Figure 43:
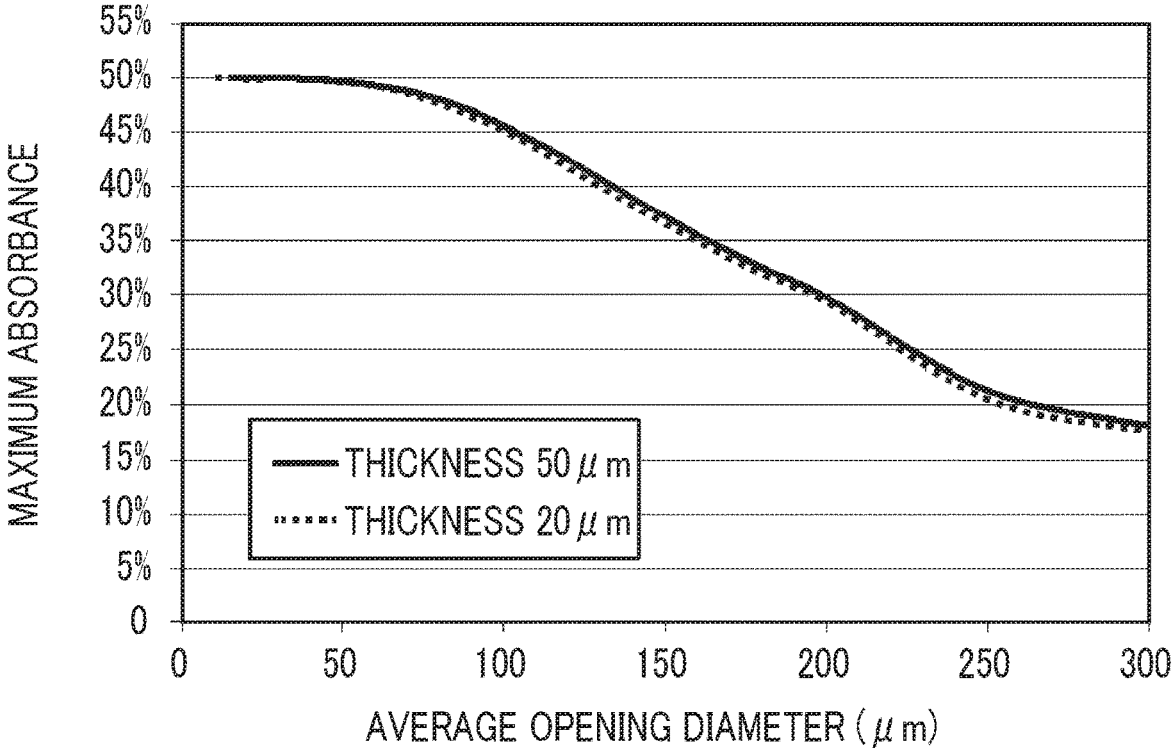
FIG. 43 is a graph showing the relationship between the average opening diameter and the maximum absorbance.

FIG. 43 shows a maximum absorbance in a case where the average opening ratio is optimized with respect to the average opening diameter of each through-hole. FIG. 43 shows two cases of a case where the thickness of the micro perforated plate is 20 μm and a case where the thickness of the micro perforated plate is 50 μm. It was found that the maximum absorbance was almost determined by the average opening diameter of the through-holes irrespective of the thickness of the micro perforated plate. It can be seen that the maximum absorbance is 50% in a case where the average opening diameter is as small as 50 μm or less but the absorbance becomes larger as the average opening diameter becomes larger than 50 μm. The absorbance decreases to 45% at an average opening diameter of 100 μm, 30% at an average opening diameter of 200 μm, and 20% at an average opening diameter of 250 μm. Therefore, it became clear that the smaller the average opening diameter, the better.

In the present invention, since it is preferable that the absorbance is high, an average opening diameter of 250 μm or less with an absorbance of 20% as an upper limit is required, an average opening diameter of 100 μm or less with the absorbance of 45% as an upper limit is preferable, and an average opening diameter of 50 μm, or less with the absorbance of 50% as an upper limit is most preferable.

Figure 44:
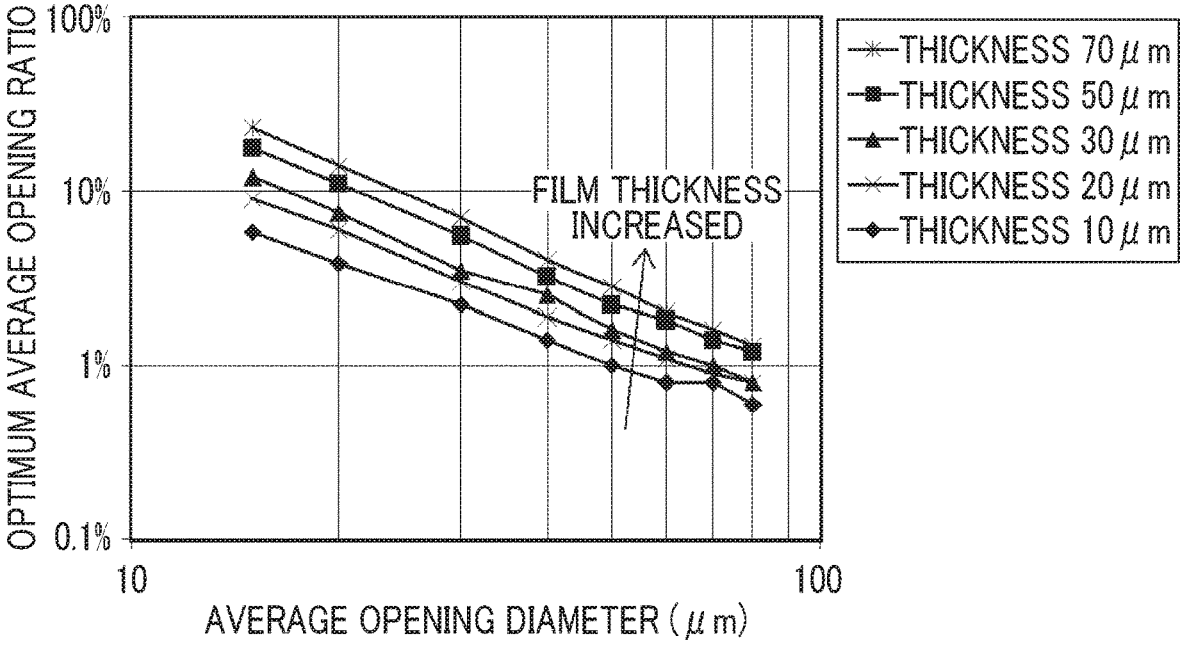
FIG. 44 is a graph showing the relationship between the average opening diameter and the optimum average opening ratio.

Calculation was performed in detail in a case where the average opening diameter was 100 μm or less at the optimum average opening ratio with respect to the average opening diameter of the through-holes. For each of the thicknesses of 10 μm, 20 μm, 30 μm, 50 μm, and 70 μm, a result showing the optimum average opening ratio for each average opening diameter of the through-holes is shown in a double logarithmic graph in FIG. 44. From the graph, it was found that the optimum average opening ratio changed approximately −1.6 power with respect to the average opening diameter of the through-holes.

More specifically, assuming that the optimum average opening ratio was rho_center, the average opening diameter of the through-holes was phi (μm), and the thickness of the micro perforated plate was t (μm), it was found that a=2+0.25×t was determined in the case of rho_center=a×phi$^{-1.6}$.

In this manner, particularly in a case where the average opening diameter of the through-holes is small, the optimum average opening ratio is determined by the thickness of the micro perforated plate and the average opening diameter of the through-holes.

Figure 45:
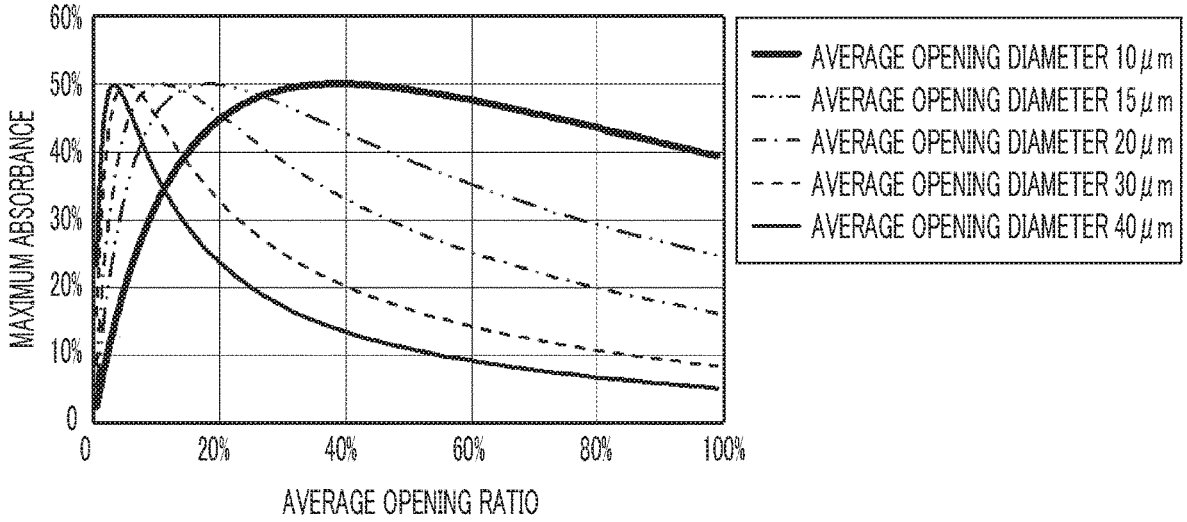
FIG. 45 is a graph showing the relationship between the average opening ratio and the maximum absorbance.

As described above, the range in which the absorbance increases smoothly spreads with the optimum average opening ratio as the center. FIG. 45 shows a result obtained by changing the average opening ratio in the simulation of the micro perforated plate having a thickness of 50 μm for the detailed analysis. The average opening diameter of the through-holes were 10 μm, 15 μm, 20 μm, 30 μm, and 40 μm, and the average opening ratio was changed from 0.5% to 99%.

At any average opening diameter, the range of the average opening ratio at which the absorbance increases spreads around the optimum average opening ratio. As a feature, the range of the average opening ratio in which the absorbance increases as the average opening diameter of the through-holes decreases is wide. On the average opening ratio side higher than the optimum average opening ratio, the range of the average opening ratio in which the absorbance increases is wide.

Since the maximum value of the absorbance is approximately 50% at any average opening diameter, Table 1 shows the average opening ratio of the lower limit and the average opening ratio of the upper limit where the absorbance is 30%, 40%, and 45%. Table 2 shows the range of each absorbance from the optimum average opening ratio.

For example, in a case where the average opening diameter of the through-holes is 20 μm, the optimum average opening ratio is 11%, and the lower limit and the upper limit of the average opening ratio at which the absorbance is 40% or more are 4.5% and 28%, respectively. In this case, the range of the average opening ratio at which the absorbance is 40% with the optimum average opening ratio as a reference is (4.5%−11.0%)=−6.5% to (28.0%−11.0%)=17.0%. Therefore, in Table 2, the range of the average opening ratio at which the absorbance is 40% with the optimum average opening ratio as a reference is shown as −6.5% to 17.0%.

TABLE 1

| Average opening diameter | Optimum average opening ratio | 30% range Lower limit | 40% range Lower limit | 45% range Lower limit | 45% range Upper limit | 40% range Upper limit | 30% range Upper limit |
|---|---|---|---|---|---|---|---|
| 10 μm | 39.0% | 9.0% | 15.0% | 20.5% | 73.0% | 96.0% | Exceeding 99% |
| 15 μm | 17.5% | 4.5% | 7.0% | 9.5% | 34.0% | 47.0% | 77.0% |
| 20 μm | 11.0% | 2.5% | 4.5% | 6.0% | 20.5% | 28.0% | 46.0% |
| 30 μm | 5.5% | 1.5% | 2.5% | 3.0% | 10.0% | 13.5% | 23.0% |
| 40 μm | 3.0% | 1.0% | 1.5% | 2.0% | 6.0% | 8.0% | 14.0% |

TABLE 2

| Average opening diameter | Range from Optimum average opening ratio | | |
|---|---|---|---|
| | 45% range | 40% range | 30% range |
| 10 μm | −18.5%~34% | −24.0%~57.0% | −30.0%~ |
| 15 μm | −8.0%~16.5% | −10.5%~29.5% | −13.0%~59.5% |
| 20 μm | −5.0~9.5% | −6.5%~17.0% | −8.5%~35.0% |
| 30 μm | −2.5%~4.5% | −3.0%~8.0% | −4.0%~17.5% |
| 40 μm | −1.0%~3.0% | −1.5%~5.0% | −2.0%~11.0% |

From Table 2, in a case where the widths of the absorbance for each average opening diameter of the through-holes are compared, assuming that the average opening diameter of the through-holes is phi (μm), the width of the absorbance changes at a ratio of approximately 100×phi−2. Therefore, for each absorbance of 30%, 40% and 45%, an appropriate range can be determined for each average opening diameter of through-holes.

That is, using the above-described optimum average opening ratio rho_center and using a range in a case where the average opening diameter of the through-holes is 20 μm as a reference, the range of the absorbance of 30% needs to fall within a range in which rho_center−0.085×(phi/20)$^{-2}$ is the average opening ratio of the lower limit and rho_center+0.35×(phi/20)$^{-2}$ is the average opening ratio of the upper limit. However, the average opening ratio is limited to a range larger than 0 and smaller than 1 (100%).

Preferably, the absorbance is in the range of 40%, and the range is a range in which rho_center−0.24×(phi/10)$^{-2}$ is the average opening ratio of the lower limit and rho_center+0.57×(phi/10)$^{-2}$ is the average opening ratio of the upper limit. Here, in order to minimize the error as much as possible, the reference of the average opening diameter of the through-holes was set to 10 μm.

More preferably, the absorbance is in the range of 45%, and the range is a range in which rho_center−0.185×(phi/10)$^{-2}$ is the average opening ratio of the lower limit and rho_center+0.34×(phi/10)$^{-2}$ is the average opening ratio of the upper limit.

Figure 51:
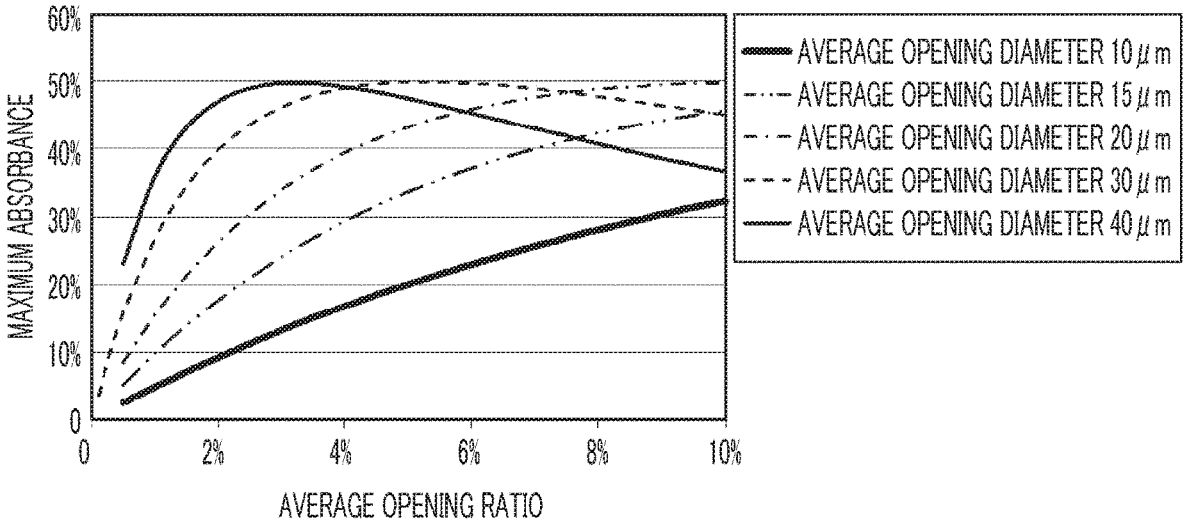
FIG. 51 is a graph showing the relationship between the average opening ratio and the maximum absorbance.

In addition, in order to determine the range of the optimum average opening ratio in the case of a smaller absorbance, a finer calculation was performed in the range where the average opening ratio is small. As a representative example, FIG. 51 shows a result in a case where the thickness of the plate-shaped member is 50 μm and the average opening diameter of the through-holes is 30 μm.

For each absorbance of 10%, 15% and 20%, the range of the average opening ratio at which this absorbance is obtained and approximate expressions are shown in Tables 3 and 4, respectively. In Table 4, "rho_center" is expressed as "rc".

TABLE 3

| Average opening diameter | Optimum average opening ratio | 10% range | | 15% range | | 20% range | |
|---|---|---|---|---|---|---|---|
| | | Lower limit | Upper limit | Lower limit | Upper limit | Lower limit | Upper limit |
| 30 μm | 5.5% | 0.3% | 85.0% | 0.5% | 56.0% | 0.7% | 40.0% |

TABLE 4

| | Lower limit | Upper limit |
|---|---|---|
| 10% range | $rc - 0.052 \times (phi/30)^{-2}$ | $rc + 0.795 \times (phi/30)^{-2}$ |
| 15% range | $rc - 0.050 \times (phi/30)^{-2}$ | $rc + 0.505 \times (phi/30)^{-2}$ |
| 20% range | $rc - 0.048 \times (phi/30)^{-2}$ | $rc + 0.345 \times (phi/30)^{-2}$ |

From Tables 3 and 4, using the above-described optimum average opening ratio rho_center and using a range in a case where the average opening diameter of the through-holes is 30 μm as a reference, the range of the absorbance of 10% needs to fall within a range in which rho_center−0.052×$(phi/30)^{-2}$ is the average opening ratio of the lower limit and rho_center+0.795×$(phi/30)^{-2}$ is the average opening ratio of the upper limit. However, the average opening ratio is limited to a range larger than 0 and smaller than 1 (100%).

Preferably, the absorbance is 15% or more, and the range is a range in which rho_center−0.050×$(phi/30)^{-2}$ is the average opening ratio of the lower limit and rho_center+0.505×$(phi/30)^{-2}$ is the average opening ratio of the upper limit.

More preferably, the absorbance is 20% or more, and the range is a range in which rho_center−0.048×$(phi/30)^{-2}$ is the average opening ratio of the lower limit and rho_center+0.345×$(phi/30)^{-2}$ is the average opening ratio of the upper limit.

Even more preferably, the above-described absorbance falls within the range of the average opening ratio at which the absorbance is 30% or more, 40% or more, or 45% or more, so that the absorbance can be further increased.

As described above, the characteristics of the sound absorbing phenomenon due to friction in the through-hole were clarified by simulation. The magnitude of the absorbance was determined by the thickness of the plate-shaped member, the average opening diameter of the through-holes, and the average opening ratio, and the optimum value range was determined.

Example 11

As Example 11, a soundproof structure having a structure in which the first frame body 16, the micro perforated plate 12, the second frame body 18, and the rear plate 20 were laminated in this order as shown in FIG. 10 was manufactured.

The micro perforated plate 12 was manufactured in the same manner as in Example 1 (thickness: 20 μm, average opening diameter: 25 μm, average opening ratio: 6.2%).

As the second frame body 18, one formed of an aluminum material and having a thickness of 30 mm and an opening portion having a diameter of 40 mm was used.

The material of the rear plate 20 was aluminum, and the thickness was 5 cm.

The first frame body 16 had a plurality of hole portions 17 having a diameter of 2 mm on an acrylic plate having a thickness of 1 mm, and a vertical acoustic absorption rate was measured in the same manner as in Example 1 while changing the opening ratio to 8%, 19%, and 31%. (Vertical acoustic) absorption rate is defined as "1−reflectivity".

Figure 52:
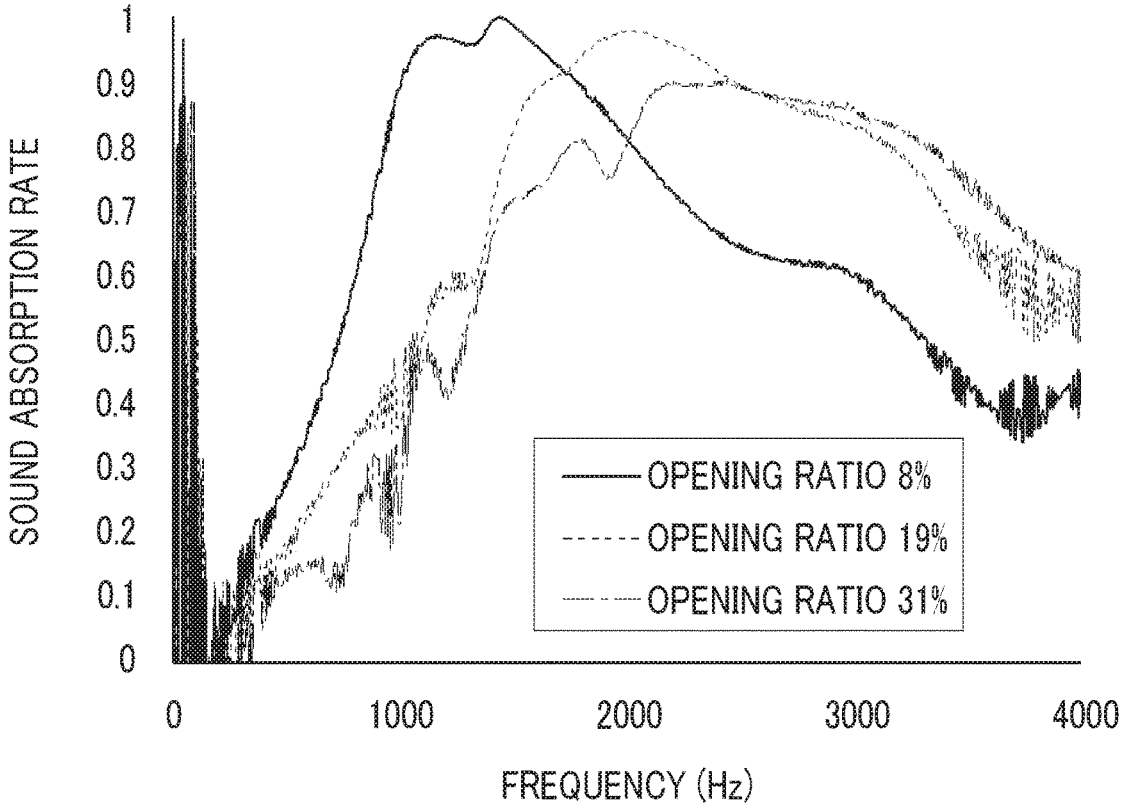
FIG. 52 is a graph showing the relationship between the frequency and the sound absorption rate.

The result is shown in FIG. 52.

From FIG. 52, it can be seen that as the opening ratio of the hole portion of the first frame body becomes smaller, the center frequency becomes a lower frequency and the band becomes narrower. This is because the inductance component due to the hole portion becomes larger as the opening ratio and the opening diameter of the hole portion of the first frame body become smaller. Therefore, by adjusting the opening diameter and the opening ratio of the hole portion of the first frame body according to the application of the soundproof structure, it is possible to obtain the sound absorbing characteristics of the low frequency narrow band or the medium frequency broad band.

Example 12

Figure 53:
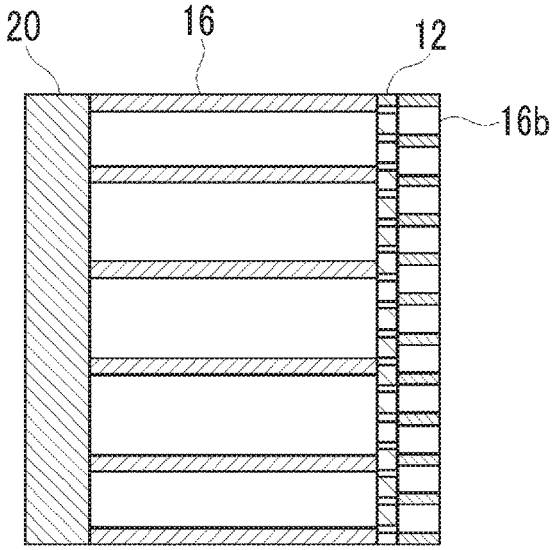
FIG. 53 is a schematic cross-sectional view illustrating the configuration of a soundproof structure of an example.

As Example 12, a soundproof structure having a structure in which a first frame body **16*b*, the micro perforated plate 12, the first frame body 16, and the rear plate 20 were laminated in this order as shown in FIG. 53 was manufactured. That is, a soundproof structure was manufactured by disposing the first frame body 16*b* on the micro perforated plate 12** of the soundproof structure manufactured in Example 10.

The first frame body **16*b* had a plurality of hole portions 17 having a diameter of 2 mm on an acrylic plate having a thickness of 1 mm, and a vertical acoustic absorption rate was measured in the same manner as in Example 1 while changing the opening ratio to 8%, 19%, and 31%. The result is shown in FIG. 54**.

Figure 54:
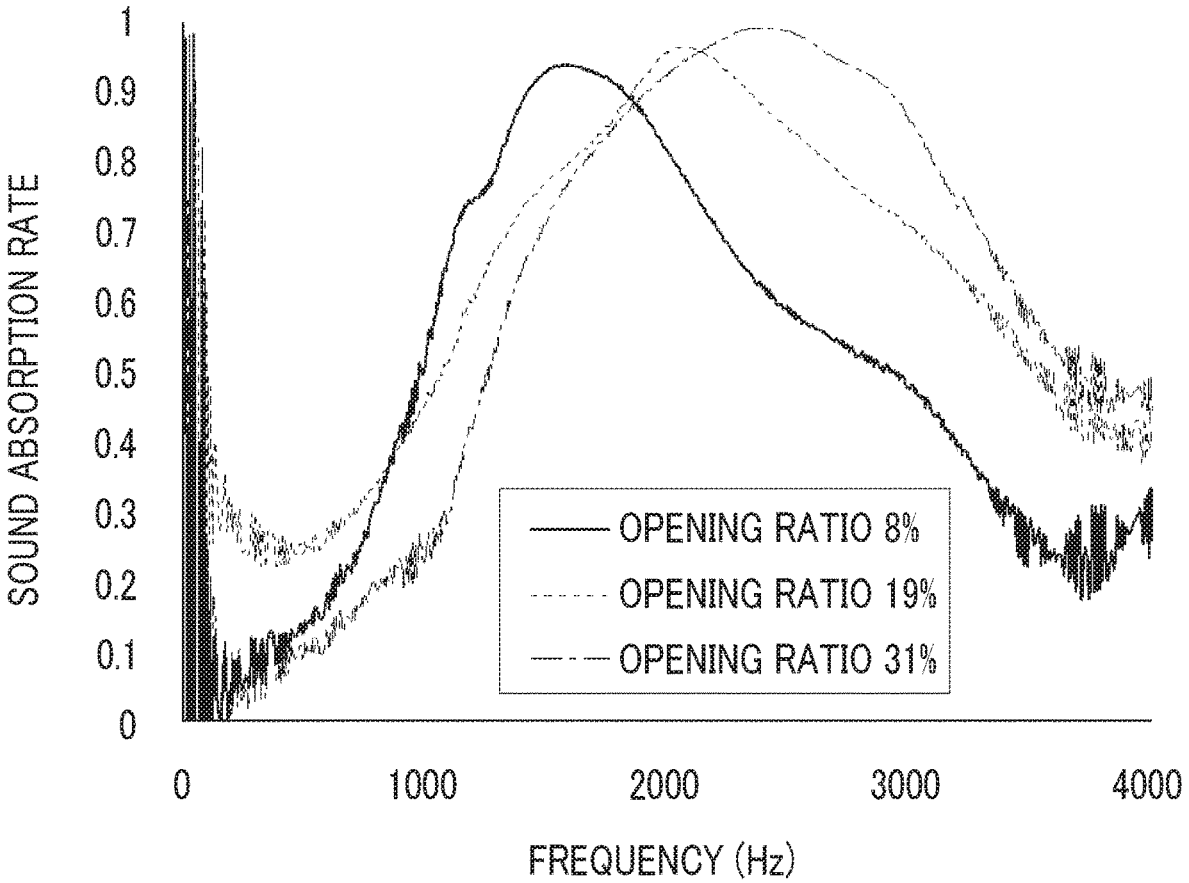
FIG. 54 is a graph showing the relationship between the frequency and the sound absorption rate.

From FIG. 54, it can be seen that as the opening ratio of the hole portion of the first frame body **16*b* becomes smaller, the center frequency becomes a lower frequency and the band becomes narrower. This is because the inductance component due to the hole portion becomes larger as the opening ratio and the opening diameter of the hole portion of the first frame body 16*b*** become smaller. Therefore, by adjusting the opening diameter and the opening ratio of the hole portion of the first frame body according to the application of the soundproof structure, it is possible to obtain the sound absorbing characteristics of the low frequency narrow band or the medium frequency broad band.

The average opening diameter phi and the average opening ratio rho of the through-holes formed in the micro perforated plate used in Example 1 and the like are in the above-described range having rho_center=(2+0.25×t)×$phi^{-1.6}$ as its center, rho_center−(0.052×$(phi/30)^{-2}$) as its lower limit, and rho_center+(0.795×$(phi/30)^{-2}$) as its upper limit. A micro perforated plate having through-holes in such a range has a small inductance component and a high acoustic resistance value since the micro perforated plate has an appropriate average opening ratio and thin and small through-holes. Therefore, high sound absorbing characteristics can be obtained in a broad band.

In the micro perforated plate 12, since the first frame body 16 is disposed, the acoustic resistance due to the hole portion of the first frame body 16 is added and the resistance becomes too large. Accordingly, there is a possibility that the sound absorbing performance will be lowered. A vertical incidence sound absorption rate α at a resonance frequency at which the imaginary part of the impedance is zero is expressed by the following Equation (1) using a micro perforated plate standardized by the impedance (ρc) of air and $R_{total}$ that is the sum of the acoustic resistance values of the first frame body. (Acoustic Absorbers and Diffusers, Authors: Trevor Cox, Peter D'Antonio, pp 27, Aug. 24, 2016 by CRC Press)

$$\alpha=1-(1-R\text{total})2/(1+R\text{total})2 \quad (1)$$

In order to obtain a vertical incidence sound absorption rate of 20% or more at the resonance frequency, $R_{total}$ needs to be 0.056 or more and 18 or less. In order to obtain a vertical incidence sound absorption rate of 50% or more at the resonance frequency, $R_{total}$ needs to be 0.17 or more and 6 or less.

In the micro perforated plate in which the average opening diameter phi and the average opening ratio rho of the through-holes are in the above-described range, the inductance component is small and the acoustic resistance value is close to 1. Therefore, in order to obtain the vertical incidence sound absorption rate described above, the acoustic resistance of the hole portion of the first frame body is preferably 17 or less, more preferably 5 or less.

Since the resistance value increases as the opening diameter of the hole portion decreases, the opening diameter of the first frame body 16 is preferably 0.1 mm or more. In addition, it is known that the air friction resistance on the side wall of the hole portion significantly increases in a case where the opening diameter is 1 mm or less ("Potential of microperforated panel absorber" J. Acoust. Soc. Am. 104, 2861-2866 1998). For this reason, the opening diameter of the hole portion is more preferably 1 mm or more. In addition, since it is difficult to manufacture a frame body having a thickness larger than the opening diameter of the hole portion, the ratio of the thickness of the frame body and the opening diameter of the hole portion is preferably 1 or less.

The resistance value r in the hole portion of the frame body can be expressed by the following Equation (2). (Acoustic Absorbers and Diffusers, authors: Trevor Cox, Peter D'Antonio, pp 245, Aug. 24, 2016 by CRC Press)

$$r=\rho/\varepsilon\times\sqrt{(8\mu\omega)}\times(1+t/a) \quad (2)$$

Here, ρ is the air density, ε is the opening ratio, μ is the air friction coefficient, t is the thickness of the frame body, and a is the opening diameter of the hole portion of the frame body.

In a case where the aspect ratio is equal to or less than 1 (t=a), in order to set the acoustic resistance value of the hole portion of the frame body to 17 or less, it is necessary to set the opening ratio to 0.1% or more. In addition, in order to set the acoustic resistance value of the hole portion of the frame body to 5 or less, it is necessary to set the opening ratio to 0.3% or more.

From the above, the effect of the present invention is obvious.

EXPLANATION OF REFERENCES

10*a* to 10*e*: soundproof structure
11: aluminum base material
12: micro perforated plate
13: aluminum hydroxide coating film
14: through-hole
16: first frame body
17: hole portion
18, 46, 50, 58: second frame body
19: opening portion
20: rear plate
30*a* to 30*h*, 52: soundproof member
31*a* to 31*e*, 44, 48, 54: soundproof cell
32: cover
34: wind shield member
35: flow control mechanism
36: attachment and detachment mechanism
38: wall
42*a*: protruding portion
42*b*: recessed portion
56: frame
58*a*: frame members on both outer sides and central frame member
58*b*: frame members of other portions
z: perpendicular direction of film surface
s: direction perpendicular to opening cross section
q: region serving as ventilation port
W: wind
M: microphone
P: acoustic tube

What is claimed is:

1. A soundproof structure, comprising:
a micro perforated plate having a plurality of through-holes passing therethrough in a thickness direction; and
a first frame body that is disposed in contact with one surface of the micro perforated plate and has a plurality of hole portions,
wherein an average opening diameter of the through-holes is 0.1 μm or more and less than 100 μm,
an opening diameter of the hole portion of the first frame body is larger than an opening diameter of the through-hole of the micro perforated plate,
an opening ratio of the hole portion of the first frame body is larger than an opening ratio of the through-hole of the micro perforated plate,
a resonance vibration frequency of the micro perforated plate in contact with the first frame body is higher than an audible range, and
assuming that the average opening diameter of the through-holes is phi (μm) and a thickness of the micro perforated plate is t (μm), an average opening ratio rho of the through-holes is in a range having rho_center=$(2+0.25\times t)\times phi^{-1.6}$ as its center, rho_center−$(0.052\times(phi/30)^{-2})$ as its lower limit, and rho_center+$(0.795\times(phi/30)^{-2})$ as its upper limit, which is a range larger than 0 and smaller than 1.

2. The soundproof structure according to claim 1,
wherein the opening diameter of the hole portion of the first frame body is 22 mm or less.

3. The soundproof structure according to claim 1, further comprising:
two first frame bodies that are disposed in contact with both surfaces of the micro perforated plate.

4. The soundproof structure according to claim 1,
wherein the first frame body is bonded and fixed to the micro perforated plate.

5. The soundproof structure according to claim 1,
wherein the micro perforated plate is formed of metal or synthetic resin.

6. The soundproof structure according to claim 1,
wherein the micro perforated plate is formed of aluminum or an aluminum alloy.

7. The soundproof structure according to claim 1, wherein the first frame body has a honeycomb structure.

8. The soundproof structure according to claim 1, wherein the first frame body is formed of metal.

9. The soundproof structure according to claim 1, wherein the first frame body is formed of synthetic resin.

10. The soundproof structure according to claim 1, wherein the first frame body is formed of paper.

11. The soundproof structure according to claim 1, wherein the first frame body is formed of any one of aluminum, iron, an aluminum alloy, or an iron alloy.

12. The soundproof structure according to claim 1, further comprising:

a rear plate that is disposed on a surface of the first frame body opposite to a surface on which the micro perforated plate is disposed.

13. The soundproof structure according to claim 1, further comprising:

a rear plate that is disposed so as to be spaced apart from a laminate of the micro perforated plate and the first frame body.

14. The soundproof structure according to claim 1, further comprising:

a second frame body having one or more opening portions; and a soundproof cell which covers the one or more opening portions of the second frame body and in which a laminate of the micro perforated plate and the first frame body is disposed.

15. An opening structure, comprising:

the soundproof structure according to claim 14; and an opening member having an opening, wherein the soundproof structure is disposed in the opening of the opening member such that a perpendicular direction of a film surface of the micro perforated plate crosses a direction perpendicular to an opening cross section of the opening member, and a region serving as a ventilation port through which gas passes is provided in the opening member.

* * * * *